US011211013B2

(12) United States Patent
Kim et al.

(10) Patent No.: US 11,211,013 B2
(45) Date of Patent: Dec. 28, 2021

(54) GATE DRIVING CIRCUIT AND DISPLAY APPARATUS COMPRISING THE SAME

(71) Applicant: LG Display Co., Ltd., Seoul (KR)

(72) Inventors: KwangSoo Kim, Paju-si (KR); HongJae Shin, Paju-si (KR); JaeKyu Park, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/132,735

(22) Filed: Dec. 23, 2020

(65) Prior Publication Data

US 2021/0201816 A1 Jul. 1, 2021

(30) Foreign Application Priority Data

Dec. 31, 2019 (KR) ..... 10-2019-0180121

(51) Int. Cl.
*G09G 3/3266* (2016.01)

(52) U.S. Cl.
CPC ... *G09G 3/3266* (2013.01); *G09G 2310/0286* (2013.01); *G09G 2310/08* (2013.01)

(58) Field of Classification Search
CPC .. G09G 3/3233; G09G 3/3266; G09G 3/3611; G09G 3/3674; G06F 3/04166; G06F 2300/0408; G06F 2300/0861; G06F 2310/0205; G06F 2310/021; G06F 2310/0221; G06F 2310/0224; G06F 2310/0243; G06F 2310/0264; G06F 2310/0267; G06F 2310/0286; G06F 2310/063; G06F 2310/08; G06F 2320/106; G06F 2320/0295; G06F 2230/00
See application file for complete search history.

(56) References Cited

U.S. PATENT DOCUMENTS

2007/0195055 A1* 8/2007 Kim ..... G09G 3/3677 345/100
2015/0170592 A1* 6/2015 Bai ..... G11C 19/28 345/100
2018/0047329 A1* 2/2018 Shang ..... G09G 3/3666
2019/0206294 A1* 7/2019 Tian ..... G11C 19/28
2020/0265762 A1* 8/2020 Zhao ..... G11C 19/28

FOREIGN PATENT DOCUMENTS

KR 10-2016-0017390 A 2/2016

* cited by examiner

*Primary Examiner* — Michael J Eurice
(74) *Attorney, Agent, or Firm* — Seed IP Law Group LLP

(57) ABSTRACT

A gate driving circuit and a display apparatus including the same are disclosed, in which a plurality of gate lines may be driven through one stage circuit. The gate driving circuit includes first to mth stage circuits outputting a plurality of scan signals by dividing the scan signals into a first signal group and a second signal group. The first to mth stage circuits are grouped into k number of stage groups having two adjacent stage circuits, stage circuits of jth stage group (j is a natural number of 1 to k−1) output the scan signals of the first signal group to be earlier than the scan signals of the second signal group, and stage circuits of (j+1)th stage group output the scan signals of the second signal group to be earlier than the scan signals of the first signal group.

20 Claims, 22 Drawing Sheets

GATE DRIVING CIRCUIT AND DISPLAY APPARATUS COMPRISING THE SAME

CROSS-REFERENCE TO RELATED APPLICATIONS

This disclosure claims the benefit of and priority to the Korean Patent Application No. 10-2019-0180121, filed Dec. 31, 2019, the entirety of which is hereby incorporated by reference as if fully set forth herein.

BACKGROUND

Technical Field

The present disclosure relates to a gate driving circuit and a display apparatus comprising the same.

Description of the Related Art

Recently, a display apparatus has become more important with the development of multimedia. In this respect, a flat panel display apparatus such as a liquid crystal display apparatus, an organic light emitting display apparatus, and a micro light emitting diode display apparatus has been commercially used.

The flat panel display apparatus includes a display panel including a plurality of pixels having a thin film transistor connected to data and gate lines, a data driving circuit portion supplying a data voltage to the data line, and a gate driving circuit portion comprised of a shift register having a plurality of stages for supplying a gate signal to the gate line.

Recently, a Gate In Panel (GIP)-type display apparatus, in which a transistor constituting a stage of a shift register is embedded in a non-display area of a display panel in the form of a thin film transistor, has been used simultaneously with a manufacturing process of a thin film transistor of each pixel to simplify a structure of circuit components, reduce the manufacturing cost and reduce a bezel width.

However, with high resolution and a thin bezel of a display apparatus, a gate driving circuit that may drive two or more gate lines in one stage is required.

BRIEF SUMMARY

The inventors of the present disclosure have recognized that a display device with a reduced bezel width would be beneficial in the consumer market. To address one or more technical challenges and problems of the related art, the inventors have provided a display device including a gate driving circuit that may drive two or more gate lines in one stage. This allows various technical benefits including the reduction of bezel width, reducing of manufacturing cost, and achieving high resolution in displays.

One or more embodiments of the present disclosure provides a gate driving circuit and a display apparatus including the same, in which a plurality of gate lines may be driven through one stage circuit.

One or more embodiments of the present disclosure provides a gate driving circuit and a display apparatus including the same, in which a size of the gate driving circuit is reduced.

Further embodiments of the present disclosure provides a display apparatus in which power consumption is reduced.

In addition to the benefits of the present disclosure as mentioned above, additional benefits and features of the present disclosure will be clearly understood by those skilled in the art from the following description of the present disclosure.

A gate driving circuit according to one embodiment of the present disclosure includes first to mth stage circuits outputting a plurality of scan signals by dividing the scan signals into a first signal group and a second signal group, wherein the first to mth stage circuits are grouped into k number of stage groups having two adjacent stage circuits, stage circuits of jth stage group (j is a natural number of 1 to k−1) output the scan signals of the first signal group to be earlier than the scan signals of the second signal group, and stage circuits of (j+1)th stage group output the scan signals of the second signal group to be earlier than the scan signals of the first signal group.

According to one embodiment of the present disclosure, the first signal group may include odd numbered scan signals of the plurality of scan signals, and the second signal group may include even numbered scan signals of the plurality of scan signals.

A gate driving circuit according to one embodiment of the present disclosure includes a plurality of scan shift clock lines transferring a plurality of scan shift clocks, a plurality of carry shift clock lines transferring a plurality of carry shift clocks, and first to mth stage circuits selectively connected to the plurality of scan shift clock lines and connected to any one of the plurality of carry shift clock lines, wherein the first to mth stage circuits are grouped into k number of stage groups having two adjacent stage circuits, and the order of scan signals output from odd numbered stage groups of the k number of stage groups is different from the order of scan signals output from even numbered stage groups.

Details according to various embodiments of the present disclosure in addition to the above benefits are included in the detailed description and drawings.

According to one embodiment of the present disclosure, a gate driving circuit and a display apparatus comprising the same may be provided, in which a plurality of gate lines may be driven through one stage circuit.

According to one embodiment of the present disclosure, a gate driving circuit and a display apparatus comprising the same may be provided, in which a size of the gate driving circuit is reduced.

According to one embodiment of the present disclosure, a display apparatus may be provided, in which power consumption is reduced.

In addition to the effects of the present disclosure as mentioned above, additional advantages and features of the present disclosure will be clearly understood by those skilled in the art from the above description of the present disclosure.

BRIEF DESCRIPTION OF THE SEVERAL VIEWS OF THE DRAWINGS

The above and other features and other advantages of the present disclosure will be more clearly understood from the following detailed description taken in conjunction with the accompanying drawings, in which.

DETAILED DESCRIPTION

Figure 1:
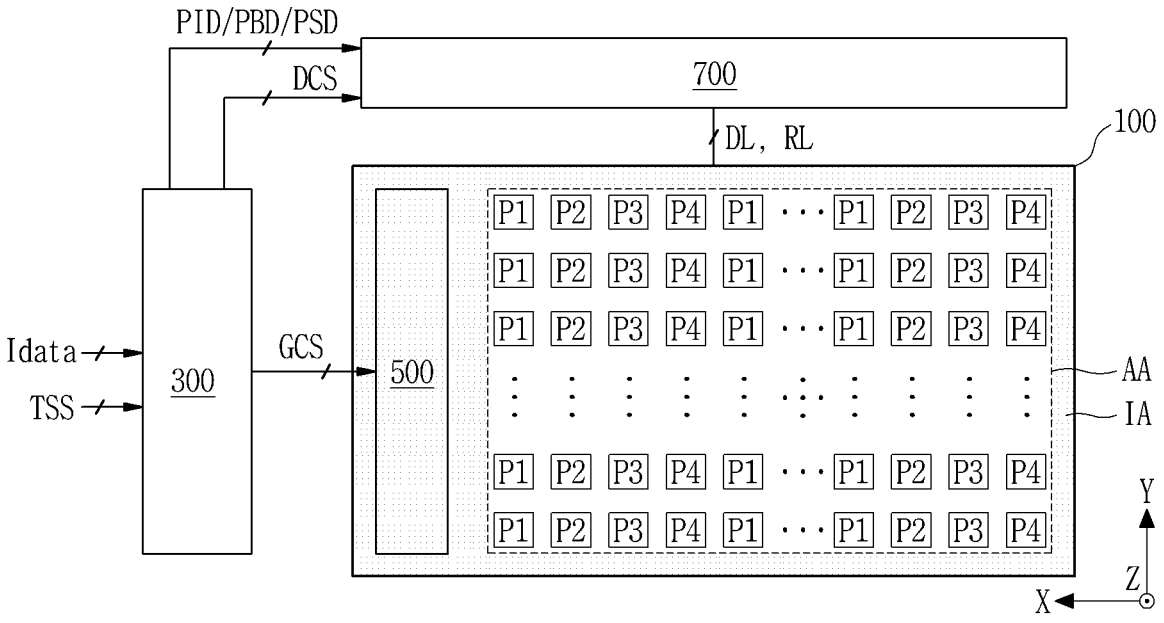
FIG. 1 is a view illustrating a display apparatus according to one embodiment of the present disclosure.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art.

A shape, a size, a ratio, an angle, and a number disclosed in the drawings for describing embodiments of the present disclosure are merely an example, and thus, the present disclosure is not limited to the illustrated details. Like reference numerals refer to like elements throughout the specification. In the following description, when the detailed description of the relevant known function or configuration is determined to unnecessarily obscure the important point of the present disclosure, the detailed description will be omitted.

In a case where 'comprise,' 'have,' and 'include' described in the present disclosure are used, another part may be added unless 'only~' is used. The terms of a singular form may include plural forms unless referred to the contrary.

In construing an element, the element is construed as including an error range although there is no explicit description.

In describing a position relationship, for example, when the position relationship is described as 'upon~,' 'above~,' 'below~,' and 'next to~,' one or more portions may be arranged between two other portions unless 'just' or 'direct' is used.

In describing a time relationship, for example, when the temporal order is described as 'after~,' 'subsequent~,' 'next~,' and 'before~,' a case which is not continuous may be included unless 'just' or 'direct' is used.

It will be understood that, although the terms "first," "second," etc., may be used herein to describe various elements, these elements should not be limited by these terms. These terms are only used to distinguish one element from another. For example, a first element could be termed a second element, and, similarly, a second element could be termed a first element, without departing from the scope of the present disclosure.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

In the present disclosure, a subpixel circuit and a gate driving circuit, which are formed on a substrate of a display panel, may be embodied as n-type MOSFET type thin film transistors but are not limited thereto. The pixel circuit and the gate driving circuit may be embodied as p-type MOSFET type thin film transistors. The thin film transistor may include a gate, a source, and a drain. In the thin film transistor, a carrier moves from the source to the drain. In the n-type thin film transistor, since the carrier is an electron, a source voltage is lower than a drain voltage such that the electron may move from the source to the drain. In the n-type thin film transistor, since the electron moves from the source to the drain, a current moves from the drain to the source. In the p-type thin film transistor, since the carrier is a hole, the source voltage is higher than the drain voltage in order for the hole to move from the source to the drain. In the p-type thin film transistor, since the hole moves from the source to the drain, a current moves from the source to the drain. In the MOSFET type thin film transistor, the source and the drain are not fixed but may be changed depending on a voltage applied thereto. Therefore, in the description of the embodiment according to the present disclosure, a description will be given based on that any one of the source and the drain is referred to as a first source/drain electrode and the other one of the source and the drain is referred to as a second source/drain electrode.

Hereinafter, a gate driving circuit and a display apparatus comprising the gate driving circuit according to the present disclosure will be described in detail with reference to the accompanying drawings. Wherever possible, the same reference numbers will be used throughout the drawings to refer to the same or like parts. Since a scale of each of elements shown in the accompanying drawings is different from an actual scale for convenience of description, the present disclosure is not limited to the shown scale.

Figure 2:
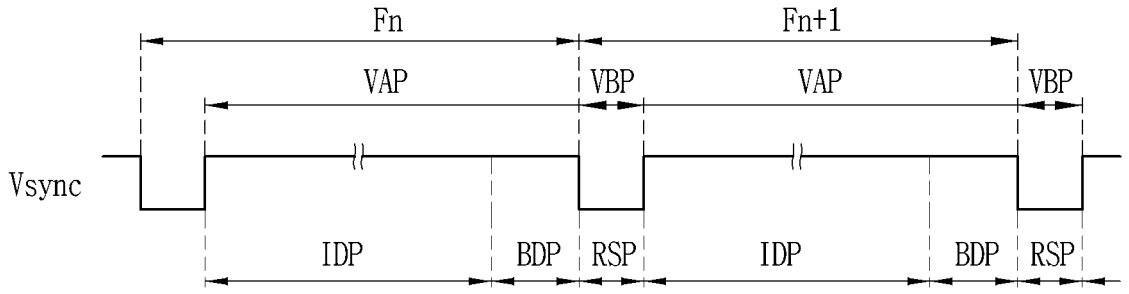
FIG. 2 is a view illustrating an operation period of a display panel shown in FIG. 1.
Figure 3:
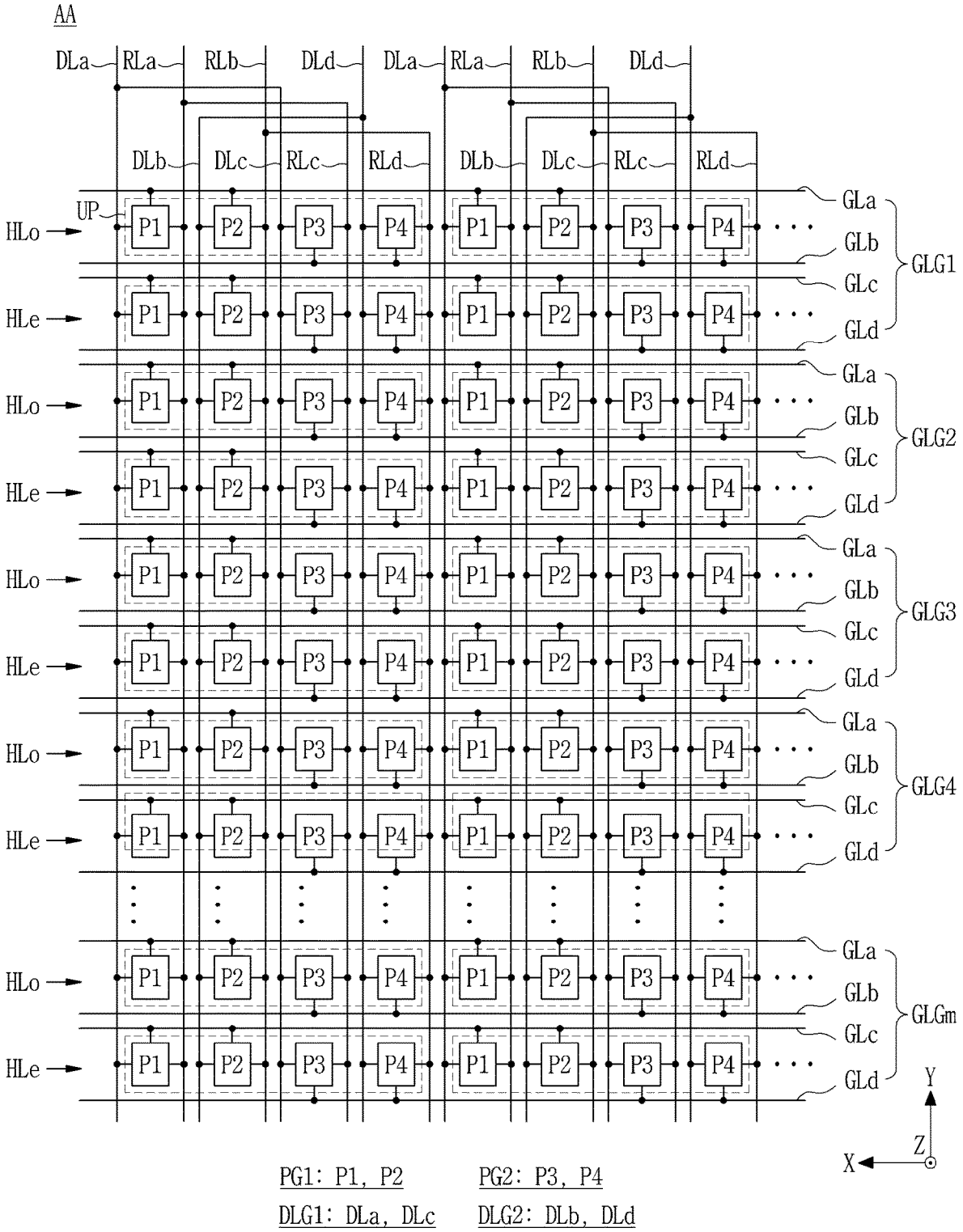
FIG. 3 is a view illustrating an arrangement structure of pixels shown in FIG. 1.

FIG. 1 is a view illustrating a display apparatus according to one embodiment of the present disclosure, FIG. 2 is a view illustrating an operation period of a display panel shown in FIG. 1, and FIG. 3 is a view illustrating an arrangement structure of pixels shown in FIG. 1.

Referring to FIGS. 1 to 3, the display apparatus according to one embodiment of the present disclosure may include a display panel 100, a timing controller 300, a gate driving circuit portion 500, and a data driving circuit portion 700.

The display panel 100 may include a display area AA (or active area) defined on a substrate, and a non-display area IA (or inactive area) adjacent to the display area AA.

The display area AA may include a plurality of unit pixels UP, first to mth gate line groups GLG1 to GLGm, a plurality of data lines DL, and a plurality of reference lines RL.

Each of the plurality of unit pixels UP may be disposed on a substrate to be spaced apart from one another along a first direction X and a second direction Y crossing the first direction X.

Each of the plurality of unit pixels UP according to one embodiment may include first to fourth subpixels P1, P2, P3 and P4. For example, the first subpixel P1 may include a red subpixel P1, the second subpixel P2 may include a white subpixel P2, the third subpixel P3 may include a blue subpixel P3, and the fourth subpixel P4 may include a green subpixel P4.

The first to fourth subpixels P1, P2, P3 and P4 may be grouped into first and second pixel groups PG1 and PG2 having two adjacent subpixels along a first direction X.

The second line portion which reads "and the second pixel group PG2" is replaced with "and the second pixel group PG2".

The first and second pixel groups PG1 and PG2 may be driven at their respective timings different from each other. For example, a driving order of the first and second pixel groups PG1 and PG2 may be changed in a unit of 4-horizontal period. According to one embodiment, the first pixel group PG1 may be driven to be earlier than the second pixel group PG2 for (8x−7)th (x is a natural number) to (8x−4)th horizontal periods of horizontal periods of one frame. The second pixel group PG2 may be driven to be earlier than the first pixel group PG1 for (8x−3)th to (8x)th horizontal periods of the horizontal periods of one frame.

Each of the first to mth gate line groups GLG1 to GLGm may be extended longitudinally along the first direction X and disposed to be spaced apart from another gate line group on a substrate along a second direction Y crossing the first direction X.

Each of the first to mth gate line groups GLG1 to GLGm may include four gate lines GLa, GLb, GLc and GLd. For example, each of the first to mth gate line groups GLG1 to GLGm may drive two unit pixels UP, which are adjacent to each other up and down, along the second direction Y in a given order in accordance with a non-sequential manner for 2-horizontal period.

According to one embodiment, in each of the first to mth gate line groups GLG1 to GLGm, the odd numbered gate lines or (2x−1)th gate lines GLa and GLc of the four gate lines GLa, GLb, GLc and GLd may be connected to any one of the first and second pixel groups PG1 and PG2 disposed in horizontal lines HL of the display area AA. The even numbered gate lines or (2x)th gate lines GLb and GLd of the four gate lines GLa, GLb, GLc and GLd may be connected to the other one of the first and second pixel groups PG1 and PG2 disposed in the horizontal lines HL of the display area AA. For example, the (2x−1)th gate lines GLa and GLc of the four gate lines GLa, GLb, GLc and GLd may be embodied to simultaneously drive the first and second subpixels P1 and P2 of the first pixel group PG1 disposed in each horizontal line HLe. The (2x)th gate lines GLb and GLd of the four gate lines GLa, GLb, GLc and GLd may be embodied to simultaneously drive the third and fourth subpixels P3 and P4 of the second pixel group PG2 disposed in each horizontal line HLe.

The first to mth gate line groups GLG1 to GLGm may be grouped into k number of inversion driving groups having two adjacent gate line groups. For example, the nth gate line group GLGn and the (n+1)th gate line group GLGn+1, which are adjacent to each other, among the first to mth gate line groups GLG1 to GLGm may be grouped into one inversion driving group. For example, one inversion driving group may include a total of eight gate lines.

Each of the plurality of data lines DLa, DLb, DLc and DLd may be extended longitudinally along the second direction Y and disposed to be spaced apart from another data line on the substrate along the first direction X.

Each of the plurality of data lines DLa, DLb, DLc and DLd according to one embodiment may commonly connected with the subpixels P1, P2, P3 and P4 disposed along the second direction Y.

Four data lines DLa, DLb, DLc and DLd disposed in one unit pixel UP may be grouped into the first and second data line groups DLG1 and DLG2 having two data lines that are not directly adjacent to each other along the first direction X.

The odd numbered data lines DLa and DLc of the four data lines DLa, DLb, DLc and DLd may electrically be connected with each other and grouped into the first data line group DLG1. The even numbered data lines DLb and DLd of the four data lines DLa, DLb, DLc and DLd may electrically be connected with each other and grouped into the second data line group DLG2.

The data lines of the first data line group DLG1 may electrically be connected with the first subpixel P1 of the first pixel group PG1 and the third subpixel P3 of the second pixel group PG2. The data lines of the second data line group DLG2 may electrically be connected with the second subpixel P2 of the first pixel group PG1 and the fourth subpixel P4 of the second pixel group PG2. The subpixels of the first pixel group PG1 and the subpixels of the second pixel group PG2 may be connected with different data lines or the same gate line.

Since the four subpixels P1, P2, P3 and P4 disposed in one unit pixel UP are driven by two data lines not four data lines, the number of data lines DL electrically connected with the data driving circuit portion 700 may be reduced to ½, whereby a size of the data driving circuit portion 700 may be reduced.

Each of the plurality of reference lines RL may be disposed on the substrate to be parallel with each of the plurality of data lines DL. For example, the reference lines RL may be expressed as sensing lines.

The reference lines RL are connected with the subpixels P1, P2, P3 and P4 in the same manner as the data lines DLa, DLb, DLc and DLd. Therefore, the number of reference lines RL electrically connected with the data driving circuit portion 700 may be reduced to ½, whereby the size of the data driving circuit portion 700 may be reduced.

The timing controller 300 may be embodied to control the display panel 100 in a display mode and a sensing mode based on a vertical synchronization signal and a horizontal synchronization signal of a timing synchronization signal TSS provided from a display driving system (or host controller).

The display mode of the display panel 100 may be driving for sequentially displaying an input image and a black image, which have a certain time difference, in a plurality of horizontal lines. The display mode according to one embodiment may include an image display period (or light emitting display period) IDP for displaying an input image, and a black display period (or impulse non-light emission period) for displaying a black image. The black display period BDP of the display mode may be omitted in accordance with a driving frequency of the display apparatus or motion picture response characteristic of the display apparatus.

The sensing mode (or real-time sensing mode) of the display panel 100 may be real-time sensing driving for sensing a driving characteristic of the subpixels P1, P2, P3 and P4 disposed in one of the plurality of horizontal lines and updating a compensation value per subpixel to compensate for a driving characteristic change of the corresponding subpixels P1, P2, P3 and P4 based on the sensed value, after the image display period (IDP) in one frame. The sensing mode according to one embodiment may sense driving characteristics of the subpixels P1, P2, P3 and P4 disposed in any one of the plurality of horizontal lines in accordance with an irregular order in a vertical blank period VBP of each frame. Since the subpixels P1, P2, P3 and P4 emitting light in accordance with the display mode do not emit light in the sensing mode, line dim may occur due to non-light emission of the sensed horizontal line when the horizontal lines are sensed sequentially in the sensing mode. On the other hand, when the horizontal lines are sensed in the sensing mode in an irregular order or a random order, line dim may be reduced or minimized or avoided due to a visual dispersion effect.

According to one embodiment, the timing controller 300 may set each frame Fn, Fn+1 for displaying an image on the display panel 100 to the image display period IDP, the black display period BDP and the real-time sensing period RSP. For example, the timing controller 300 may set a vertical active period VAP of one frame period Fn, Fn+1 to the display period IDP, BDP for the display mode, and may set the vertical blank period VBP to the sensing period (or real-time sensing period) RSP for the sensing mode.

The timing controller 300 may vary a duty (or light emission duty) of the image display period IDP by controlling a start timing of the black display period BDP in one frame Fn, Fn+1. The timing controller 300 according to one embodiment may extract a motion vector of input images by comparing and analyzing the input images on a basis of frame Fn, Fn+1, and may vary the start timing of the black display period BDP in accordance with the motion vector of the images. For example, the timing controller 300 may reduce the duty of the image display period IDP by advancing the start timing of the black display period BDP within one frame Fn, Fn+1 if the motion vector of the images is greater than a reference value, thereby increasing maximum instantaneous luminance of the subpixels P1, P2, P3 and P4. As a result, a motion picture response time may be reduced and at the same time motion blurring may be reduced or minimized. On the contrary, the timing controller 300 may increase the duty of the image display period IDP by delaying the start timing of the black display period BDP within one frame Fn, Fn+1 if the motion vector of the images is smaller than the reference value, thereby increasing luminance of the subpixels P1, P2, P3 and P4.

The timing controller 300 may generate and output a gate control signal GCS and a data control signal DCS for driving the display panel 100 in the image display period IDP, the black display period BDP and the sensing period RSP based on the timing synchronization signals TSS provided from the display driving system (or host controller).

According to one embodiment, the timing controller 300 may generate and output the gate control signal GCS and the data control signal DCS for divisionally driving one horizontal period into a first period (or first sub horizontal period) and a second period (or first sub horizontal period), based on the timing synchronization signal TSS.

The data control signal DCS may include a source start pulse, a source sampling clock and a source output enable to control the driving timing of the data driving circuit portion 700.

The gate control signal GCS may include a gate start signal, a first reset signal, a second reset signal, a gate driving clock, and a line sensing preparation signal to control the driving timing of the gate driving circuit portion 500.

The timing controller 300 may generate a respective gate driving clock in each of the image display period IDP, the black display period BDP, and the sensing period RSP. For example, the timing controller 300 may generate an image display gate driving clock in the image display period IDP, a black display gate driving clock in the black display period BDP, and a sensing gate driving clock in the sensing period RSP. The image display gate driving clock, the black display gate driving clock and the sensing gate driving clock may be different from one another.

The timing controller 300 may align input data Idata supplied from the display driving system (or host controller) per image display period IDP of the display mode as subpixel image data PID to correspond to a driving order (or given order) of the subpixels P1, P2, P3 and P4 disposed on the display panel 100 and then supply the aligned pixel image data to the data driving circuit portion 700.

According to one embodiment, when the unit pixel UP includes the white subpixel P2, the timing controller 300 may generate white input data based on red, green and blue input data Idata, and may align red, green blue and white input data as pixel image data PID to correspond to the arrangement structure and the driving order of the subpixels and provide the aligned data to the data driving circuit portion 700. For example, the timing controller 300 may convert red, green and blue input data to four colored data, i.e., red, green, blue and white data in accordance with a data conversion method disclosed in the Korean Laid-Open Patent No. 10-2013-0060476 or 10-2013-0030598.

The timing controller 300 may align input data Idata as pixel image data PID to be displayed for the first and second periods of each horizontal period. For example, the timing controller 300 may align the input data Idata as pixel image data PID to correspond to a driving order of the gate lines included in the first to mth gate line groups GLG1 to GLGm and a sharing structure of the data lines.

The timing controller 300 according to one embodiment may categorize the input data Idata into input data of the first pixel group PG1 and input data of the second pixel group PG2. The timing controller 300 may align input data of the first pixel group PG1 as input data of the first period and input data of the second pixel group PG2 as input data of the second period, for (8x−7)th to (8x−4)th horizontal periods of the horizontal periods of one frame. The timing controller 300 may align input data of the second pixel group PG2 as input data of the first period and input data of the first pixel group PG1 as input data of the second period, for (8x−3)th to (8x)th horizontal periods of the horizontal periods of one frame.

An aligning method of input data to be supplied to subpixels of first to eighth horizontal lines disposed on the display panel 100 will be described as an example.

The timing controller 300 may align input data, which are to be supplied to the first pixel group PG1 of the first horizontal line, among the input data Idata, as data corresponding to the first period of the first horizontal period, align input data, which are to be supplied to the first pixel group PG1 of the second horizontal line, as data corresponding to the second period of the first horizontal period, align input data, which are to be supplied to the first pixel group PG1 of the third horizontal line, as data corresponding to the first period of the second horizontal period, and align input data, which are to be supplied to the first pixel group PG1 of the fourth horizontal line, as data corresponding to the second period of the second horizontal period.

Then, the timing controller 300 may align input data, which are to be supplied to the second pixel group PG2 of the first horizontal line, among the input data Idata, as data corresponding to the first period of the third horizontal period, align input data, which are to be supplied to the second pixel group PG2 of the second horizontal line, as data corresponding to the second period of the third horizontal period, align input data, which are to be supplied to the second pixel group PG2 of the third horizontal line, as data corresponding to the first period of the fourth horizontal period, and align input data, which are to be supplied to the second pixel group PG2 of the fourth horizontal line, as data corresponding to the second period of the fourth horizontal period.

Then, the timing controller 300 may align input data, which are to be supplied to the second pixel group PG2 of the fifth horizontal line, among the input data Idata, as data corresponding to the first period of the fifth horizontal period, align input data, which are to be supplied to the second pixel group PG2 of the sixth horizontal line, as data corresponding to the second period of the fifth horizontal period, align input data, which are to be supplied to the second pixel group PG2 of the seventh horizontal line, as data corresponding to the first period of the sixth horizontal period, and align input data, which are to be supplied to the second pixel group PG2 of the eighth horizontal line, as data corresponding to the second period of the sixth horizontal period.

Then, the timing controller 300 may align input data, which are to be supplied to the first pixel group PG1 of the fifth horizontal line, among the input data Idata, as data corresponding to the first period of the seventh horizontal period, align input data, which are to be supplied to the first pixel group PG1 of the sixth horizontal line, as data corresponding to the second period of the seventh horizontal period, align input data, which are to be supplied to the first pixel group PG1 of the seventh horizontal line, as data corresponding to the first period of the eighth horizontal period, and align input data, which are to be supplied to the first pixel group PG1 of the eighth horizontal line, as data corresponding to the second period of the eighth horizontal period.

According to the data alignment method described as above, the data of the first pixel group PG1 and the data of the second pixel group PG2 are alternately aligned as input data of the same color in a unit of 4-horizontal period or eight horizontal lines after the first and second horizontal periods, whereby the input data having the same color may be continuous for 4-horizontal period. According to this data alignment method, as the input data of the same color are continuous for 4-horizontal period, data transition times in the data driving circuit portion 700 may remarkably be reduced, whereby power consumption of the data driving circuit portion 700 and moreover the display apparatus may be reduced.

The timing controller 300 may provide subpixel black data PBD per black display period BDP of the display mode and supply the generated pixel black data PBD to the data driving circuit portion 700. For example, the timing controller 300 may generate a preset non-light emitting gray scale value or black gray scale value of the light emitting diode ELD as subpixel black data PBD.

The timing controller 300 may generate subpixel sensing data PSD per sensing period RSP of the sensing mode and supply the generated pixel sensing data PSD to the data driving circuit portion 700. For example, the timing controller 300 may generate a gray scale value, which may turn on the driving thin film transistor of the subpixels P1, P2, P3 and P4 disposed in a horizontal line to be sensed in the sensing period RSP, as subpixel sensing data PSD. At this time, the subpixel sensing data PSD corresponding to the subpixels constituting a unit pixel may have the same gray scale value or respective gray scale values different per subpixel.

The gate driving circuit portion 500 may be disposed in the non-display area IA of the display panel 100 and electrically connected with the plurality of gate line groups GLG. The gate driving circuit portion 500 may drive the first to mth gate line groups GLG1 to GLGm based on the gate control signal GCS supplied from the timing controller 300 in accordance with a given order.

The gate driving circuit portion 500 may generate scan signals respectively corresponding to the image display period IDP, the black display period BDP and the sensing period RSP based on the gate control signal GCS supplied from the timing controller 300, and may supply the generated scan signals to the corresponding gate line. For example, the gate driving circuit portion 500 may supply the scan signals to the gate lines in the vertical active period VAP of each frame period in accordance with a given order.

Also, the gate driving circuit portion 500 may supply the scan signals to any one of the gate lines per vertical black period VBP of each frame period Fn, Fn+1.

According to one embodiment, the gate driving circuit portion 500 may output scan signals having a first scan pulse corresponding to the image display period IDP and a second scan pulse corresponding to the black display period BDP in the display mode in accordance with a given order.

Optionally, the gate driving circuit portion 500 may group the plurality of gate line groups GLG into a plurality of horizontal groups, and may simultaneously supply the second scan pulse of the scan signals on a horizontal group basis in the black display period BDP of the display mode. For example, when the display area AA is virtually divided into a first area and a second area, the gate driving circuit portion 500 may simultaneously supply the second scan pulse of the scan signals to the gate lines disposed in the second area in the display mode, in the middle of sequentially supplying the first scan pulse of the scan signals to the gate lines disposed in the first area.

The gate driving circuit portion 500 may directly be formed or embedded in the non-display area IA of the display panel 100 and thus connected with the of gate lines individually in accordance with the manufacturing process of the thin film transistor.

As an example, the gate driving circuit portion 500 may be embodied in the non-display area IA at a left side of the substrate and drive the gate lines in accordance with a single feeding method in due order.

As another example, the gate driving circuit portion 500 may be embodied in the non-display area IA at each of a left side and a right side of the substrate and drive the gate lines in accordance with a double feeding method or a single feeding method in due order. For example, in the single feeding method, the gate driving circuit portion 500 embodied in the non-display area IA at the left side of the substrate may sequentially drive the odd numbered gate line groups of the gate lines, and the gate driving circuit portion 500 embodied in the non-display area IA at the right side of the substrate may sequentially drive the even numbered gate line groups of the gate lines. In the double feeding method, each of the gate driving circuit portion 500 embodied in the non-display area IA at the left side of the substrate and the gate driving circuit portion 500 embodied in the non-display area IA at the right side of the substrate may sequentially drive the gate lines at the same time.

The data driving circuit portion 700 may be connected with the plurality of data lines DL provided in the display panel 100. The data driving circuit portion 700 according to one embodiment may convert the data PID, PBD and PSD to analog type data voltages Vdata by using the data PID, PBD and PSD and the data control signal DCS supplied from the timing controller 300 and a plurality of reference gamma voltages supplied from a power supply, and may supply the converted data voltages to the corresponding data line DL.

In the image display period IDP of the display mode, the data driving circuit portion 700 may convert the subpixel image data PID to the image data voltage Vdata based on the data control signal DCS supplied from the timing controller 300 and supply the converted image data voltage to the corresponding data line DL, and at the same time may generate a reference voltage and supply the generated reference voltage to the reference line RL. Each of the image data voltage and the reference voltage may be synchronized with the scan pulse of the scan signals supplied to the gate lines corresponding to the image display period IDP of the display mode.

In the black display period BDP of the display mode, the data driving circuit portion 700 may convert the subpixel black data PBD to the black data voltage based on the data control signal DCS supplied from the timing controller 300 and supply the converted black data voltage to the corresponding data line DL. The black data voltage may be synchronized with the second scan pulse of the scan signals supplied to the gate lines corresponding to the black display period BDP of the display mode.

In the sensing period RSP of the sensing mode, the data driving circuit portion 700 may convert the subpixel sensing data PSD to the sensing data voltage based on the data control signal DCS supplied from the timing controller 300 and supply the converted sensing data voltage to the corresponding data line DL, and at the same time may generate a reference voltage and supply the generated reference voltage to the reference line RL. Each of the sensing data voltage and the reference voltage may be synchronized with the third scan pulse of the scan signals supplied to the gate line corresponding to the sensing period RSP of the sensing mode.

In the sensing period RSP of the sensing mode, the data driving circuit portion 700 may sense a driving characteristic of the subpixels P1, P2, P3 and P4 through the plurality of reference lines RL, and may generate sensing low data corresponding to the sensed value and supply the generated sensing low data to the timing controller 300. The data driving circuit portion 700 may generate a restoring data voltage synchronized with the third scan pulse of the scan signals supplied to the gate line corresponding to the sensing period RSP of the sensing mode and supply the generated restoring data voltage to the data line DL, thereby restoring (or recovering) a display state (or driving state) of the subpixels P1, P2, P3 and P4 connected to the gate line corresponding to the sensing period RSP equally to a previous state of the sensing period RSP.

Meanwhile, the timing controller 300 according to one embodiment stores sensing low data per subpixels P1, P2, P3 and P4 supplied from the data driving circuit portion 700 in a storage circuit in accordance with the sensing mode. In the display mode, the timing controller 300 may compensate for the subpixel image data PID to be supplied to the sensed subpixels P1, P2, P3 and P4 based on the sensing low data stored in the storage circuit and supply the compensated subpixel image data to the data driving circuit portion 700. For example, the sensing low data may include sequential change information of each of the driving thin film transistor and the light emitting diode, which are disposed in the subpixels P1, P2, P3 and P4. Therefore, the timing controller 300 may sense a characteristic value (for example, threshold voltage or mobility) of the driving thin film transistor disposed in each subpixel, in the sensing mode, and may compensate for the subpixel image data PDI to be supplied to each of the subpixels P1, P2, P3 and P4, based on the sensed characteristic value, thereby reducing or minimizing or avoiding picture quality deterioration based on characteristic value deviation of the driving thin film transistor in the plurality of subpixels P1, P2, P3 and P4. Since the sensing mode of the display apparatus is the technique already known in the art by the applicant of the present disclosure, its detailed description will be omitted.

Figure 4:
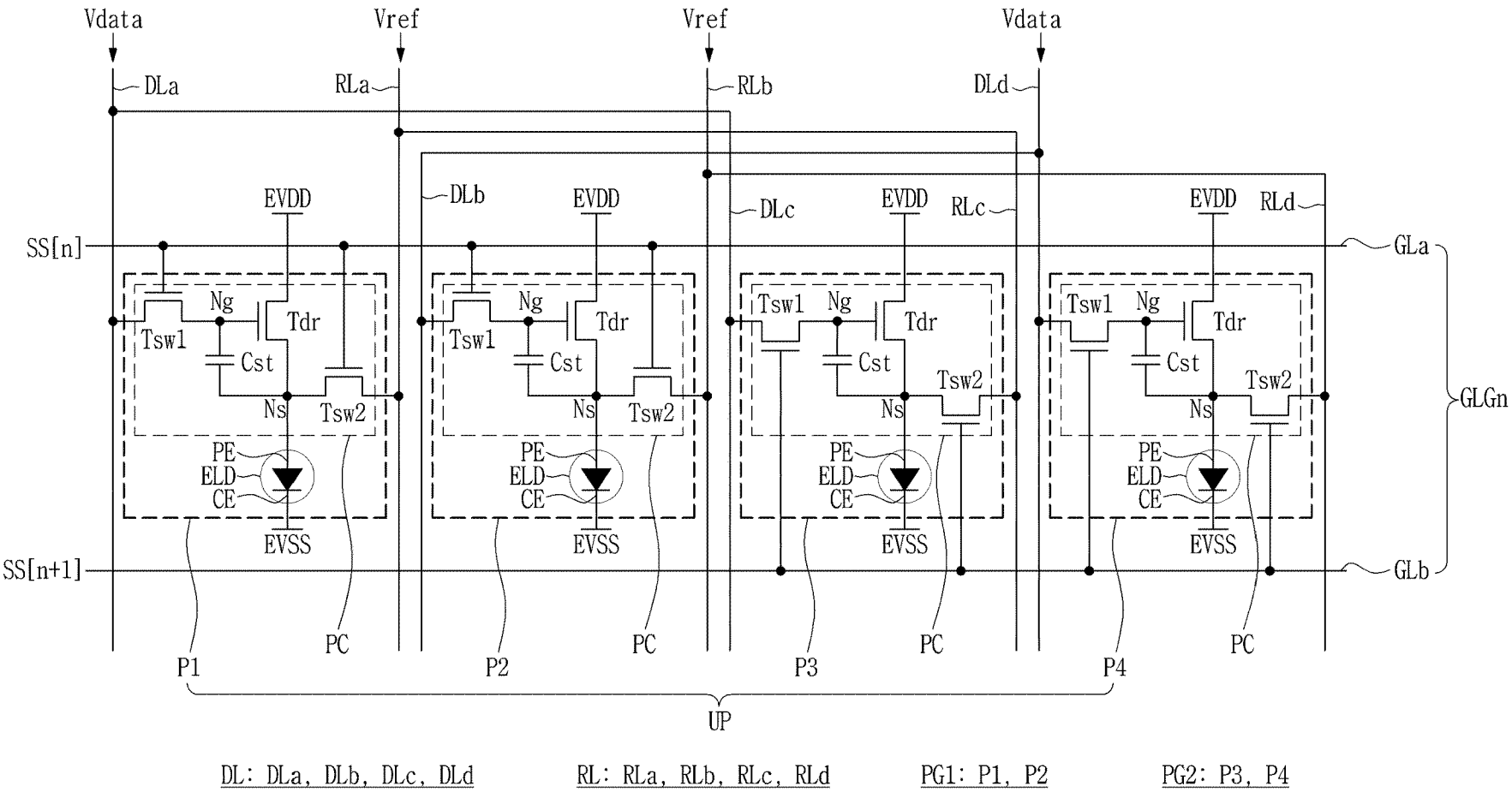
FIG. 4 is an equivalent circuit view illustrating a unit pixel shown in FIG. 3.

FIG. 4 is an equivalent circuit view illustrating a unit pixel shown in FIG. 3.

Referring to FIG. 4, the unit pixel UP according to one embodiment of the present disclosure may include first to fourth subpixels P1, P2, P3 and P4.

According to one embodiment, the first subpixel P1 may be connected to a (4x−3)th gate line GLa, (4x−3)th data line DLa and a (4x−3)th reference line RLa. The second subpixel P2 may be connected to a (4x−3)th gate line GLa, (4x−2)th data line DLb and a (4x−2)th reference line RLb. The third subpixel P3 may be connected to a (4x−2)th gate line GLb, (4x−1)th data line DLc and a (4x−1)th reference line RLc. The fourth subpixel P4 may be connected to a (4x)th gate line GLd, (4x)th data line DLd and a (4x)th reference line RLd.

Each of the first to fourth subpixels P1, P2, P3 and P4 may include a light emitting diode ELD, and a subpixel circuit PC for controlling light emission of the light emitting diode ELD.

The subpixel circuit PC may output a data current based on a differential voltage Vdata−Vref of a data voltage Vdata supplied through the data line DL and a reference voltage Vref supplied through the reference line RL adjacent thereto, in response to scan signals SS[n] and SS[n+1] supplied through the corresponding gate lines.

The subpixel circuit PC according to one embodiment may include a first switching thin film transistor Tsw1, a second switching thin film transistor Tsw2, a driving thin film transistor Tdr, and a storage capacitor Cst. In the following description, the thin film transistor will be referred to as "TFT."

At least one of the first switching TFT Tsw1, the second switching TFT Tsw2 and the driving TFT Tdr may be a-Si TFT, poly-Si TFT, Oxide TFT, or Organic TFT. For example, in the subpixel circuit PC, some of the first switching TFT Tsw1, the second switching TFT Tsw2 and the driving TFT Tdr may be a TFT that includes a semiconductor layer (or active layer) made of low-temperature poly-Si (LTPS) having an excellent response characteristic, and the other of the first switching TFT Tsw1, the second switching TFT Tsw2 and the driving TFT Tdr may be a TFT that include a semiconductor layer (or active layer) made of oxide having an excellent off current characteristic.

The first switching TFT Tsw1 includes a gate electrode connected to the corresponding gate line GL, a first source/drain electrode connected to the data line DL, and a second source/drain electrode connected to a gate node Ng of the driving TFT Tdr. The first switching TFT Tsw1 is turned on in accordance with the scan signals SS[n] and SS[n+1] of the corresponding gate line GL to supply the data voltage Vdata supplied through the data line DL adjacent thereto, to the gate node Ng of the driving TFT Tdr.

The second switching TFT Tsw2 includes a gate electrode connected to the corresponding gate line GL, a first source/drain electrode connected to a source node Ns of the driving TFT Tdr, and a second source/drain electrode connected to the reference line RL adjacent thereto. The second switching TFT Tsw2 is turned on in accordance with the scan signals SS[n] and SS[n+1] of the corresponding gate line GL to supply the reference voltage Vref supplied through the reference line RL, to a source node Ns of the driving TFT Tdr.

The storage capacitor Cst may be formed between the gate node Ng and the source node Ns of the driving TFT Tdr. The storage capacitor Cst according to one embodiment may include a first capacitor electrode connected with the gate node Ng of the driving TFT Tdr, a second capacitor electrode connected with the source node Ns of the driving TFT Tdr, and a dielectric layer formed in an overlap area between the first capacitor electrode and the second capacitor electrode. Such a storage capacitor Cst charges a differential voltage between the gate node Ng and the source node Ns of the driving TFT Tdr and then switches the driving TFT Tdr in accordance with the charged voltage.

The driving TFT Tdr may include a gate electrode (or gate node Ng) commonly connected to the second source/drain electrode of the first switching TFT Tsw1 and the first capacitor electrode of the storage capacitor Cst, a first source/drain electrode (or source node Ns) commonly connected to the first source/drain electrode of the second switching TFT Tsw2, the second capacitor electrode of the storage capacitor Cst and the light emitting diode ELD, and a second source/drain electrode (or drain node) connected to a subpixel driving power source EVDD. The driving TFT Tdr may be turned on by the voltage of the storage capacitor Cst to control the amount of a current flowing from the subpixel driving power source EVDD to the light emitting diode ELD.

The gate electrodes of the first and second switching TFTs Tsw1 and Tsw2 disposed in the first subpixel P1 may commonly be connected to the (4x−3)th gate line GLa. The gate electrodes of the first and second switching TFTs Tsw1 and Tsw2 disposed in the second subpixel P2 may commonly be connected to the (4x−3)th gate line GLa. The gate electrodes of the first and second switching TFTs Tsw1 and Tsw2 disposed in the third subpixel P3 may commonly be connected to the (4x−2)th gate line GLb. The gate electrodes of the first and second switching TFTs Tsw1 and Tsw2 disposed in the fourth subpixel P4 may commonly be connected to the (4x−2)th gate line GLb.

The light emitting diode ELD emits light in accordance with the data current supplied from the subpixel circuit PC to emit light of luminance corresponding to the data current.

The light emitting diode ELD according to one embodiment may include a subpixel electrode (or anode electrode) PE electrically connected with the subpixel circuit PC, a self-light emitting diode, and a common electrode (or cathode electrode) CE disposed on the self-light emitting diode and connected to a subpixel common power source EVSS.

The subpixel electrode PE may be disposed in a light emitting area (or opening area) defined in the subpixels P1, P2, P3 and P4 and electrically be connected with the source node Ns of the subpixel circuit PC through a contact hole disposed in an insulating layer (or planarization layer) that at least partially or entirely covers the subpixel circuit PC. The subpixel electrode PE may be made of a transparent conductive metal material or a reflective metal material depending on a top emission structure or a bottom emission structure of the light emitting diode ELD.

The self-light emitting diode is formed on the subpixel electrode PE and is directly in contact with the subpixel electrode PE. This light emitting diode ELD emits light in accordance with the data current supplied from the subpixel circuit PC to emit light of luminance corresponding to the data current.

The self-light emitting diode according to one embodiment may be a common layer commonly formed in each of the plurality of subpixels P1, P2, P3 and P4 so as not to be identified per subpixels P1, P2, P3 and P4. The self-light emitting diode may emit white light by responding to a current flowing between the subpixel electrode PE and the common electrode CE. The self-light emitting diode according to one embodiment may include an organic light emitting diode or an inorganic light emitting diode, or may include a deposited or mixture structure of an organic light emitting diode (or inorganic light emitting diode) and a quantum dot light emitting diode.

The organic light emitting diode according to one embodiment includes two or more light emitting material layers (or light emitting portions) for emitting white light. For example, the organic light emitting diode may include first and second light emitting material layers for emitting white light by mixture of first light and second light. In this case, the first light emitting material layer may include at least one of a blue light emitting material, a green light emitting material, a red light emitting material, a yellow light emitting material, and a yellow-green light emitting material. The second light emitting material layer may include at least one of a blue light emitting material, a green light emitting material, a red light emitting material, a yellow light emitting material, and a yellow-green light emitting material to emit second light which may make white light by mixture with the first light emitted from the first light emitting material layer.

The organic light emitting diode according to one embodiment may further include at least one functional layer for improving light emission efficiency and/or lifetime. For example, the functional layer may be disposed in each of an upper portion and/or a lower portion of the light emitting material layer.

The inorganic light emitting diode according to one embodiment may include a semiconductor light emitting diode, a micro light emitting diode, or a quantum dot light emitting diode. For example, when the light emitting diode ELD is an inorganic light emitting diode, the light emitting diode ELD may have, but not limited to, a scale of 1 to 100 micrometers.

The common electrode CE may be disposed on the display area AA, and may directly be in contact with the self-light emitting diode or electrically and directly be in contact with the self-light emitting diode. The common electrode CE may be made of a transparent conductive metal material or a reflective metal material depending on a top emission structure or a bottom emission structure of the light emitting diode ELD.

Figure 5:
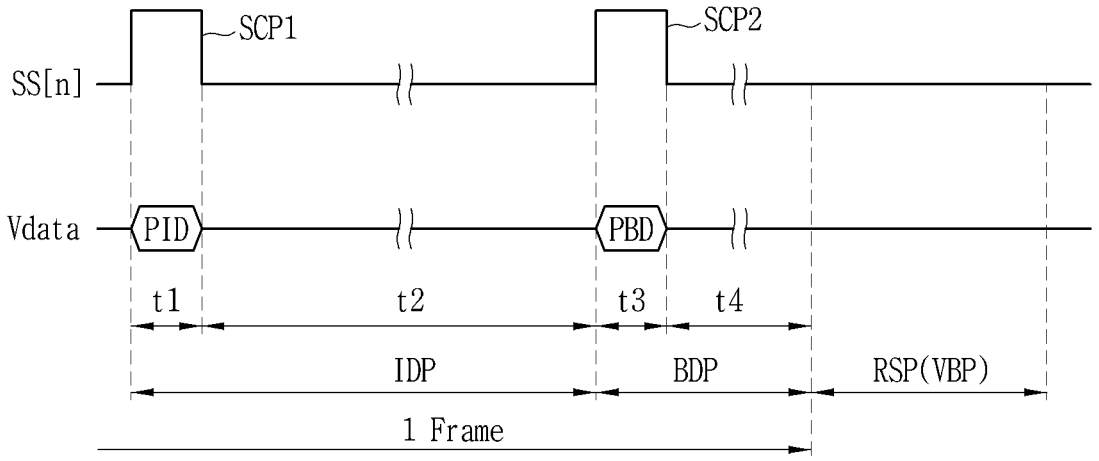
FIG. 5 is a timing view illustrating a scan signal and a data voltage for driving subpixels according to one embodiment shown in FIG. 4.

FIG. 5 is a timing view illustrating a scan signal and a data voltage for driving subpixels according to one embodiment shown in FIG. 4.

Referring to FIGS. 4 and 5, the subpixels P1, P2, P3 and P4 according to one embodiment of the present disclosure may be driven (or operated) in the image display period IDP and the black display period BDP for one frame.

The image display period IDP of the subpixels P1, P2, P3 and P4 may include an image data addressing period t1 and a light emission period t2.

At the image data addressing period (or first data addressing period), the first switching TFT Tsw1 and the second switching TFT Tsw2 disposed in each of the subpixels P1, P2, P3 and P4 are turned on at the same time by the first scan pulse SCP1 of the scan signal SSa supplied through the first gate line GLa. Therefore, the image data voltage Vdata of the subpixel image data PID supplied through the data line DL is applied to the gate node Ng of the driving TFT Tdr, and at the same time, the reference voltage Vref supplied through the reference line RL is applied to the source node Ns of the driving TFT Tdr. Therefore, at the image data addressing period t1, a voltage difference Vdata-Vref between the gate node Ng and the source node Ns of the driving TFT Tdr may be set to a voltage higher than the threshold voltage of the driving TFT Tdr, and the storage capacitor Cst may store a differential voltage Vdata−Vref of the image data voltage Vdata and the reference voltage Vref. In this case, the image data voltage Vdata may have a voltage level in which the threshold voltage of the driving TFT Tdr sensed through the sensing mode is reflected in an actual data voltage or compensated.

At the light emission period t2, each of the first and second switching TFTs Tsw1 and Tsw2 disposed in each of the subpixels P1, P2, P3 and P4 is turned off by the scan signal SSa of TFT off voltage level, whereby the driving TFT Tdr is turned on by the voltage Vdata−Vref charged in the storage capacitor Cst. Therefore, the driving TFT Tdr supplies the data current determined by the differential voltage Vdata−Vref of the image data voltage Vdata and the reference voltage Vref to the light emitting diode ELD to allow the light emitting diode ELD to emit light in proportion to the data current flowing from the subpixel driving power source EVDD to the subpixel common power source EVSS. That is, at the light emission period t2, if the first and second switching TFTs Tsw1 and Tsw2 are turned off, a current flows to the driving TFT Tdr and the light emitting diode ELD starts to emit light in proportion to the current, whereby a voltage of the source node Ns of the driving TFT Tdr is increased and a voltage of the gate node Ng of the driving TFT Tdr is increased by the storage capacitor Cst as much as the voltage increase of the source node Ns of the driving TFT Tdr. As a result, a gate-source voltage Vgs of the driving TFT Tdr may continuously be maintained by the voltage of the storage capacitor Cst, and light emission of the light emitting diode ELD may be sustained to reach the start timing of the black display period BDP. The light emission period of the light emitting diode ELD may correspond to a light emission duty.

The black display period BDP of the subpixels P1, P2, P3 and P4 may include a black data addressing period t3 and a non-light emission period t4.

At the black data addressing period (or second data addressing period) t3, each of the first and the second switching TFTs Tsw1 and Tsw2 disposed in each of subpixels P1, P2, P3 and P4 is turned on at the same time by the second scan pulse SCP2 of the scan signal SSa supplied through the first gate line GLa. Therefore, the black data voltage Vdata of the subpixel black data PBD supplied through the data line DL is applied to the gate node Ng of the driving TFT Tdr. At this time, the source node Ns of the driving TFT Tdr may be maintained at an operation voltage level (or non-light emitting start voltage) of the light emitting diode ELD in accordance with the turn-off state of the second switching TFT Tsw2. The black data voltage Vdata may have a voltage level lower than an operation voltage level (or non-light emitting voltage level) of the light emitting diode ELD or a voltage level lower than the threshold voltage of the driving TFT Tdr. Therefore, at the black data addressing period t3, the driving TFT Tdr is turned off as the voltage Vgs between the gate node Ng and the source node Ns is varied to be lower than the threshold voltage of the driving TFT Tdr by the black data voltage Vdata. For this reason, as the data current supplied from the driving TFT Tdr to the light emitting diode ELD is cut off, light emission of the light emitting diode ELD is stopped, whereby the pixel P displays a black image due to non-light emission of the light emitting diode ELD.

At the non-light emission period t4, each the first and second switching TFTs Tsw1 and Tsw2 disposed in each of the subpixels P1, P2, P3 and P4 is turned off by scan signal SSa of TFT off voltage level, whereby the driving TFT Tdr maintains the turn-off state. For this reason, the light emitting diode ELD may maintain the non-light emission state, and non-light emission of the light emitting diode ELD may be sustained to reach the image data addressing period t1 of next frame or the start timing of the sensing period RSP. The non-light emission period of the light emitting diode ELD may correspond to a black duty or a non-light emission duty.

Meanwhile, the subpixels P1, P2, P3 and P4 disposed in the other horizontal line except any one specific horizontal line to be sensed among the plurality of horizontal lines disposed in the display area may be driven in the image display period IDP and the black display period BDP substantially equally to the subpixels P1, P2, P3 and P4 disposed in the aforementioned first gate line GLa.

Figure 6:
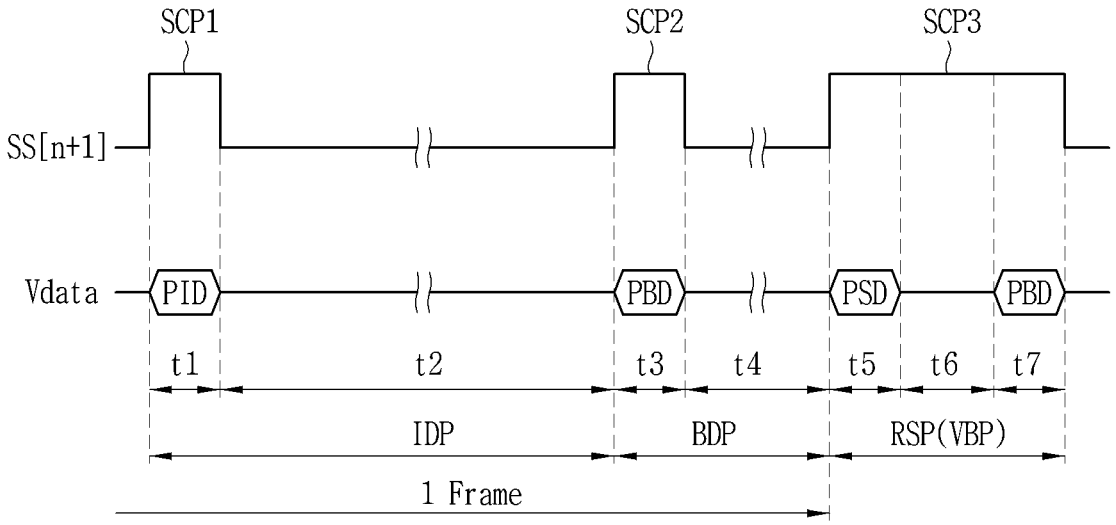
FIG. 6 is a timing view illustrating a scan signal and a data voltage for driving subpixels according to one embodiment shown in FIG. 4.

FIG. 6 is a timing view illustrating a scan signal and a data voltage for driving subpixels according to one embodiment shown in FIG. 4.

Referring to FIGS. 4 and 6, the subpixels P1, P2, P3 and P4 according to one embodiment of the present disclosure may be driven (or operated) in the image display period IDP, the black display period BDP and the sensing period RSP for one frame.

The image display period IDP of the subpixels P1, P2, P3 and P4 may include an image data addressing period t1 and a light emission period t2. Since the image data addressing period t1 and the light emission period t2 are substantially equal to those described with reference to FIG. 5, their repeated description will be omitted.

The black display period BDP of the subpixels P1, P2, P3 and P4 may include a black data addressing period t3 and a non-light emission period t4. Since the black data addressing period t3 and the non-light emission period t4 are substantially equal to those described with reference to FIG. 5, their repeated description will be omitted.

The sensing period RSP of the subpixels P1, P2, P3 and P4 may include a sensing data addressing period t5 and a sampling period t6.

At the sensing data addressing period (or third data addressing period) t5, each of the first and the second switching TFTs Tsw1 and Tsw2 disposed in each of the subpixels P1, P2, P3 and P4 is turned on as the same time by the third scan pulse SCP3 of the scan signal SS[n] supplied through the (4x−3)th gate line GLa. Therefore, the sensing data voltage Vdata of the subpixel sensing data PSD supplied through the data line DL is applied to the gate node Ng of the driving TFT Tdr, and at the same time, the reference voltage Vref supplied through the reference line RL is applied to the source node Ns of the driving TFT Tdr. Therefore, at the sensing data addressing period t5, a voltage Vgs between the gate node Ng and the source node Ns of the driving TFT Tdr is set to correspond to the sensing data voltage. For example, the sensing data voltage Vdata may have a level of a target voltage set to sense the threshold voltage of the driving TFT Tdr.

At the sampling period t6 (or real-time sensing period), each of the first and the second switching TFTs Tsw1 and Tsw2 in each of the subpixels P1, P2, P3 and P4 maintains the turn-on state by the third scan pulse SCP3 of the scan signal SS[n] supplied through the (4x−3)th gate line GLa. The reference line RL is electrically connected to a sensing unit embedded in the data driving circuit. Therefore, the sensing unit of the data driving circuit may sample a sensing subpixel current or sensing subpixel voltage supplied through the source node Ns of the driving TFT Tdr and the second switching TFT Tsw2 and the reference line RL, and may convert the sampled sampling signal through analog-digital conversion to generate sensing low data and supply the generated sensing low data to the timing controller 300.

The sensing period RSP of the subpixels P1, P2, P3 and P4 according to one embodiment of the present disclosure may further include a data restoring period t7.

At the data restoring period t7 (or real-time sensing period), each of the first and the second switching TFTs Tsw1 and Tsw2 in each of the subpixels P1, P2, P3 and P4 maintains the turn-on state by the third scan pulse SCP3 of the scan signal SS[n] supplied through the (4x−3)th gate line GLa. The reference line RL is electrically detached from the sensing unit of the data driving circuit and electrically connected with a reference power source. Therefore, the restoring data voltage Vdata of the pixel black data PBD supplied through the data line DL is applied to the gate node Ng of the driving TFT Tdr and at the same time, the reference voltage Vref supplied through the reference line RL is applied to the source node Ns of the driving TFT Tdr. Therefore, at the data restoring period t7, the voltage between the gate node Ng and the source node Ns of the driving TFT Tdr is restored to a previous state of the sensing period RSP, whereby the pixels P may again emit light and re-emission of the light emitting diode ELD may be sustained to reach the image data addressing period t1 of next frame Fn+1.

FIGS. 7A to 7*d* are views illustrating a driving method of subpixels according to the present disclosure, and are intended to describe an operation of each of the gate driving circuit portion and the data driving circuit portion for first to eighth horizontal periods of one frame.

Figure 7A:
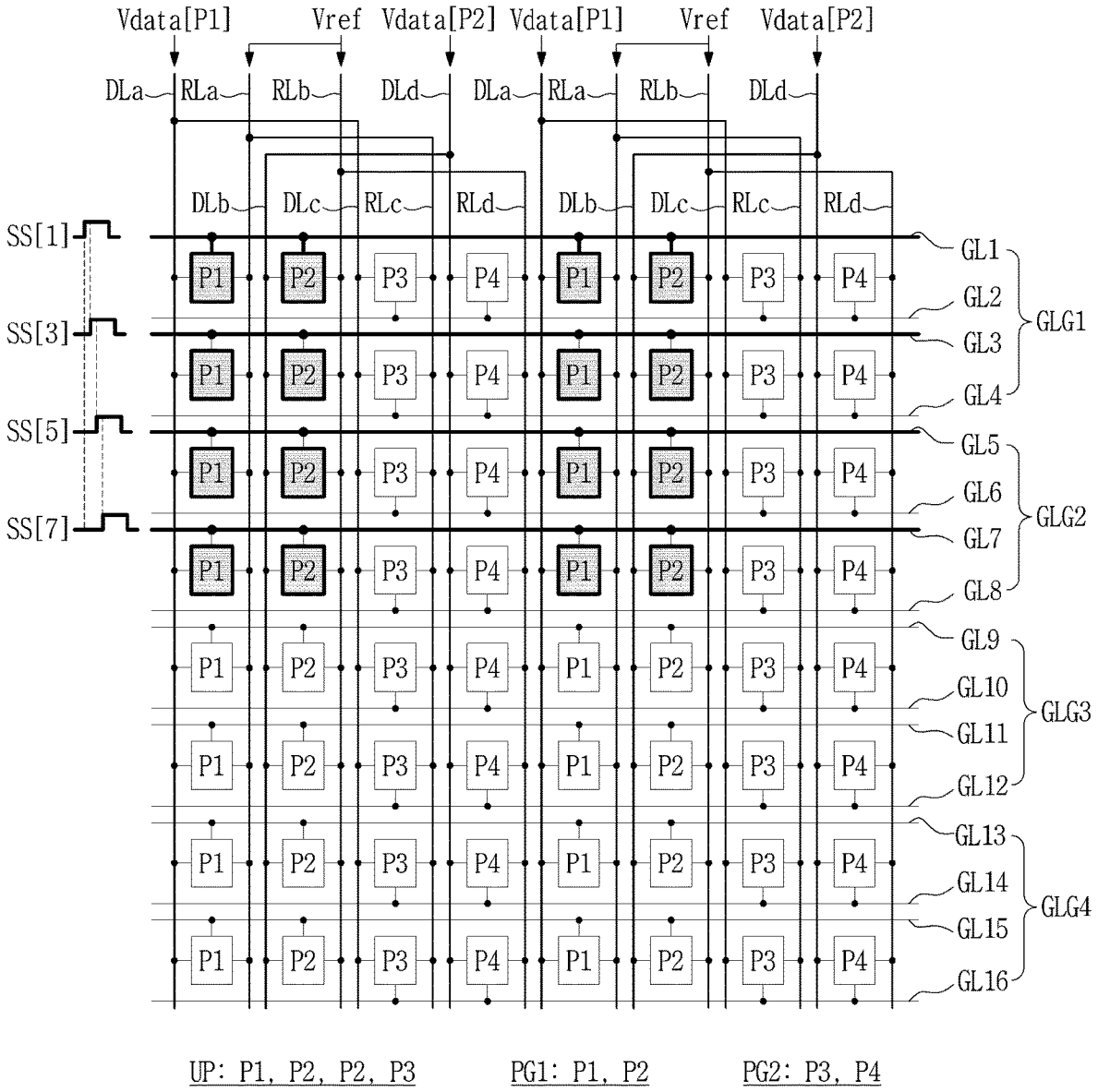
FIGS. 7A to 7D are views illustrating a driving method of subpixels according to the present disclosure.

Referring to FIGS. 1 and 7A, the gate driving circuit portion 500 according to the present disclosure may first drive the first pixel group PG1 of the first and second pixel groups PG1 and PG2 of the unit pixels UP disposed in each of the first to fourth horizontal lines, for the first and second horizontal periods. For example, the gate driving circuit portion 500 may sequentially supply scan signals SS[1], SS[3], SS[5] and SS[7] to each of the odd numbered gate lines GL1, GL3, GL5 and GL7 of the first and second gate line groups GLG1 and GLG2. That is, the gate driving circuit portion 500 may sequentially supply the scan signals SS[1], SS[3], SS[5] and SS[7] to each of the first, third, fifth and seventh gate lines GL1, GL3, GL5 and GL7 connected to the first pixel group PG1 disposed in the first to fourth horizontal lines for the second horizontal period. At this time, the scan signals SS[1], SS[3], SS[5] and SS[7] supplied to each of the odd numbered gate lines GL1, GL3, GL5 and GL7 of the first and second gate line groups GLG1 and GLG2 may sequentially be shifted and overlapped for a certain time period.

For the first and second horizontal periods, the data driving circuit portion 700 may continuously supply a first pixel data voltage Vdata[P1] (for example, red pixel data voltage) and a second pixel data voltage Vdata[P2] (for example, white pixel data voltage), which respectively correspond to the subpixels P1 and P2 of the first pixel group PG1 disposed in each of the first to fourth horizontal lines, to corresponding data lines DLa and DLd without transition (or inversion) of the data voltage for the second horizontal period.

Therefore, the first subpixel P1 of the first to fourth subpixels P1, P2, P3 and P4 respectively disposed in the first to fourth horizontal lines for the first and second horizontal periods may display an image corresponding to the first pixel data voltage Vdata[P1], and the second subpixel P2 may display an image corresponding to the second pixel data voltage Vdata[P2].

Figure 7B:
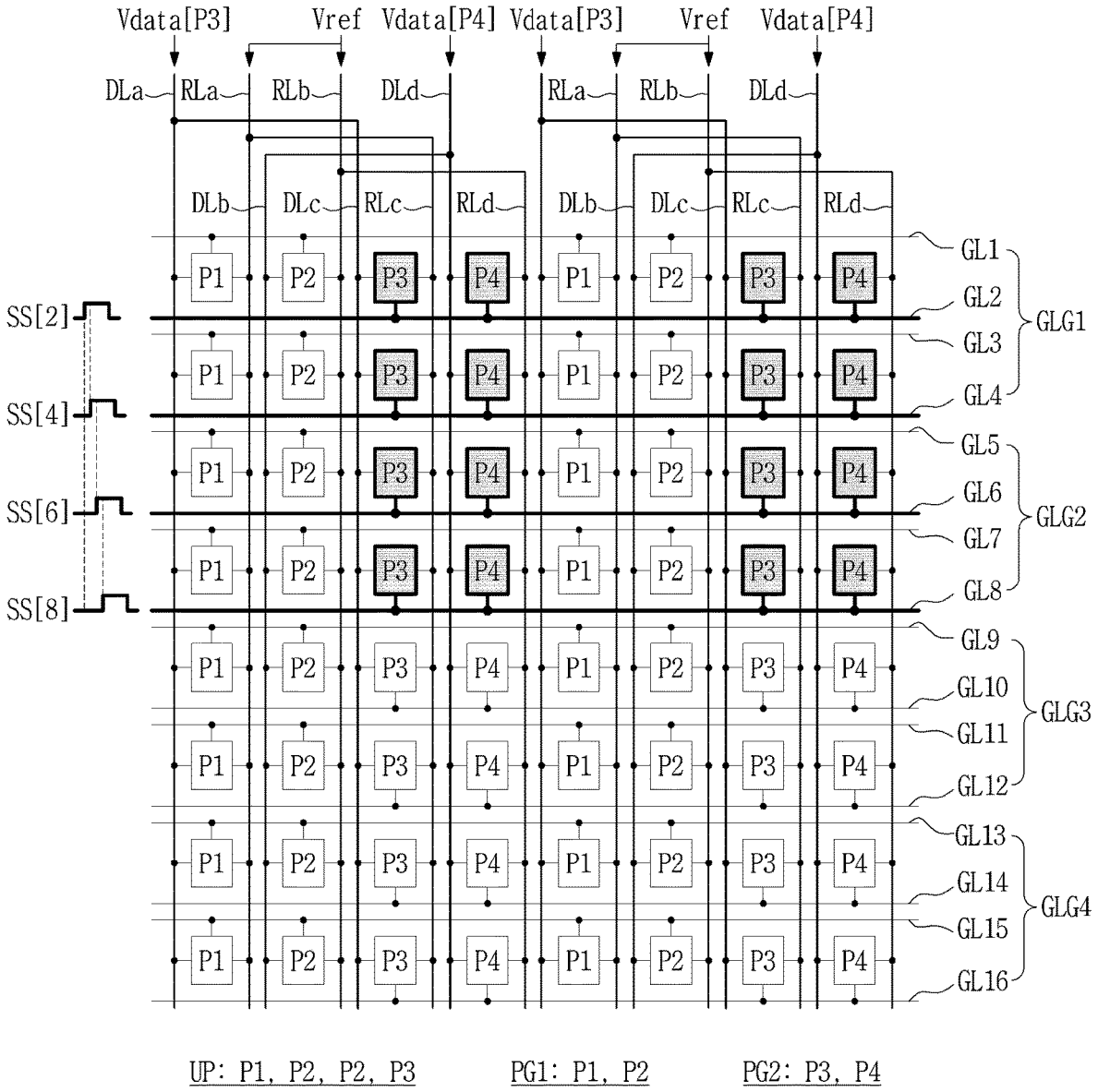

Referring to FIGS. 1 and 7B, the gate driving circuit portion 500 according to the present disclosure may drive the second pixel group PG2, which is not driven, from the unit pixels UP disposed in each of the first to fourth horizontal lines, for the third and fourth horizontal periods. For example, the gate driving circuit portion 500 may sequentially supply scan signals SS[2], SS[4], SS[6] and SS[8] to each of the even numbered gate lines GL2, GL4, GL6 and GL8 of the first and second gate line groups GLG1 and GLG2. That is, the gate driving circuit portion 500 may sequentially supply the scan signals SS[2], SS[4], SS[6] and SS[8] to each of the second, fourth, sixth and eighth gate lines GL2, GL4, GL6 and GL8 connected to the second pixel group PG2 disposed in the first to fourth horizontal lines for the second horizontal period. At this time, the scan signals SS[2], SS[4], SS[6] and SS[8] supplied to each of the even numbered gate lines GL2, GL4, GL6 and GL8 of the first and second gate line groups GLG1 and GLG2 may sequentially be shifted and overlapped for a certain time period.

For the third and fourth horizontal periods, the data driving circuit portion 700 may continuously supply a third pixel data voltage Vdata[P3] (for example, blue pixel data voltage) and a fourth pixel data voltage Vdata[P4] (for example, green pixel data voltage), which respectively correspond to the subpixels P3 and P4 of the second pixel group PG2 disposed in each of the first to fourth horizontal lines, to corresponding data lines DLa and DLd without transition (or inversion) of the data voltage for the second horizontal period.

Therefore, the third subpixel P3 of the first to fourth subpixels P1, P2, P3 and P4 respectively disposed in the first to fourth horizontal lines for the third and fourth horizontal periods may display an image corresponding to the third pixel data voltage Vdata[P3], and the fourth subpixel P4 may display an image corresponding to the fourth pixel data voltage Vdata[P4].

Figure 7C:
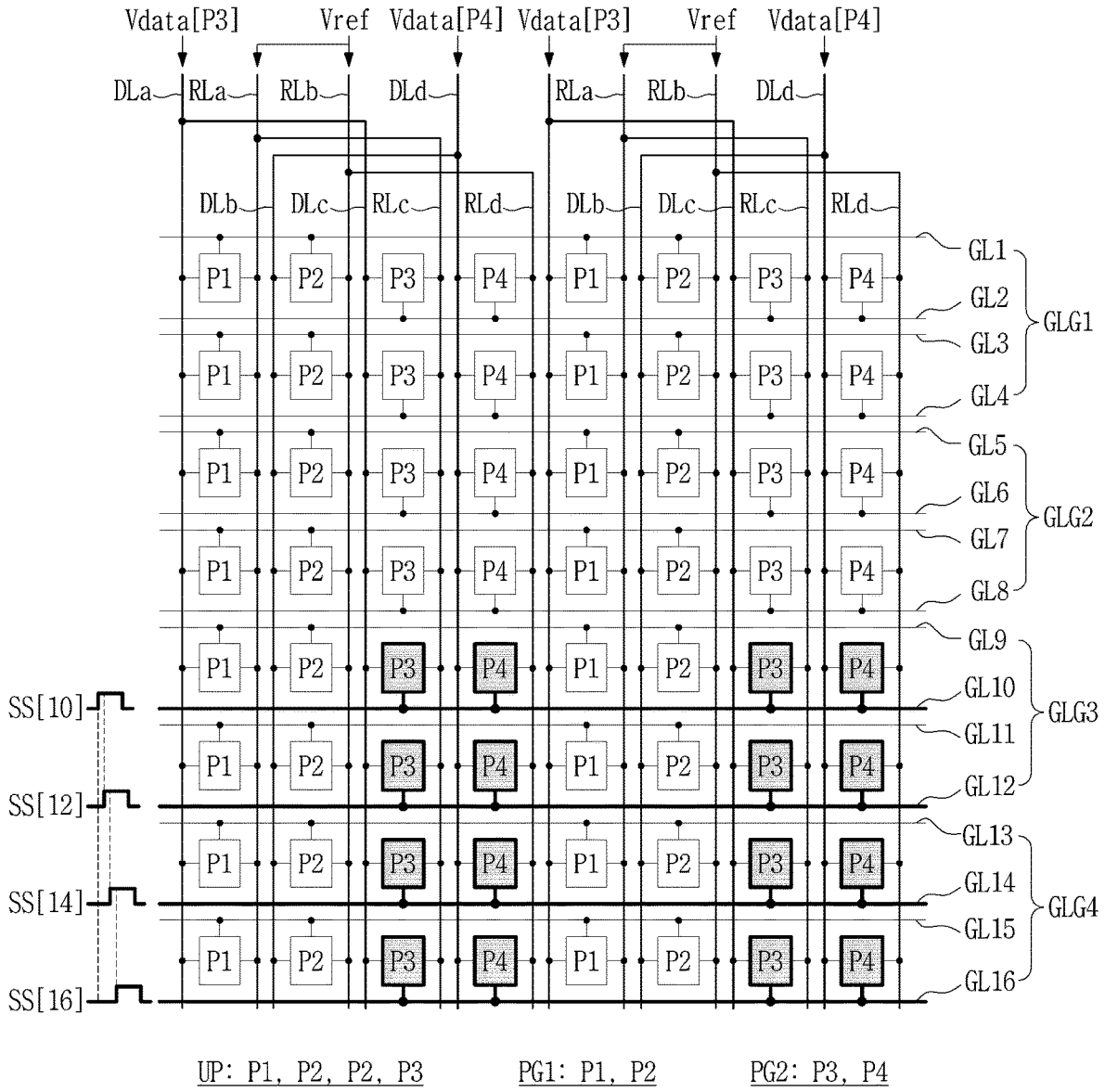

Referring to FIGS. 1 and 7C, the gate driving circuit portion 500 according to the present disclosure may first drive the second pixel group PG2 of the first pixel group PG1 and the second pixel group PG2 of the unit pixels UP disposed in each of the fifth to eighth horizontal lines, for the fifth and sixth horizontal periods. For example, the gate driving circuit portion 500 may sequentially supply scan signals SS[10], SS[12], SS[14] and SS[16] to each of the even numbered gate lines GL10, GL12, GL14 and GL16 of the third and fourth gate line groups GLG3 and GLG4. That is, the gate driving circuit portion 500 may sequentially supply the scan signals SS[10], SS[12], SS[14] and SS[16] to each of the tenth, twelfth, fourteenth and sixteenth gate lines GL10, GL12, GL14 and GL16 connected to the second pixel group PG2 disposed in the fifth to eighth horizontal lines for the second horizontal period. At this time, the scan signals SS[10], SS[12], SS[14] and SS[16] supplied to each of the even numbered gate lines GL10, GL12, GL14 and GL16 of the third and fourth gate line groups GLG3 and GLG4 may sequentially be shifted and overlapped for a certain time period.

For the fifth and sixth horizontal periods, the data driving circuit portion 700 may continuously supply a third pixel data voltage Vdata[P3] and a fourth pixel data voltage Vdata[P4], which respectively correspond to the subpixels P3 and P4 of the second pixel group PG2 disposed in each of the fifth to eighth horizontal lines, to corresponding data lines DLa and DLd without transition (or inversion) of the data voltage for the second horizontal period.

Therefore, the third subpixel P3 of the first to fourth subpixels P1, P2, P3 and P4 respectively disposed in the fifth to eighth horizontal lines for the fifth and sixth horizontal periods may display an image corresponding to the third pixel data voltage Vdata[P3], and the fourth subpixel P4 may display an image corresponding to the fourth pixel data voltage Vdata[P4].

Figure 7D:
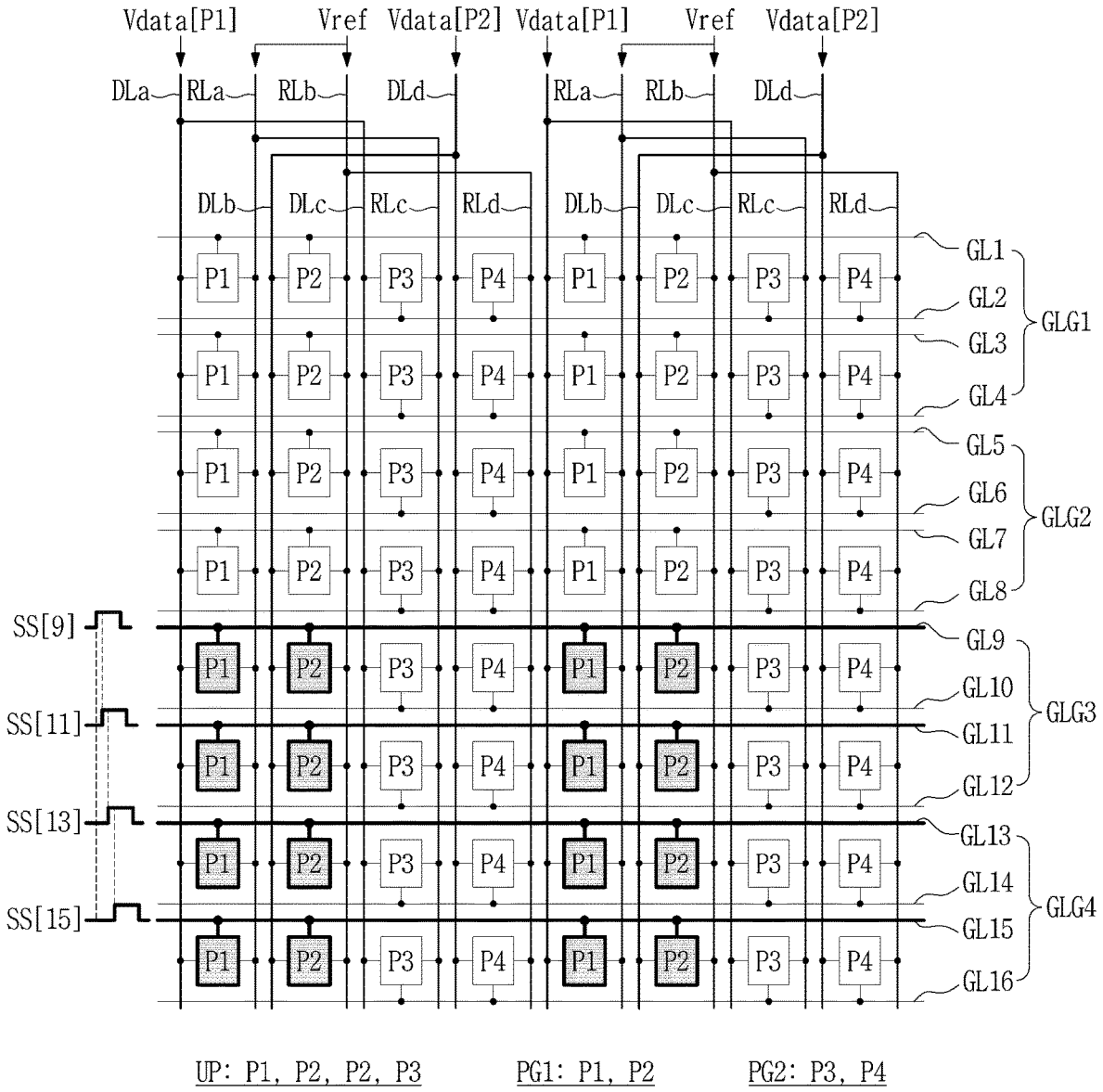

Referring to FIGS. 1 and 7*d*, the gate driving circuit portion 500 according to the present disclosure may drive the first pixel group PG1 of the unit pixels UP disposed in each of the fifth to eighth horizontal lines, for the seventh and eighth horizontal periods. For example, the gate driving circuit portion 500 may sequentially supply scan signals SS[9], SS[11], SS[13] and SS[15] to each of the odd numbered gate lines GL9, GL11, GL13 and GL15 of the third and fourth gate line groups GLG3 and GLG4. That is, the gate driving circuit portion 500 may sequentially supply the scan signals SS[9], SS[11], SS[13] and SS[15] to each of the ninth, eleventh, thirteenth and fifteenth gate lines GL9, GL11, GL13 and GL15 connected to the first pixel group PG1 disposed in the fifth to eighth horizontal lines for the second horizontal period. At this time, the scan signals SS[9], SS[11], SS[13] and SS[15] supplied to each of the odd numbered gate lines GL9, GL11, GL13 and GL15 of the third and fourth gate line groups GLG3 and GLG4 may sequentially be shifted and overlapped for a certain time period.

For the seventh and eighth horizontal periods, the data driving circuit portion 700 may continuously supply a first pixel data voltage Vdata[P1] and a second pixel data voltage Vdata[P2], which respectively correspond to the subpixels P1 and P2 of the first pixel group PG1 disposed in each of the fifth to eighth horizontal lines, to corresponding data lines DLa and DLd without transition (or inversion) of the data voltage for the second horizontal period.

Therefore, the first subpixel P1 of the first to fourth subpixels P1, P2, P3 and P4 respectively disposed in the fifth to eighth horizontal lines for the seventh and eighth horizontal periods may display an image corresponding to the first pixel data voltage Vdata[P1], and the second subpixel P2 may display an image corresponding to the second pixel data voltage Vdata[P2].

Each of the gate driving circuit portion 500 and the data driving circuit portion 700 according to the present disclosure may repeat the aforementioned driving methods for the first to eighth horizontal periods to display an image of one frame. As a result, the display apparatus according to the present disclosure may remarkably reduce data transition times in the data driving circuit portion 700, whereby power consumption of the data driving circuit portion 700 may be reduced.

Figure 8:
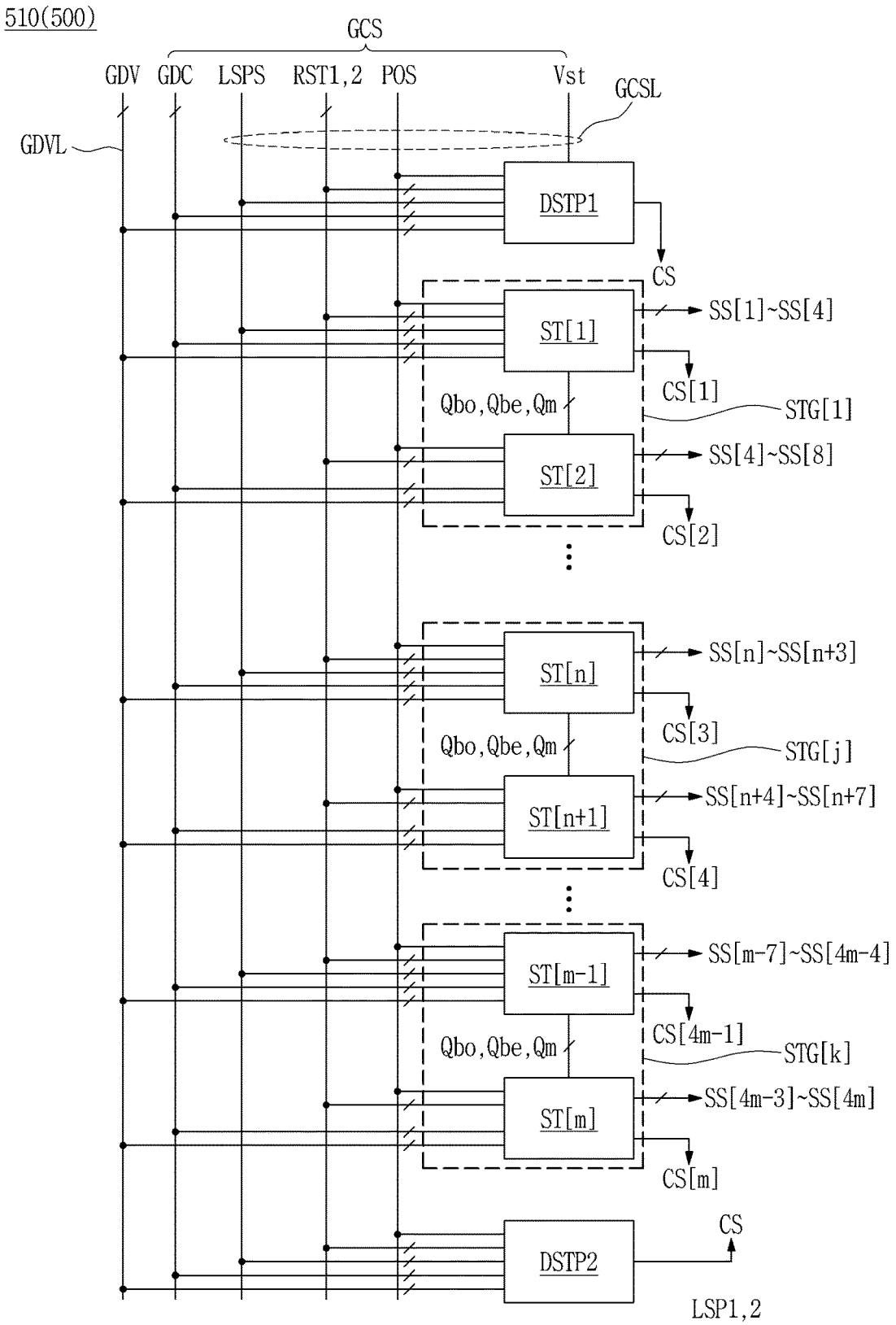
FIG. 8 is a view illustrating a gate driving circuit portion according to one embodiment of the present disclosure, which is shown in FIG. 1.

FIG. 8 is a view illustrating a gate driving circuit portion according to one embodiment of the present disclosure, which is shown in FIG. 1.

Referring to FIGS. 1, 2 and 6, the gate driving circuit portion 500 according to one embodiment of the present disclosure may include a gate driving circuit 510.

The gate driving circuit 510 may include a gate control signal line GCSL, a gate driving voltage line GDVL, and first to mth stage circuits ST[1] to ST[m]. The gate driving circuit 510 may further include a front dummy stage circuit portion DSTP1 disposed at a front end of the first stage circuit ST[1], and a rear dummy stage circuit portion DSTP2 disposed at a rear end of the mth stage circuit ST[m].

The gate control signal line GCSL receives the gate control signal GCS supplied from the timing controller 300. The gate control signal line GCSL according to one embodiment may include a gate start signal line, a first reset signal line, a second reset signal line, a plurality of gate driving clock lines, a display panel on signal line, and a sensing preparation signal line.

The gate start signal line may receive a gate start signal Vst supplied from the timing controller 300. For example, the gate start signal line may be connected to the front dummy stage circuit portion DSTP1.

The gate start signal Vst is a signal for controlling a start timing of each of the image display period IDP and the black display period BDP of every frame, and may be generated just before each of the image display period IDP and the black display period BDP starts. For example, the gate start signal Vst may be generated twice per frame.

The gate start signal Vst according to one embodiment may include a first gate start pulse (or image display gate start pulse) Vst1 generated just before the image display period IDP starts within one frame, and a second gate start pulse (or black display gate start pulse) Vst2 generated just before the black display period BDP starts.

The first reset signal line may receive a first reset signal RST1 supplied from the timing controller 300. The second reset signal line may receive a second reset signal RST2 supplied from the timing controller 300. For example, each of the first and second reset signal lines may commonly be connected to the front dummy stage circuit portion DSTP1, the first to mth stage circuits ST[1] to ST[m], and the rear dummy stage circuit portion DSTP2.

The first reset signal RST1 may be generated at the time when the sensing mode starts. The second reset signal RST2 may be generated at the time when the sensing mode ends. Optionally, the second reset signal RST2 may be omitted or equal to the first rest signal RST1.

The plurality of gate driving clock lines may include a plurality of carry shift clock lines which receives a plurality of carry shift clocks, and a plurality of scan shift clock lines which receives a plurality of scan shift clocks. The clock lines included in the plurality of gate driving clock lines may selectively be connected to the front dummy stage circuit portion DSTP1, the first to mth stage circuits ST[1] to ST[m], and the rear dummy stage circuit portion DSTP2.

The plurality of gate driving clock lines according to one embodiment may include six carry shift clock lines and 24 scan shift clock lines but are not limited thereto.

The display panel on signal line may receive a display panel on signal POS supplied from the timing controller 300. For example, the display panel on signal line may commonly be connected to the front dummy stage circuit portion DSTP1 and the first to mth stage circuits ST[1] to ST[m]. The display panel on signal POS may be generated when the display apparatus is powered on. The display panel on signal POS may commonly be supplied to all the stage circuits embodied in the gate driving circuit 510. Therefore, all the stage circuits embodied in the gate driving circuit 510 may simultaneously be initialized or reset by the display panel on signal POS of a high voltage.

The sensing preparation signal line may receive a line sensing preparation signal LSPS supplied from the timing controller 300. For example, the sensing preparation signal line may commonly be connected to the first to mth stage circuits ST[1] to ST[m]. Optionally, the sensing preparation signal line may additionally be connected to the front dummy stage circuit portion DSTP1.

The line sensing preparation signal LSPS may be generated irregularly or randomly within the image display period IDP of every frame. The each of line sensing preparation signals LSPS generated per frame may be different from a start timing of one frame.

The line sensing preparation signal LSPS according to one embodiment may include a line sensing selection pulse and a line sensing release pulse.

The line sensing selection pulse may be a signal for selecting any one horizontal line to be sensed among a plurality of horizontal lines. The line sensing selection pulse may be synchronized with a gate start pulse or a front carry signal supplied to any one of the stage circuits ST[1] to ST[m] as a gate start signal. The line sensing selection pulse may be expressed as a sensing line precharging control signal.

The line sensing release pulse may be a signal for releasing line sensing for a horizontal line which is completely sensed. The line sensing release pulse may be generated between an end timing of the sensing period RSP and a start timing of the line sensing selection pulse.

The gate driving voltage line GDVL may include first to fourth gate high potential voltage lines respectively receiving first to fourth gate high potential voltages having their respective voltage levels different from one another, from a power supply circuit, and first to third gate low potential voltage lines respectively receiving first to third gate low potential voltages having their respective voltage levels different from one another, from the power supply circuit.

According to one embodiment, the first gate high potential voltage may have a voltage level higher than that of the second gate high potential voltage. The third and fourth gate high potential voltages may be swung to be opposite to each other or reversed with respect to each other for alternating current driving between a high voltage (or TFT on voltage or first voltage) and a low voltage (or TFT off voltage or second voltage). For example, when the third gate high potential voltage (or gate odd high potential voltage) has a high voltage, the fourth gate high potential voltage (or gate even high potential voltage) may have a low voltage. When the third gate high potential voltage has a low voltage, the fourth gate high potential voltage may have a high voltage.

Each of the first and second gate high potential voltage lines may commonly be connected to the first to mth stage circuits ST[1] to ST[m], the front dummy stage circuit portion DSTP1 and the rear dummy stage circuit portion DSTP2.

The third gate high potential voltage line may commonly be connected to odd numbered stage circuits of the first to mth stage circuits ST[1] to ST[m], and may commonly be connected to odd numbered dummy stage circuits of each of the front dummy stage circuit portion DSTP1 and the rear dummy stage circuit portion DSTP2.

The fourth gate high potential voltage line may commonly be connected to even numbered stage circuits of the first to mth stage circuits ST[1] to ST[m], and may commonly be connected to even numbered dummy stage circuits of each of the front dummy stage circuit portion DSTP1 and the rear dummy stage circuit portion DSTP2.

According to one embodiment, the first gate low potential voltage and the second gate low potential voltage may substantially have the same voltage level. The third gate low potential voltage may have a TFT off voltage level. The first gate low potential voltage may have a voltage level higher than that of the third gate low potential voltage. In one embodiment of the present disclosure, the first gate low potential voltage may be set to a voltage level higher than that of the third gate low potential voltage, whereby an off current of a TFT having a gate electrode connected to a control node of a stage circuit, which will be described later, may certainly be cut off to make sure of stability and reliability in the operation of the corresponding TFT.

The first to third gate low potential voltage lines may commonly be connected to the first to mth stage circuits ST[1] to ST[m].

The front dummy stage circuit portion DSTP1 may be switched in accordance with the gate start signal Vst supplied from the timing controller 300 to sequentially generate a plurality of front carry signals, thereby supplying the generated front carry signals to any one of the rear stages as the front carry signals or the gate start signals.

The rear dummy stage circuit portion DSTP2 may sequentially generate a plurality of rear carry signals to supply the rear carry signals (or stage reset signals) to any one of the front stages.

The first to mth stage circuits ST[1] to ST[m] may be connected to one another to be mutually dependent upon one another. The first to mth stage circuits ST[1] to ST[m] may generate first to 4mth scan signals SC[1] to SC[4m] and output the generated signals to the corresponding gate lines disposed on the light emitting display panel 100. The first to mth stage circuits ST[1] to ST[m] may generate first to mth carry signals CS[1] to CS[m] and supply the generated signals to any one of the rear stages as the front carry signals (or gate start signals) and at the same time supply the generated signals to any one of the front stages as the rear carry signals (or stage reset signals).

Each of the first to mth stage circuits ST[1] to ST[m] may be embodied to sequentially output four scan signals corresponding to a given order in a unit of four gate lines among 4m number of gate lines.

Each of the first to mth stage circuits ST[1] to ST[m] may be embodied to output four scan signals based on four scan shift clocks and one carry shift clock. In each of the first to mth stage circuits ST[1] to ST[m], four scan signals may be output at their respective horizontal periods different from one another.

According to one embodiment, each of the first to mth stage circuits ST[1] to ST[m] may output a plurality of scan signals, that is, four scan signals by dividing the scan signals into a first signal group and a second signal group.

Any two of the four scan signals may be included in the first signal group, and the other two scan signals may be included in the second signal group. For example, the first signal group may include first and third scan signals of the four scan signals, and the second signal group may include second and fourth scan signals of the four scan signals.

The first to mth stage circuits ST[1] to ST[m] may be grouped into k number of stage groups STG1 to STGk (k is m/2) having two adjacent stage circuits.

Each of the k number of stage groups STG1 to STGk may be connected with eight gate lines. That is, each of the k number of stage groups STG1 to STGk may be connected with each of k number inversion driving groups.

The order of the scan signals output from the odd numbered stage groups of the k number of stage groups STG1 to STGk may be different from the order of the scan signals output from the even numbered stage groups.

The plurality of scan signals, i.e., eight scan signals, output from each of the k number of stage groups STG1 to STGk may be output by being divided into the first signal group and the second signal group based on an output timing. According to one embodiment, the first signal group may include the odd numbered scan signals of the eight scan signals, and the second signal group may include the even numbered scan signals of the eight scan signals.

The odd numbered stage groups may output the odd numbered scan signals, which belong to the first signal group, to be earlier than the even numbered scan signals, which belong to the second signal group. For example, two stage circuits which belong to the odd numbered stage groups may output the scan signals of the first signal group to be earlier than the scan signals of the second signal group. On the contrary, the even numbered stage groups may output the even numbered scan signals, which belong to the second signal group, to be earlier than the odd numbered scan signals, which belong to the first signal group. For example, two stage circuits which belong to the odd numbered stage groups may output the scan signals of the first signal group to be earlier than the scan signals of the second signal group. If data are aligned to be synchronized with the scan signals output from the stage groups as above, as described above, input data of the same color may be continuous for 4-horizontal period without transition.

Two adjacent stages ST[n] and ST[n+1] of the first to mth stage circuits ST[1] to ST[m] may mutually share some of a sensing control circuit and control nodes Qbo, Qbe, Qm, whereby circuit configuration of the gate driving circuit 500 may be simplified, and an area occupied by the gate driving circuit portion 500 in the display panel 100 may be reduced.

Figure 9:
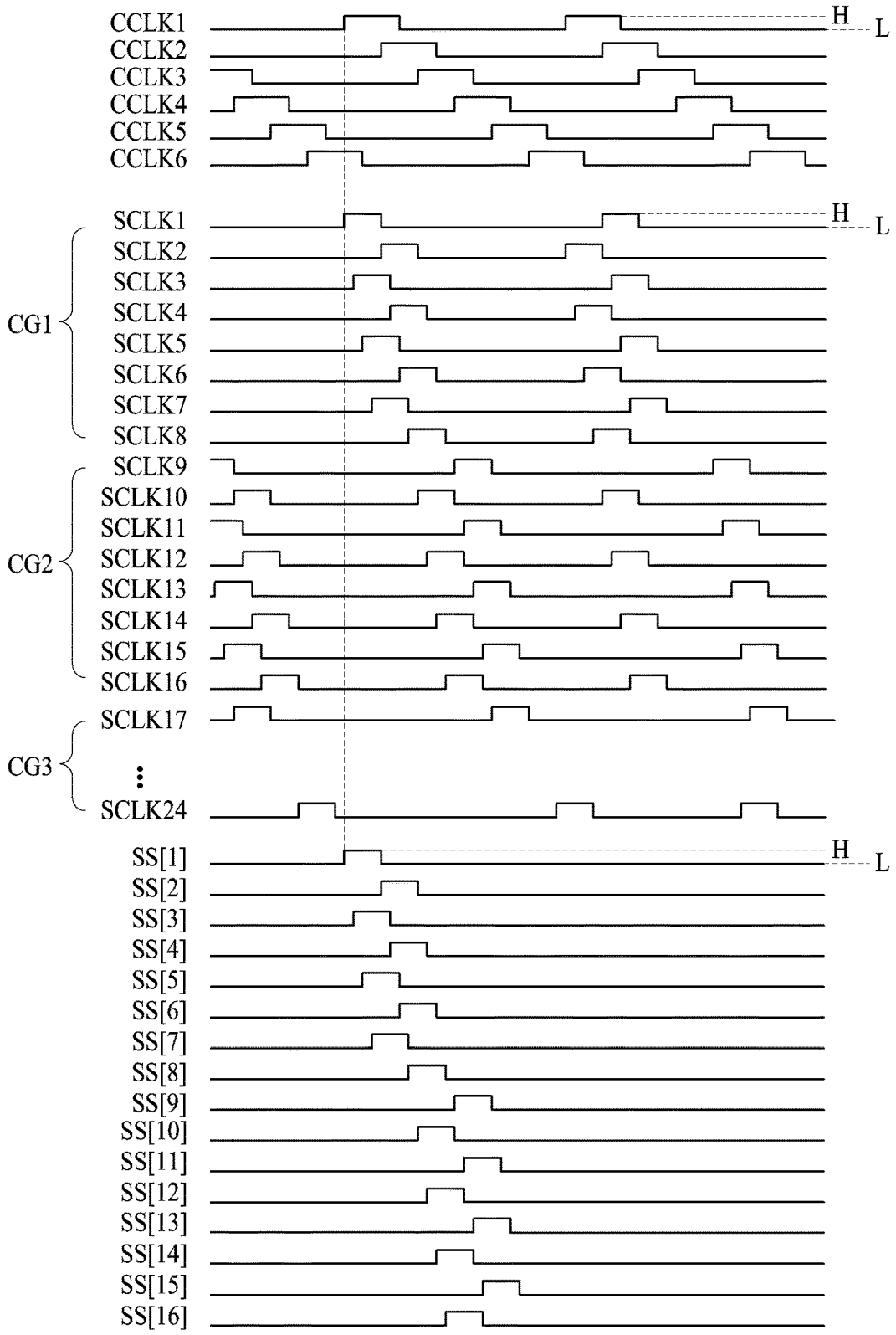
FIG. 9 is a waveform illustrating scan signals output from a first stage group and a plurality of gate driving clocks shown in FIG. 8.

FIG. 9 is a waveform illustrating scan signals output from a first stage group and a plurality of gate driving clocks shown in FIG. 8.

Referring to FIGS. 8 and 9, the plurality of gate driving clocks GDC according to one embodiment of the present disclosure include first to sixth carry shift clocks CCLK[1] to CCLK[6] having their respective phases different from one another or sequentially shifted phases, first to 24th scan shift clocks SCLK[1] to SCLK[24] having their respective phases different from one another or sequentially shifted phases.

The carry shift clocks CCLK1 to CCLK4 may be clock signals for generating carry signals, the scan shift clocks SCLK1 to SCLK24 are clock signals for generating scan signals having scan pulses.

The carry shift clocks CCLK1 to CCLK6 may be swung between the high voltage H and the low voltage L. A high voltage of each of the first to sixth carry shift clocks CCLK1 to CCLK6 may be shifted as much as ½-horizontal period, whereby the carry shift clocks CCLK1 to CCLK6 adjacent to one another may be overlapped with one another as much as ¼-horizontal period. For example, in each of the carry shift clocks CCLK1 to CCLK6, a period of the high voltage H (or pulse period) may correspond to 1.5-horizontal period, and a period of the low voltage L may correspond to 2.25-horizontal period.

For example, the high voltage H of each of the carry shift clocks CCLK1 to CCLK6 may have the same voltage level as the first gate high potential voltage. The low voltage L of each of the carry shift clocks CCLK1 to CCLK6 may have the same voltage level as the first gate low potential voltage.

According to one embodiment, each of the carry shift clocks CCLK1 to CCLK6 may be applied per one of the stage circuits ST[1] to ST[m].

The scan shift clocks SCLK1 to SCLK24 may be swung between the high voltage H and the low voltage L. In each of the scan shift clocks SCLK1 to SCLK24 according to one embodiment, a period of the high voltage H may correspond to ½-horizontal period, and a period of the low voltage L may correspond to 4-horizontal period or 6-horizontal period in accordance with the driving order of the subpixels. For example, the high voltage of each of the first to twenty-fourth scan shift clocks SCLK1 to SCLK24 may have the same voltage level as the first gate high potential voltage. The low voltage L of each of the first to twenty-fourth scan shift clocks SCLK1 to SCLK24 may have the same voltage level as the first gate low potential voltage.

The high voltage H (or pulse period) of each of the first to twenty-fourth scan shift clocks SCLK1 to SCLK24 according to one embodiment may be shifted to correspond to the driving order of the subpixels disposed on the display panel. The first to twenty-fourth can shift clocks SCLK1 to SCLK24 may be overlapped to make sure of a sufficient charging time during fast driving. The high voltages H of the clocks adjacent to each other may be overlapped with each other as much as ¾.

According to one embodiment, the first to twenty-fourth scan shift clocks SCLK1 to SCLK24 may be grouped into first to third clock groups CG1, CG2 and CG3 having eight clocks.

According to one embodiment, the first to eighth scan shift clocks SCLK1 to SCLK8 grouped in the first clock group CG1 may be supplied to (3y−2)th stage group of the first to kth stage groups STG1 to STGk. The ninth to sixteenth scan shift clocks SCLK9 to SCLK16 grouped in the second clock group CG2 may be supplied to (3y−1)th stage group of the first to kth stage groups STG1 to STGk. The seventeenth to twenty-fourth scan shift clocks SCLK17 to SCLK24 grouped in the third clock group CG3 may be supplied to (3y)th stage group of the first to kth stage groups STG1 to STGk.

The odd numbered scan shift clocks of eight scan shift clocks grouped in each of the first and third clock groups CG1 and CG3 may be generated to be earlier than the even numbered scan shift clocks. The even numbered scan shift clocks of eight scan shift clocks grouped in the second clock group CG2 may be generated to be earlier than the odd numbered scan shift clocks.

Four higher scan shift clocks of eight scan shift clocks grouped in each of the first and third clock groups CG1 and CG3 may be supplied to the odd numbered stage circuit of two stage circuits which belong to the corresponding stage group, and four lower scan shift clocks may be supplied to the even numbered stage circuit of two stage circuits which belong to the corresponding stage group.

Each of the scan shift clocks SCLK1 to SCLK24 may be swung for the display mode. A specific scan shift clock of the scan shift clocks SCLK1 to SCLK24 may be swung for the output of the third scan pulse for the sensing mode, and the other scan shift clocks may be maintained at the low voltages L.

Figure 10:
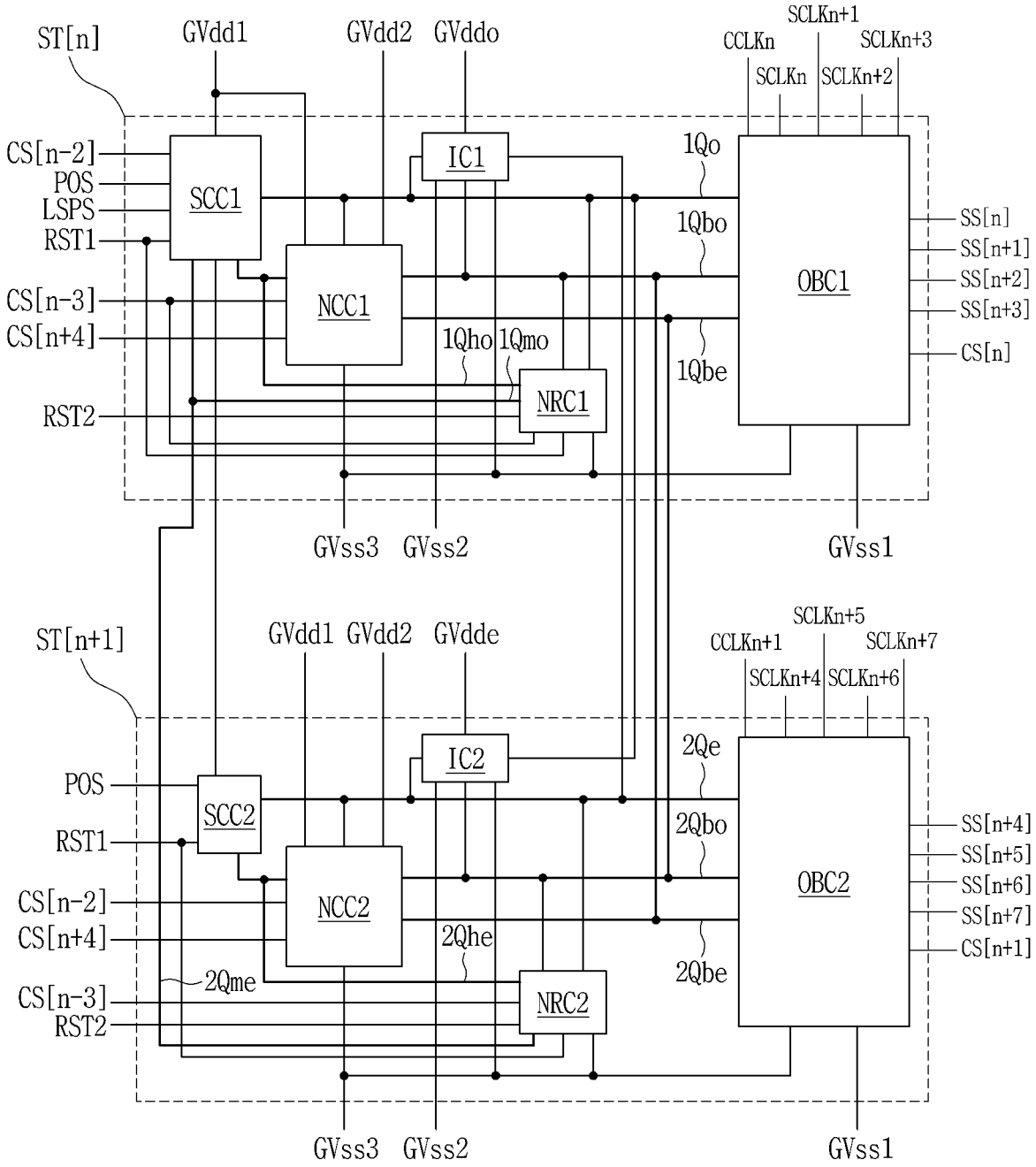
FIG. 10 is a block view illustrating an nth stage circuit and an (n+1)th stage circuit shown in FIG. 8.

FIG. 10 is a block view illustrating an nth stage circuit and an (n+1)th stage circuit shown in FIG. 8.

Referring to FIGS. 8 to 10, the nth stage circuit ST[n] according to one embodiment of the present disclosure may be the odd numbered stage circuit of the first to mth stage circuits ST[1] to ST[m].

The nth stage circuit ST[n] according to one embodiment may include a first to fifth odd control nodes 1Qo, 1Qbo, 1Qbe, 1Gho and 1Qmo, a first sensing control circuit SCC1, a first node control circuit NCC1, a first inverter circuit IC1, a first nod reset circuit NRC1, and a first output buffer circuit OBC1.

The first odd control node 1Qo may be electrically connected to each of the first sensing control circuit SCC1, the first node control circuit NCC1, the first inverter circuit IC1, the first nod reset circuit NRC1, and the first output buffer circuit OBC1.

Each of the second and third odd control node 1Qbo and 1Qbe may be electrically connected to each of the first sensing control circuit SCC1, the first node control circuit NCC1, the first inverter circuit IC1, the first nod reset circuit NRC1, and the first output buffer circuit OBC1

The second odd control node 1Qbo may be electrically connected to (n+1)th stage circuit ST[n+1]. The third odd control node 1Qbe may be electrically connected to (n+1)th stage circuit ST[n+1].

The fourth odd control node 1Qho may be electrically connected to each of the first sensing control circuit SCC1, the first node control circuit NCC1 and the first nod reset circuit NRC1.

The fifth odd control node 1Qmo may be electrically connected to each of the first sensing control circuit SCC1 and the first nod reset circuit NRC1, and electrically connected to (n+1)th stage circuit ST[n+1].

The first sensing control circuit SCC1 may be embodied to control the potential of the fifth odd control node 1Qmo through the first gate high potential voltage GVdd1 in response to the line sensing preparation signal LSPS and the (n−2)th carry signal CS[n−2] (second front carry signal) and control the potential of the first odd control node 1Qo through the first gate high potential voltage GVdd1 in response to the voltage of the fifth odd control node 1Qmo and the first reset signal RST1. The first sensing control circuit SCC1 may be embodied to discharge or reset the potential of the first odd control node 1Qo through the third gate low potential voltage GVss3 in response to the display panel on signal POS supplied when the display apparatus is powered on.

The first node control circuit NCC1 may be embodied to control the potential of the first odd control node 1Qo through the first gate high potential voltage GVdd1 in response to the (n−3)th carry signal CS[n−3] (first front carry signal), and may be embodied to control the potential of each of the first odd control node 1Qo and the fourth odd control node 1Qho through the third gate low potential voltage GVss3 in response to the (n+4)th carry signal CS[n+4] (or second rear carry signal). Optionally, the first node control circuit NCC1 may be embodied to control the potential of each of the first odd control node 1Qo and the fourth odd control node 1Qho through the third gate low potential voltage GVss3 in response to the (n+3)th carry signal CS[n+3] (or first rear carry signal).

The first node control circuit NCC1 may be embodied to control the potential of the fourth odd control node 1Qho through the first gate high potential voltage GVdd1 in response to the voltage of the first odd control node 1Qo. The first node control circuit NCC1 may be embodied to control the potential of each of the first odd control node 1Qo and the fourth odd control node 1Qho through the third gate low potential voltage GVss3 in response to the voltage of the second odd control node 1Qbo or the voltage of the third odd control node 1Qbe.

The first inverter circuit IC1 may be embodied to control the potential of the second odd control node 1Qbo through the third gate high potential voltage GVddo or the third gate low potential voltage GVss3 in response to the voltage of the first odd control node 1Qo. For example, when the potential of the first odd control node 1Qo is a high voltage or more, the first inverter circuit IC1 may control the potential of the second odd control node 1Qbo through the third gate low potential voltage GVss3. And, the first inverter circuit IC1 may be embodied to control the potential of the second odd control node 1Qbo through the third gate high potential voltage GVddo or the third gate low potential voltage GVss3 in response to the voltage of the first even control node 2Qe of the (n+1)th stage circuit ST[n+1]. For example, when the potential of the first even control node 2Qe of the (n+1)th stage circuit ST[n+1] is a low voltage, the first inverter circuit IC1 may control the potential of the second odd control node 1Qbo through the third gate high potential voltage GVddo.

The first node reset circuit NRC1 may be embodied to control the potential of the second odd control node 1Qbo with the third gate low potential voltage GVss3 in response to the (n−3)th carry signal CS[n−3]. The first node reset circuit NRC1 may be embodied to control the potential of the second odd control node 1Qbo with the third gate low potential voltage GVss3 in response to the voltage of the fifth odd control node 1Qmo and the first reset signal RST1. The first node reset circuit NRC1 may be embodied to control the potential of the first odd control node 1Qo with the third gate low potential voltage GVss3 in response to the voltage of the fifth fourth odd control node 1Qho, the voltage of the fifth odd control node 1Qmo and the second reset signal RST2.

The first output buffer circuit OBC1 may be embodied to output the nth to (n+3)th scan shift clocks SCLK[n] to SCLK[n+3] as nth to (n+3)th scan signals SC[n] to SC[n+3] in response to the voltage of each of the first to third odd control nodes 1Qo, 1Qbo and 1Qbe. The first output buffer circuit OBC1 may be embodied to output the nth carry shift clock CCLK[n] as the nth carry signal CS[n] in response to the voltage of each of the first to third odd control nodes 1Qo, 1Qbo and 1Qbe.

According to one embodiment, when the potential of the first odd control node 1Qo based on coupling between a booster capacitor embodied between the first odd control node 1Qo and the output node and a clock is bootstrapped and maintained at a boosting voltage, the first output buffer circuit OBC1 may output each of the nth to (n+3)th scan shift clocks SCLK[n] to SCLK[n+3] and the nth carry shift clock CCLK[n] to a corresponding output node.

The (n+1)th stage circuit ST[n+1] according to one embodiment may be even numbered stage circuits of the first to mth stage circuits ST[1] to ST[m].

The (n+1)th stage circuit ST[n] according to one embodiment may include first to fifth even control nodes 2Qe, 2Qbo, 2Qbe, 2Qhe and 2Qme, a second sensing control circuit SCC2, a second node control circuit NCC2, a second inverter circuit IC2, a second node reset circuit NRC2, and a second output buffer circuit OBC2.

The first even control node 2Qe may electrically be connected to each of the second sensing control circuit SCC2, the second node control circuit NCC2, the second inverter circuit IC2, the second node reset circuit NRC2 and the second output buffer circuit OBC2.

Each of the second and third even control nodes 2Qbo and 2Qbe may electrically be connected to each of the second node control circuit NCC2, the second inverter circuit IC2, the second node reset circuit NRC2 and the second output buffer circuit OBC2.

The second even control node 2Qbo may electrically be connected with the third odd control node 1Qbe of the nth stage circuit ST[n]. Therefore, the third odd control node 1Qbe of the nth stage circuit ST[n] and the second even control node 2Qbo of the (n+1)th stage circuit ST[n+1] may be connected or shared with each other.

The third even control node 2Qbe may electrically be connected to each of the second odd control node 1Qbo of the nth stage circuit ST[n]. Therefore, the second odd control node 1Qbo of the nth stage circuit ST[n] and the third even control node 2Qbe of the (n+1)th stage circuit ST[n+1] may be connected or shared with each other.

The fourth even control node 2Qbe may electrically be connected to each of the second sensing control circuit SCC2, the second node control circuit NCC2 and the second node reset circuit NRC2.

The fifth even control node 2Qme may electrically be connected to the second node reset circuit NRC2, and may electrically be connected with the fifth odd control node 1Qmo of the nth stage circuit ST[n] and the first node reset circuit NRC1.

The second sensing control circuit SCC2 may share the potential of the fifth odd control node 1Qmo of the first sensing control circuit SCC1 embodied in the nth stage circuit ST[n]. For example, the second sensing control circuit SCC2 may share a circuit embodied to control the potential of the fifth odd control node 1Qmo with the first gate high potential voltage GVdd1 in response to the line sensing preparation signal LSPS and the (n−2)th carry signal CS[n−2] in the first sensing control circuit SCC1 embodied in the nth stage circuit ST[n].

The second sensing control circuit SCC2 may be embodied to control the potential of the first even control node 2Qe with the first gate high potential voltage GVdd1 supplied from the first sensing control circuit SCC1 of the nth stage circuit ST[n], in response to the first reset signal RST1. The second sensing control circuit SCC2 may be embodied to discharge or reset the potential of the first even control node 2Qe through the third gate low potential voltage GVss3 in response to the display panel on signal POS supplied when the light emitting display apparatus is powered on.

The second node control circuit NCC2 may be embodied to control the voltage of each of the first to third even control nodes 2Qe, 2Qbo and 2Qbe.

The second node control circuit NCC2 may be embodied to control the potential of the first even control node 2Qe through the first gate high potential voltage GVdd1 in response to the (n−2)th carry signal CS[n−2], and may be embodied to control the potential of each of the first even control node 2Qe and the fourth even control node 2Qhe through the third gate low potential voltage GVss3 in response to the (n+4)th carry signal CS[n+4].

The second node control circuit NCC2 may be embodied to control the potential of the fourth even control node 2Qhe through the first gate high potential voltage GVdd1 in response to the voltage of the first even control node 2Qe. The second node control circuit NCC2 may be embodied to control the potential of each of the first even control node 2Qe and the fourth even control node 2Qhe through the third gate low potential voltage GVss3 in response to the voltage of the second even control node 2Qbo or the voltage of the third even control node 2Qbe.

The second inverter circuit IC2 may be embodied to control the potential of the second even control node 2Qbo through the fourth gate high potential voltage GVdde or the third gate low potential voltage GVss3 in response to the voltage of the first even control node 2Qe. For example, when the potential of the first even control node 2Qe is a high voltage or more, the second inverter circuit IC2 may control the potential of the second even control node 2Qbo through the third gate low potential voltage GVss3. The second inverter circuit IC2 may be embodied to control the potential of the second even control node 2Qbo through the third gate high potential voltage GVddo or the third gate low potential voltage GVss3 in response to the voltage of the first odd control node 1Qo of the nth stage circuit ST[n]. For example, when the potential of the first odd control node 1Qo of the nth stage circuit ST[n] is a low voltage, the second inverter circuit IC2 may control the potential of the second even control node 2Qbo through the fourth gate high potential voltage GVdde.

The second node reset circuit NRC2 may be embodied to control the potential of the second even control node 2Qbo with the third gate low potential voltage GVss3 in response to the (n−3)th carry signal CS[n−3]. The second node reset circuit NRC2 may be embodied to control the potential of the second even control node 2Qbo with the third gate low potential voltage GVss3 in response to the voltage of the fifth even control node 2Qme and the first reset signal RST1. The second node reset circuit NRC2 may be embodied to control the potential of the first even control node 2Qe with the third gate low potential voltage GVss3 in response to the voltage of the fourth even control node 2Qbe, the voltage of the fifth even control node 2Qme and the second reset signal RST2.

The second output buffer circuit OBC2 may be embodied to output the (n+4)th to (n+7)th scan shift clocks SCLK[n+4] to SCLK[n+7] as the (n+4)th to (n+7)th scan signals SC[n+4] to SC[n+7] in response to the voltage of each of the first to third even control nodes 2Qe, 2Qbo and 2Qbe. The second output buffer circuit OBC2 may be embodied to output the (n+1)th carry shift clock CCK[n+1] as the (n+1)th carry signal CS[n+1] in response to the voltage of each of the first to third even control nodes 2Qe, 2Qbo and 2Qbe.

According to one embodiment, while the potential of the second even control node 2Qe is bootstrapped by a coupling between boost capacitor, which embodied between the second even control node 2Qe and the output node, and a clock, and is maintained at a boosting voltage, the second output buffer circuit OBC2 may output each of (n+4)th to (n+7)th scan shift clocks SCLK[n+4] to SCLK[n+7] and (n+1)th carry shift clock CCLK[n+1] to a corresponding output node.

In the gate driving circuit according to one embodiment of the present disclosure, some circuit that includes the fifth odd control node 1Qmo in the sensing control circuits SCC1 and SCC2 embodied in the nth stage circuit ST[n] may be shared with the (n+1)th stage circuit ST(n+1) adjacent thereto, whereby circuit configuration for the sensing mode may be simplified. In the gate driving circuit according to one embodiment of the present disclosure, the nth stage circuit ST[n] and the (n+1)th stage circuit ST[n+1], which are adjacent to each other, may mutually share the second and third control nodes 1Qbo, 1Qbe, 2Qbo and 2Qbe, which are alternately driven, whereby configuration of the inverter circuits IC1 and IC2 of the stage circuits may be simplified Meanwhile, for convenience of description, the aforementioned description of FIG. 8 is based on that the control node embodied in each of the nth stage circuit ST[n] and the (n+1)th stage circuit ST[n+1] is divided into the odd control node and the even control node, but is not limited thereto. For example, it is to be understood that each of the first to mth stage circuits ST[1] to ST[m] includes first to fifth control nodes.

Figure 11:
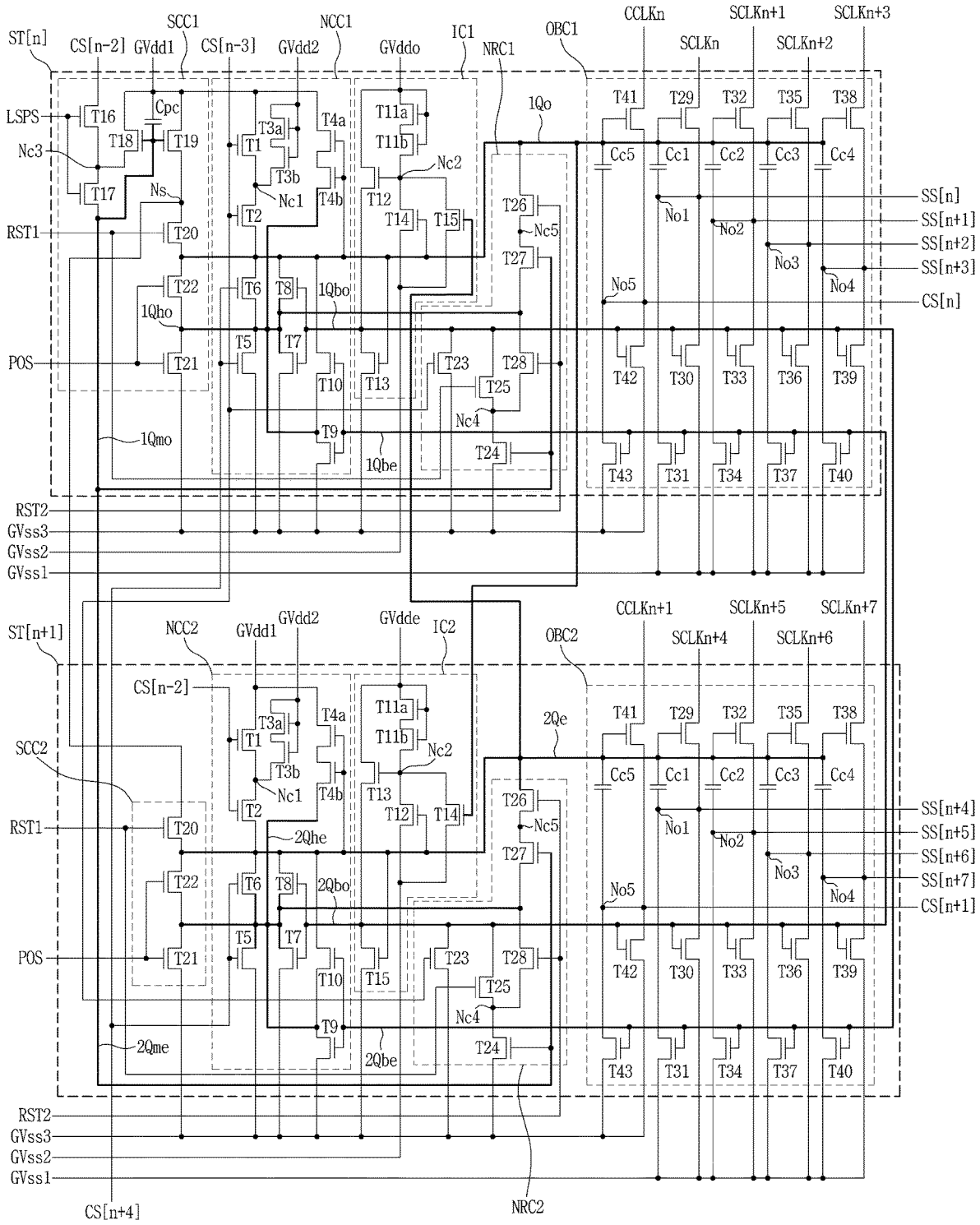
FIG. 11 is a circuit view illustrating an nth stage circuit and an (n+1)th stage circuit shown in FIG. 8.

FIG. 11 is a circuit view illustrating an nth stage circuit and an (n+1)th stage circuit shown in FIG. 8.

Referring to FIGS. 8 and 11, the nth stage circuit ST[n] according to one embodiment of the present disclosure may include a first sensing control circuit SCC1, a first node control circuit NCC1, a first inverter circuit IC1, a first node reset circuit NRC1, and a first output buffer circuit OBC1, which are selectively connected to the first to fifth odd control nodes 1Qo, 1Qbo, 1Qbe, 1Qho and 1Qmo.

The first node control circuit NCC1 according to one embodiment may include first to tenth TFTs T1 to T10.

The first to fourth TFTs T1, T2, T1*a*, T3*b*, T4*a* and T4*b* serve to control or setup the potential of the first odd control node 1Qo, and thus may be expressed as first node setup circuits.

The first TFT T1 and the second TFT T2 may be electrically connected between the first gate high potential voltage line for transferring the first gate high potential voltage GVdd1 and the first odd control node 1Qo in series, and may be embodied to charge the first gate high potential voltage GVdd1 in the first odd control node 1Qo in response to the (n−3)th carry signal CS[n−3].

In this case, the (n−3)th carry signal CS[n−3] may be a first front carry signal.

The first TFT T1 may output the first gate high potential voltage GVdd1 to a first connection node Nc1 in response to the (n−3)th carry signal CS[n−3] supplied through a front carry input line. For example, the first TFT T1 may be turned on in accordance with the (n−3)th carry signal CS[n−3] of a high voltage to output the first gate high potential voltage GVdd1 to the first connection node Nc1.

The second TFT T2 may electrically connect the first connection node Nc1 to the first odd control node 1Qo in response to the (n−3)th carry signal CS[n−3]. For example, the second TFT T2 may be turned on in accordance with the (n−3)th carry signal CS[n−3] of a high voltage simultaneously with the first TFT T1 to supply the first gate high potential voltage GVdd1 supplied through the first connection node Nc1 to the first odd control node 1Qo.

The third TFTs T3*a* and T3*b* may supply the second gate high potential voltage GVdd2 to the first connection node Nc1 in response to the second gate high potential voltage GVdd2. For example, the third TFTs T3*a* and T3*b* may be turned on in accordance with the second gate high potential voltage GVdd2 to at least partially or always supply the second gate high potential voltage GVdd2 to the first connection node Nc1 between the first TFT T1 and the second TFT T2, thereby preventing off current of the first TFT T1 and current leakage of the first odd control node 1Qo from occurring. For example, the third TFTs T3*a* and T3*b* may completely turn off the first TFT T1 turned off by the (n−3)th carry signal CS[n−3] having a low voltage by increasing a voltage difference between the gate voltage of the first TFT T1 and the first connection node Nc1. As a result, voltage drop (or current leakage) of the first odd control node 1Qo by off current of the first TFT T1 which is turned off may be prevented from occurring, whereby the voltage of the first odd control node 1Qo may stably be maintained. For example, when the threshold voltage of the first TFT T1 has a negative polarity (−), the gate-source voltage Vgs of the first TFT T1 may be fixed to the negative polarity (−) by the second gate high potential voltage GVdd2 supplied to the drain electrode. For this reason, the first TFT T1 which is turned off may become a complete off state, whereby current leakage based on the off current may be prevented from occurring.

The second gate high potential voltage GVdd2 is set to a voltage level lower than the first gate high potential voltage GVdd1. Resistance of the second gate high potential voltage GVdd2 is set to be higher than that of the first gate high potential voltage GVdd1 to reduce a voltage drop of the first gate high potential voltage GVdd1. The second gate high potential voltage line for supplying the second gate high potential voltage GVdd2 may be used as a path through which a leakage current of the third TFTs T3*a* and T3*b* flows, whereby the voltage drop of the first gate high potential voltage GVdd1 may be reduced. Therefore, in one embodiment of the present disclosure, the first gate high potential voltage line and the second gate high potential voltage line may be detached from each other to independently configure voltage drop components of the first gate high potential voltage line and the second gate high potential voltage line, whereby the voltage drop of the first gate high potential voltage line may be reduced or minimized. As a result, an error operation of the gate driving circuit, which is generated due to the voltage drop of the first gate high potential voltage line, may be avoided.

The third TFTs T3*a* and T3*b* according to one embodiment may include (3-1)th and (3-2)th TFTs T3*a* and T3*b* electrically connected with each other in series between the second gate high potential voltage line and the first connection node Nc1 to prevent the leakage current due to the off current from occurring.

The (3-1)th TFT T3*a* may be turned on by the second gate high potential voltage GVdd2 to supply the second gate high potential voltage GVdd2 to the (3-2)th TFT T3*b*. For example, the (3-1)th TFT T3*a* may be connected to the second gate high potential voltage line in the form of diode.

The (3-2)th TFT T3*b* may be turned on by the second gate high potential voltage GVdd2 simultaneously with the (3-1) th TFT T3*a* to supply the second gate high potential voltage GVdd2 supplied through the (3-1)th TFT T3*a*, to the first connection node Nc1.

The fourth TFTs T4*a* and T4*b* may supply the first gate high potential voltage GVdd1 to the fourth odd control node 1Qho in response to the first odd control node 1Qo. For example, the fourth TFTs T4*a* and T4*b* may be turned on in accordance with the high voltage of the first odd control node 1Qo to supply the first gate high potential voltage GVdd1 to the fourth odd control node 1Qho.

The fourth TFTs T4*a* and T4*b* according to one embodiment may include (4-1)th and (4-2)th TFTs T4*a* and T4*b* electrically connected with each other in series between the first gate high potential voltage line and the fourth odd control node 1Qho to prevent the leakage current due to the off current from occurring.

The (4-1)th TFT T4*a* may be turned on by the high voltage of the first odd control node 1Qo to supply the first gate high potential voltage GVdd1 to the (4-2)th TFT T4*b*.

The (4-2)th TFT T4*b* may be turned on by the high voltage of the first odd control node 1Qo simultaneously with the (4-1)th TFT T4*a* to supply the first gate high potential voltage GVdd1 supplied through the (4-1)th TFT T4*a*, to the fourth odd control node 1Qho.

The fifth and sixth TFTs T5 and T6 may be embodied to control the potential of each of the first odd control node 1Qo and the fourth odd control node 1Qho through the third gate low potential voltage GVss3 in response to the (n+4)th carry signal CS[n+4]. The fifth and sixth TFTs T5 and T6 may be expressed as first odd discharge circuits.

The fifth TFT T5 may be embodied to control the potential of the fourth odd control node 1Qho through the third gate low potential voltage GVss3 in response to the (n+4)th carry signal CS[n+4]. For example, the fifth TFT T5 may be turned on in accordance with the (n+4)th carry signal CS[n+4] of a high voltage to discharge or reset the potential of the fourth odd control node 1Qho to the third gate low potential voltage GVss3.

The sixth TFT T6 may electrically connect the first odd control node 1Qo with the fourth odd control node 1Qho in response to the (n+4)th carry signal CS[n+4]. For example, the sixth TFT T6 may be turned on in accordance with the (n+4)th carry signal CS[n+4] of a high voltage simultaneously with the fifth TFT T5 to supply the third gate low potential voltage GVss3 supplied through the fifth TFT T5 and the fourth odd control node 1Qho, to the first odd control node 1Qo, thereby discharging or resetting the potential of the first odd control node 1Qo to the third gate low potential voltage GVss3.

The fourth odd control node 1Qho between the fifth TFT T5 and the sixth TFT T6 may be supplied with the first gate high potential voltage GVdd1 through the fourth TFTs T4*a* and T4*b*. Therefore, the fourth TFTs T4*a* and T4*b* may completely turn off the sixth TFT T6 turned off by the (n+4)th carry signal CS[n+4] of a low voltage by increasing a voltage difference between the gate voltage of the sixth TFT T6 and the fourth odd control node 1Qho. As a result, a voltage drop (or current leakage) of the first odd control node 1Qo through the sixth TFT T6 which is turned off may be prevented from occurring, whereby the voltage of the first odd control node 1Qo may stably be maintained.

The seventh and eighth TFTs T7 and T8 may be embodied to control the potential of each of the first odd control node 1Qo and the fourth odd control node 1Qho through the third gate low potential voltage GVss3 in response to the voltage of the second odd control node 1Qbo. The seventh and eighth TFTs T7 and T8 may be expressed as second odd discharge circuits.

The seventh TFT T7 may be embodied to control the potential of the fourth odd control node 1Qho through the third gate low potential voltage GVss3 in response to the voltage of the second odd control node 1Qbo. For example, the seventh TFT T7 may be turned on in accordance with the high voltage of the second odd control node 1Qbo to discharge or reset the potential of the fourth odd control node 1Qho to the third gate low potential voltage GVss3.

The eighth TFT T8 may electrically connect the first odd control node 1Qo with the fourth odd control node 1Qho in response to the voltage of the second odd control node 1Qbo. For example, the eighth TFT T8 may be turned on by the high voltage of the second odd control node 1Qbo simultaneously with the seventh TFT T7 to supply the third gate low potential voltage GVss3 supplied through the seventh TFT T7 and the fourth odd control node 1Qho, to the first odd control node 1Qo, thereby discharging or resetting the potential of the first odd control node 1Qo to the third gate low potential voltage GVss3.

The fourth odd control node 1Qho between the seventh TFT T7 and the eighth TFT T8 may be supplied with the first gate high potential voltage GVdd1 through the fourth TFTs T4*a* and T4*b*. Therefore, the fourth TFTs T4*a* and T4*b* may completely turn off the eighth TFT T8 turned off by the (n+4)th carry signal CS[n+4] of a low voltage by increasing a voltage difference between the gate voltage of the eighth TFT T8 and the fourth odd control node 1Qho. As a result, a voltage drop (or current leakage) of the first odd control node 1Qo through the eighth TFT T8 which is turned off may be prevented from occurring, whereby the voltage of the first odd control node 1Qo may stably be maintained.

The ninth and tenth TFTs T9 and T10 may be embodied to control the potential of each of the first odd control node 1Qo and the fourth odd control node 1Qho through the third gate low potential voltage GVss3 in response to the voltage of the third odd control node 1Qbe. The ninth and tenth TFTs T9 and T10 may be expressed as third odd discharge circuits.

The ninth TFT T9 may be embodied to control the potential of the fourth odd control node 1Qho through the third gate low potential voltage GVss3 in response to the voltage of the third odd control node 1Qbe. For example, the ninth TFT T9 may be turned on in accordance with the high voltage of the third odd control node 1Qbe to discharge or reset the potential of the fourth odd control node 1Qho to the third gate low potential voltage GVss3.

The tenth TFT T10 may electrically connect the first odd control node 1Qo with the fourth odd control node 1Qho in response to the voltage of the third odd control node 1Qbe. For example, the tenth TFT T10 may be turned on by the high voltage of the third odd control node 1Qbe simultaneously with the ninth TFT T9 to supply the third gate low potential voltage GVss3 supplied through the ninth TFT T9 and the fourth odd control node 1Qho, to the first odd control node 1Qo, thereby discharging or resetting the potential of the first odd control node 1Qo to the third gate low potential voltage GVss3.

The fourth odd control node 1Qho between the ninth TFT T9 and the tenth TFT T10 may be supplied with the first gate high potential voltage GVdd1 through the fourth TFTs T4*a* and T4*b*. Therefore, the fourth TFTs T4*a* and T4*b* may completely turn off the tenth TFT T10 turned off by the (n+4)th carry signal CS[n+4] of a low voltage by increasing a voltage difference between the gate voltage of the tenth TFT T10 and the fourth odd control node 1Qho. As a result, a voltage drop (or current leakage) of the first odd control node 1Qo through the tenth TFT T10 which is turned off may be prevented from occurring, whereby the voltage of the first odd control node 1Qo may stably be maintained.

The first inverter circuit IC1 according to one embodiment may include 11th to 15th TFTs T11*a*, T11*b*, T12, T13, T14 and T15.

The 11th TFTs T11*a* and T11*b* may supply the third gate high potential voltage GVddo to a second connection node Nc2 in response to the third gate high potential voltage GVddo. The 11th TFTs T11*a* and T11*b* according to one embodiment may include (11-1)th and (11-2)th TFTs T11*a* and T11*b* electrically connected with each other in series between the third gate high potential voltage line and the second connection node Nc2 to prevent the leakage current due to the off current from occurring.

The (11-1)th TFT T11*a* may be turned on by the third gate high potential voltage GVddo to supply the third gate high potential voltage GVddo to the (11-2)th TFT T11*b*. For example, the (11-1)th TFT T11*a* may be connected to the third gate high potential voltage line in the form of diode.

The (11-2)th TFT T11*b* may be turned on by the third gate high potential voltage GVddo simultaneously with the (11-1)th TFT T11*a* to supply the third gate high potential voltage GVddo supplied through the (11-1)th TFT T11*a*, to the second connection node Nc2.

The 12th TFT T12 may be turned on or turned off in accordance with a voltage of the second connection node Nc2, and may supply the third gate high potential voltage GVddo to the second odd control node 1Qbo when it is turned on.

The 13th TFT T13 may be turned on or turned off in accordance with the voltage of the first odd control node 1Qo, and may discharge or reset the potential of the second odd control node 1Qbo to the third gate low potential voltage GVss3 when it is turned on.

The 14th TFT T14 may be turned on or turned off in accordance with the voltage of the first odd control node 1Qo, and may discharge or reset the potential of the second connection node Nc2 to the second gate low potential voltage GVss2 when it is turned on.

The 15th TFT T15 may be turned on or turned off in accordance with the voltage of the first even control node 2Qe of the (n+1)th stage circuit ST[n+1], and may discharge or reset the potential of the second connection node Nc2 to the second gate low potential voltage GVss2 when it is turned on.

The first sensing control circuit SCC1 according to one embodiment may include 16th to 222nd TFTs T16 to T22, and a precharging capacitor Cpc.

The 16th to 18th TFTs T16 to T18 and the precharging capacitor Cpc may be embodied to control the fifth odd control node 1Qmo through the (n−2)th carry signal CS[n−2] in response to the line sensing preparation signal LSPS and the (n−2)th carry signal CS[n−2](or a second front carry signal). The 16th to 18th TFTs T16 to T18 and the precharging capacitor Cpc may be expressed as line sensing preparation circuits or line sensing precharging circuits for precharging the voltage of the fifth odd control node 1Qmo in the display mode. For example, the fifth odd control node 1Qmo may be expressed as a memory node or precharging node for the sensing mode.

The 16th TFT T16 may output the (n−2)th carry signal CS[n−2] to a third connection node Nc3 in response to the line sensing preparation signal LSPS. For example, in the image display mode, the 16th TFT T16 may be turned on in accordance with the line sensing selection pulse LSP1 transferred through the sensing preparation signal line, to output the (n−2)th carry signal CS[n−2] of a high voltage synchronized with the line sensing selection pulse LSP1 to the third connection node Nc3. In the image display mode, the 16th TFT T16 may be turned on in accordance with the line sensing release pulse LSP2 transferred through the sensing preparation signal line, to output the (n−2)th carry signal CS[n−2] of a low voltage to the third connection node Nc3.

The 17th TFT T17 may electrically connect the third connection node Nc3 with the fifth odd control node 1Qmo in response to the line sensing preparation signal LSPS. For example, the 17th TFT T17 may be turned on in accordance with the line sensing preparation signal LSP of a high voltage simultaneously with the 16th TFT T16 to supply the (n−2)th carry signal CS[n−2] supplied through the 17th TFT T17 and the third connection node Nc3, to the fifth odd control node 1Qmo. The third connection node Nc3 may be a connection line between the 16th TFT T16 and the 17th TFT T17.

The 18th TFT T18 may supply the first gate high potential voltage GVdd1 to the third connection node Nc3 in response to the voltage of the fifth odd control node 1Qmo. For example, the 18th TFT T18 may be turned on in accordance with the high voltage of the fifth odd control node 1Qmo to supply the first gate high potential voltage GVdd1 to the third connection node Nc3, thereby preventing a voltage leakage of the fifth odd control node 1Qmo from occurring. For example, the 18th TFT T18 may turn off the 16th TFT T16 turned off by the line sensing preparation signal LSPS of a low voltage by increasing a voltage difference between the gate voltage of the 16th TFT T16 and the third connection control node Nc3. As a result, a voltage drop (or current leakage) of the fifth odd control node 1Qmo through the 16th TFT T16 which is turned off may be prevented from occurring, whereby the voltage of the fifth odd control node 1Qmo may stably be maintained.

The precharging capacitor Cpc may be formed between the fifth odd control node 1Qmo and the first gate high potential voltage line to store a differential voltage between the voltage of the fifth odd control node 1Qmo and the first gate high potential voltage GVdd1. For example, a first electrode of the precharging capacitor Cpc may electrically be connected with the fifth odd control node 1Qmo connected to a gate electrode of the 18th TFT T18, and a second electrode of the precharging capacitor Cpc may electrically be connected with the fifth gate high potential voltage line. The precharging capacitor Cpc stores the high voltage of the (n−2)th carry signal CS[n−2] in accordance with turn-on of the 16th, 17th and 18th TFTs T16, T17 and T18, and maintains the voltage of the fifth odd control node 1Qmo for a certain time period by the voltage stored when the 16th, 17th and 18th TFTs T16, T17 and T18 are turned off. For example, the voltage of the fifth odd control node 1Qmo may be maintained until the 16th and 17th TFTs T16 and T17 are again turned on by the line sensing release pulse LSP2 of the line sensing preparation signal LSPS.

The 19th and 20th TFTs T19 and T20 may be embodied to control the potential of the first odd control node 1Qo through the first gate high potential voltage GVdd1 in response to the voltage of the fifth odd control node 1Qmo and the first reset signal RST1. The 19th and 20th TFTs T19 and T20 may be expressed as sensing line selection circuits.

The 19th TFT T19 may output the first gate high potential voltage GVdd1 to a sharing node Ns in response to the voltage of the fifth odd control node 1Qmo. For example, the 19th TFT T19 may be turned on in accordance with the high voltage of the fifth odd control node 1Qmo precharged with the first gate high potential voltage GVdd1 to supply the first gate high potential voltage GVdd1 to the sharing node Ns.

The 20th TFT T20 may electrically connect the 19th TFT T19 to the first odd control node 1Qo in response to the first reset signal RST1. For example, the 20th TFT T20 may be turned on in accordance with the first reset signal RST1 of the high voltage to supply the first gate high potential voltage GVdd1 supplied through the 19th TFT T19 and the sharing node Ns, to the first odd control node 1Qo, thereby charging the first gate high potential voltage GVdd1 in the first odd control node 1Qo to activate the first odd control node 1Qo.

The 21st and 22nd TFTs T21 and T22 may be embodied to discharge or reset the potential of the first odd control node 1Qo to the third gate low potential voltage GVss3 in response to the display panel on signal POS supplied when the display apparatus is powered on. The 21st and 22nd TFTs T21 and T22 may be expressed as first stage initialization circuits.

The 21st TFT T21 may supply the third gate low potential voltage GVss3 supplied through the third gate low potential voltage line to the fourth odd control node 1Qho in response to the display panel on signal POS. For example, the 21st TFT T21 may be turned on in accordance with the display panel on signal POS of the high voltage to discharge or reset the potential of the fourth odd control node 1Qo to the third gate low potential voltage GVss3.

The 22nd TFT T22 may electrically connect the first odd control node 1Qo with the fourth odd control node 1Qho in response to the display panel on signal POS. For example, the 22nd TFT T22 may be turned on in accordance with the display panel on signal POS of the high voltage simultaneously with the 21st TFT T21 to supply the third gate low potential voltage GVss3 supplied through the 21st TFT T21 and the fourth odd control node 1Qho, to the first odd control node 1Qo, thereby charging or resetting the potential of the first odd control node 1Qo to the third gate low potential voltage GVss3.

The fourth odd control node 1Qho between the 21st TFT T21 and the 22nd TFT T22 may be supplied with the first gate high potential voltage GVdd1 through the fourth TFTs T4*a* and T4*b* of the first control circuit NCC1. Therefore, the fourth TFTs T4*a* and T4*b* may completely turn off the 22st TFT T22 turned off by the display panel on signal POS of the low voltage by increasing a voltage difference between a gate voltage of the 22st TFT T22 and the fourth odd control node 1Qho. As a result, a voltage drop (or current leakage) of the first odd control node 1Qo through the 22st TFT T22 which is turned off may be prevented from occurring, whereby the voltage of the first odd control node 1Qo may stably be maintained.

Optionally, the first sensing control circuit SCC1 may be omitted. That is, since the first sensing control circuit SCC1 is a circuit used to sense driving characteristics of the pixel in accordance with the sensing mode, if the pixel is not driven in the sensing mode, the first sensing control circuit SCC1 is an unnecessary element and thus may be omitted.

The first node reset circuit NRC1 according to one embodiment may include 23rd to 28th TFTs T21 to T28.

The 23rd TFT T23 may be embodied to control the potential of the second odd control node 1Qbo through the third gate low potential voltage GVss3 in response to the (n−3)th carry signal CS[n−3]. The 23rd TFT T23 may be expressed as a (1-1)th reset circuit.

The 23rd TFT T23 may be turned on in accordance with the (n−3)th carry signal CS[n−3] of the high voltage in the display mode to discharge or reset the potential of the second odd control node 1Qbo to the third gate low potential voltage GVss3.

The 24th and 25th TFTs T24 and T35 may be embodied to control the potential of the second odd control node 1Qbo through the third gate low potential voltage GVss3 in response to the voltage of the fifth odd control node 1Qmo and the first reset signal RST1. The 24th and 35th TFTs T24 and T25 may be expressed as (1-2)th reset circuits.

The 24th TFT T24 may supply the third gate low potential voltage GVss3 to a fourth connection node Nc4 in response to the fifth odd control node 1Qmo. For example, the 24th TFT T24 may be turned on in accordance with the high voltage of the fifth odd control node 1Qmo to supply the third gate low potential voltage GVss3 to the fourth connection node Nc4.

The 25th TFT T25 may electrically connect the second odd control node 1Qbo to the fourth connection node Nc4 in response to the first reset signal RST1. For example, the 25th TFT T25 may be turned on in accordance with the first reset signal RST1 of the high voltage to supply the third gate low potential voltage GVss3 supplied through the 24th TFT T24 and the fourth connection node Nc4, to the second odd control node 1Qbo. The fourth connection node Nc4 may be a connection line between the 24th TFT T24 and the 25th TFT T25.

The 26th to 28th TFTs T26, T27 and T28 may be embodied to control the potential of the first odd control node 1Qo with the third gate low potential voltage GVss3 in response to the voltage of the fourth odd control node 1Qho, the voltage of the fifth odd control node 1Qmo and the second reset signal RST2, in the sensing mode. The 26th to 28th TFTs T26, T27 and T28 may be expressed as fourth odd discharge circuits.

The 26th to 28th TFTs T26, T27 and T28 may electrically be connected in series between the first odd control node 1Qo and the fourth connection node Nc4 and electrically connect the first odd control node 1Qo with the fourth connection node Nc4 in response to the voltage of the fourth odd control node 1Qho, the voltage of the fifth odd control node 1Qmo and the second reset signal RST2.

The 26th TFT T26 may electrically connect the first odd control node 1Qo with the fifth connection node Nc5 in response to the second reset signal RST2. For example, the 26th TFT T26 may be turned on in accordance with the second reset signal RST2 of the high voltage to electrically connect the first odd control node 1Qo with the fifth connection node Nc5.

The 27th TFT T27 may electrically connect the fifth connection node Nc5 with the fourth odd control node 1Qho in response to the voltage of the fifth odd control node 1Qmo. For example, the 27th TFT T27 may be turned on in accordance with the high voltage of the fifth odd control node 1Qmo to electrically connect the fifth connection node Nc5 with the fourth odd control node 1Qho.

The 28th TFT T28 may electrically connect the fourth odd control node 1Qho with the fourth connection node Nc4 in response to the second reset signal RST2. For example, the 28th TFT T28 may be turned on in accordance with the second reset signal RST2 of the high voltage to electrically connect the fourth odd control node 1Qho with the fourth connection node Nc4.

Meanwhile, the 24th to 28th TFTs T24, T25, T26, T27 and T28 may be omitted when the first sensing control circuit SCC1 is omitted.

The first output buffer circuit OBC1 according to one embodiment may include 29th to 43th TFTs T29 to T43, and first to fifth coupling capacitors Cc1, Cc2, Cc3, Cc4 and Cc5.

The 29th to 31st TFTs T29, T30 and T31 and the first coupling capacitor Cc1 may output an nth scan shift clock SCLK[n] as the nth scan signal SC[n] in response to the voltages of the first to third odd control nodes 1Qo, 1Qbo and 1Qbe. The 29th to 31st TFTs T29, T30 and T31 and the first coupling capacitor Cc1 may be may be expressed as a first scan output circuit.

The 29th TFT T29 (or first odd pull-up TFT) may output the nth scan signal SC[n] having a scan pulse of a high voltage corresponding to the nth scan shift clock SCLK[n] to the first output node No1 in accordance with the voltage of the first odd control node 1Qo to supply the scan pulse of the nth scan signal SC[n] to the nth gate line. For example, the 29th TFT T29 may include a gate electrode connected to the first odd control node 1Qo, a first source/drain electrode connected to the first output node No1 (or scan output terminal), and a second source/drain electrode connected to the nth scan shift clock line.

According to one embodiment, as shown in FIGS. 5 and 6, based on the nth scan shift clock SCLK[n], the 29th TFT T29 may supply the first scan pulse SCP1 to the nth gate line group in the image display period of the display mode, and may supply the second scan pulse SCP2 to the nth gate line in the black display period of the display mode. In the sensing mode, when driving characteristics of the pixels embodied in the nth horizontal line are sensed, the 29th TFT T29 may additionally supply the third scan pulse SCP3 and the fourth scan pulse SCP4 to the nth gate line in the sensing period RSP based on the nth scan shift clock SCLK[n].

The 30th TFT T30 (or (1-1)th odd pull-down TFT) may output the nth scan signal SC[n] of a low voltage corresponding to the first gate low potential voltage GVss1 to the first output node No1 in accordance with the voltage of the second odd control node 1Qbo to supply the nth scan signal SC[n] of the low voltage to the nth gate line. For example, the 30th TFT T30 may include a gate electrode connected to the second odd control node 1Qbo, a first source/drain electrode connected to the first output node No1, and a second source/drain electrode connected to the first gate low potential voltage line.

The 31st TFT T34 (or (1-2)th odd pull-down TFT) may output the nth scan signal SC[n] of the low voltage corresponding to the first gate low potential voltage GVss1 to the first output node No1 in accordance with the voltage of the third odd control node 1Qbe to supply the nth scan signal SC[n] of the low voltage to the nth gate line. For example, the 31st TFT T31 may include a gate electrode connected to the third odd control node 1Qbe, a first source/drain electrode connected to the first output node No1, and a second source/drain electrode connected to the first gate low potential voltage line.

Since the 30th TFT T30 and the 31st TFT T31 are maintained at the turn-on state for a relatively longer time period than that of the 29th TFT T29, a degradation speed may be relatively faster than that of the 29th TFT T29. Therefore, the 30th TFT T10 and the 31st TFT T31 according to the present disclosure may be driven alternately on a certain time period basis in accordance with an opposite voltage of each of the second odd control node 1Qbo and the third odd control node 1Qbe, whereby the degradation speed may be delayed. For example, when the 30th TFT T30 is maintained at the turn-on state, the 31st TFT T31 may be maintained at the turn-off state. On the contrary, when the 30th TFT T30 is maintained at the turn-off state, the 31st TFT T31 may be maintained at the turn-on state.

The first coupling capacitor Cc1 may be embodied between the first odd control node 1Qo and the first output node No1. The first coupling capacitor Cc1 may generates bootstrapping in the first odd control node 1Qo in accordance with phase shift (or change) of the nth scan shift clock SCLK[n], whereby the 29th TFT T29 may completely turned on. As a result, the nth scan shift clock SCLK[n] of the high voltage may be output to the first output node No1 through the 29th TFT T29, which is completely turned, without loss.

The 32nd to 34th TFTs T32, T33 and T34 and the second coupling capacitor Cc2 may be embodied to output an (n+1)th scan shift clock SCLK[n+1] as the (n+1)th scan signal SC[n+1] in response to the voltages of the first to third odd control nodes 1Qo, 1Qbo and 1Qbe. The 32nd to 34th TFTs T32, T33 and T34 and the second coupling capacitor Cc2 may be may be expressed as a second scan output circuit.

The 32nd TFT T32 (or second odd pull-up TFT) may output the (n+1)th scan signal SC[n+1] having a scan pulse of a high voltage corresponding to the (n+1)th scan shift clock SCLK[n+1] to the second output node No2 in accordance with the voltage of the first odd control node 1Qo to supply the scan pulse of the (n+1)th scan signal SC[n+1] to (n+1)th gate line. For example, the 32nd TFT T32 may include a gate electrode connected to the first odd control node 1Qo, a first source/drain electrode connected to the second output node No2 (or sense output terminal), and a second source/drain electrode connected to the (n+1)th scan shift clock line.

According to one embodiment, as shown in FIGS. 5 and 6, based on the (n+1)th scan shift clock SCLK[n+1], the 32nd TFT T32 may supply the first scan pulse SCP1 to the (n+1)th gate line in the image display period of the display mode, and supply the second scan pulse SCP2 to the (n+1)th gate line in the black display period of the display mode. In the sensing mode, when driving characteristics of the pixels embodied in the nth horizontal line are sensed, the 32nd TFT T32 may additionally supply the third scan pulse SCP3 and fourth scan pulse SCP4 to the (n+1)th gate line in the sensing period RSP based on the (n+1)th scan shift clock SCLK[n+1].

The 33rd TFT T33 (or (2-1)th odd pull-down TFT) may output the (n+1)th scan signal SC[n+1] of a low voltage corresponding to the first gate low potential voltage GVss1 to the second output node No2 in accordance with the voltage of the second odd control node 1Qbo to supply the (n+1)th scan signal SC[n+1] of the low voltage to the second gate line of the nth gate line group. For example, the 33rd TFT T33 may include a gate electrode connected to the second odd control node 1Qbo, a first source/drain electrode connected to the second output node No2, and a second source/drain electrode connected to the first gate low potential voltage line.

The 34th TFT T34 (or (2-2)th odd pull-down TFT) may output the (n+1)th scan signal SC[n+1] of the low voltage corresponding to the first gate low potential voltage GVss1 to the second output node No2 in accordance with the voltage of the third odd control node 1Qbe to supply the (n+1)th scan signal SC[n+1] of the low voltage to the second gate line of the nth gate line group. For example, the 34th TFT T34 may include a gate electrode connected to the third odd control node 1Qbe, a first source/drain electrode connected to the second output node No2, and a second source/drain electrode connected to the first gate low potential voltage line.

The 33rd TFT T33 and the 34th TFT T34 may be driven alternately on a certain time period basis in accordance with an opposite voltage of each of the second odd control node 1Qbo and the third odd control node 1Qbe, whereby the degradation speed may be delayed.

The second coupling capacitor Cc2 may be embodied between the first odd control node 1Qo and the second output node No2. The second coupling capacitor Cc2 generates bootstrapping in the first odd control node 1Qo in accordance with phase shift (or change) of the (n+1)th scan shift clock SCLK[n+1], whereby the 32nd TFT T32 may completely turned on. As a result, the (n+1)th scan shift clock SCLK[n+1] of the high voltage may be output to the second output node No2 through the 32nd TFT T32, which is completely turned, without loss.

The 35th to 37th TFTs T35, T36 and T37 and the third coupling capacitor Cc3 may be embodied to output an (n+2)th scan shift clock SCLK[n+2] as the (n+2)th scan signal SC[n+2] in response to the voltages of the first to third odd control nodes 1Qo, 1Qbo and 1Qbe. The 35th to 37th TFTs T35, T36 and T37 and the third coupling capacitor Cc3 may be may be expressed as a third scan output circuit.

The 35th TFT T35 (or third odd pull-up TFT) may output the (n+2)th scan signal SC[n+2] having a scan pulse of a high voltage corresponding to the (n+2)th scan shift clock SCLK[n+2] to the third output node No3 in accordance with the voltage of the first odd control node 1Qo to supply the (n+2)th scan signal SC[n+2] of the high voltage to (n+2)th gate line. For example, the 35th TFT T35 may include a gate electrode connected to the first odd control node 1Qo, a first source/drain electrode connected to the third output node No3 (or scan output terminal), and a second source/drain electrode connected to the (n+2)th scan shift clock line.

According to one embodiment, as shown in FIGS. 5 and 6, based on the (n+2)th scan shift clock SCLK[n+2], the 35th TFT T35 may supply the first scan pulse SCP1 to the (n+2)th gate line in the image display period of the display mode, and supply the second scan pulse SCP2 to the (n+2)th gate line in the black display period of the display mode. In the sensing mode, when driving characteristics of the pixels embodied in the nth horizontal line are sensed, the 35th TFT T35 may additionally supply the third scan pulse SCP3 and fourth scan pulse SCP4 to the (n+2)th gate line in the sensing period RSP based on the (n+2)th scan shift clock SCLK[n+2].

The 36th TFT T36 (or (3-1)th odd pull-down TFT) may output the (n+2)th scan signal SC[n+2] of a low voltage corresponding to the first gate low potential voltage GVss1 to the third output node No3 in accordance with the voltage of the second odd control node 1Qbo to supply the (n+2)th scan signal SC[n+2] of the low voltage to the (n+2)th gate line. For example, the 36th TFT T36 may include a gate electrode connected to the second odd control node 1Qbo, a first source/drain electrode connected to the third output node No3, and a second source/drain electrode connected to the first gate low potential voltage line.

The 37th TFT T37 (or (3-2)th odd pull-down TFT) may output the (n+2)th scan signal SC[n+2] of the low voltage corresponding to the first gate low potential voltage GVss1 to the third output node No3 in accordance with the voltage of the third odd control node 1Qbe to supply the (n+2)th scan signal SC[n+2] of the low voltage to the (n+2)th gate line. For example, the 37th TFT T37 may include a gate electrode connected to the third odd control node 1Qbe, a first source/drain electrode connected to the third output node No3, and a second source/drain electrode connected to the first gate low potential voltage line.

The 36th TFT T36 and the 37th TFT T37 may be driven alternately on a certain time period basis in accordance with an opposite voltage of each of the second odd control node 1Qbo and the third odd control node 1Qbe, whereby the degradation speed may be delayed.

The third coupling capacitor Cc3 may be embodied between the first odd control node 1Qo and the third output node No3. The third coupling capacitor Cc3 may generate bootstrapping in the first odd control node 1Qo in accordance with phase shift (or change) of the (n+2)th scan shift clock SCLK[n+2], whereby the 35th TFT T35 may completely turned on. As a result, the (n+2)th scan shift clock SCLK[n+2] of the high voltage may be output to the third output node No3 through the 35th TFT T35, which is completely turned, without loss.

The 38th to 40th TFTs T38, T39 and T40 and the fourth coupling capacitor Cc4 may be embodied to output an (n+3)th scan shift clock SCLK[n+3] as the (n+3)th scan signal SC[n+3] in response to the voltages of the first to third odd control nodes 1Qo, 1Qbo and 1Qbe. The 38th to 40th TFTs T38, T39 and T40 and the fourth coupling capacitor Cc4 may be may be expressed as a fourth scan output circuit.

The 38th TFT T38 (or fourth odd pull-up TFT) may output the (n+3)th scan signal SC[n+3] having a scan pulse of a high voltage corresponding to the (n+3)th scan shift clock SCLK[n+3] to the fourth output node No4 in accordance with the voltage of the first odd control node 1Qo to supply the (n+3)th scan signal SC[n+3] of the high voltage to (n+3)th gate line. For example, the 38th TFT T38 may include a gate electrode connected to the first odd control node 1Qo, a first source/drain electrode connected to the third output node No4 (or scan output terminal), and a second source/drain electrode connected to the (n+3)th scan shift clock line.

According to one embodiment, as shown in FIGS. 5 and 6, based on the (n+3)th scan shift clock SCLK[n+3], the 38th TFT T38 may supply the first scan pulse SCP1 to the (n+3)th gate line in the image display period of the display mode, and supply the second scan pulse SCP2 to the (n+3)th gate line in the black display period of the display mode. In the sensing mode, when driving characteristics of the pixels embodied in the nth horizontal line are sensed, the 38th TFT T38 may additionally supply the third scan pulse SCP3 and fourth scan pulse SCP4 to the (n+3)th gate line in the sensing period RSP based on the (n+3)th scan shift clock SCLK[n+3].

The 39th TFT T39 (or (4-1)th odd pull-down TFT) may output the (n+3)th scan signal SC[n+3] of a low voltage corresponding to the first gate low potential voltage GVss1 to the fourth output node No4 in accordance with the voltage of the second odd control node 1Qbo to supply the (n+3)th scan signal SC[n+3] of the low voltage to the (n+3)th gate line. For example, the 39th TFT T39 may include a gate electrode connected to the second odd control node 1Qbo, a first source/drain electrode connected to the fourth output node No4, and a second source/drain electrode connected to the first gate low potential voltage line.

The 40th TFT T40 (or (4-2)th odd pull-down TFT) may output the (n+3)th scan signal SC[n+3] of the low voltage corresponding to the first gate low potential voltage GVss1 to the fourth output node No4 in accordance with the voltage of the third odd control node 1Qbe to supply the (n+3)th scan signal SC[n+3] of the low voltage to the (n+3)th gate line. For example, the 40th TFT T40 may include a gate electrode connected to the third odd control node 1Qbe, a first source/drain electrode connected to the fourth output node No4, and a second source/drain electrode connected to the first gate low potential voltage line.

The 39th TFT T39 and the 40th TFT T40 may be driven alternately on a certain time period basis in accordance with an opposite voltage of each of the second odd control node 1Qbo and the third odd control node 1Qbe, whereby the degradation speed may be delayed.

The fourth coupling capacitor Cc4 may be embodied between the first odd control node 1Qo and the fourth output node No4. The fourth coupling capacitor Cc4 may generate bootstrapping in the first odd control node 1Qo in accordance with phase shift (or change) of the (n+3)th scan shift clock SCLK[n+3], whereby the 38th TFT T38 may completely turned on. As a result, the (n+3)th scan shift clock SCLK[n+3] of the high voltage may be output to the fourth output node No4 through the 38th TFT T38, which is completely turned, without loss.

The 41st to 43rd TFTs T41, T42 and T43 and the fifth coupling capacitor Cc5 may be embodied to output an nth carry shift clock CCLK[n] as the nth carry signal CS[n] in response to the voltages of the first to third odd control nodes 1Qo, 1Qbo and 1Qbe. The 41st to 43rd TFTs T41, T42 and T43 and the fifth coupling capacitor Cc5 may be may be expressed as carry output circuits.

The 41st TFT T41 (or fifth odd pull-up TFT) may output the nth carry signal CS[n] having a carry pulse of a high voltage corresponding to the nth carry shift clock CCLK[n] to the fifth output node No5 in accordance with the voltage of the first odd control node 1Qo to supply the nth carry signal CS[n] of the high voltage to the front or rear stage circuit. According to one embodiment, based on the nth carry shift clock CCLK[n], the 41st TFT T41 may output the nth carry signal CS[n] to the front or rear stage circuit in the display mode based on the nth carry shift clock CCLK[n]. For example, the 41st TFT T41 may include a gate electrode connected to the first odd control node 1Qo, a first source/drain electrode connected to the fifth output node No5, and a second source/drain electrode connected to the nth carry shift clock line.

The 42rd TFT T42 (or (5-1)th odd pull-down TFT) may output the nth carry signal CS[n] of a low voltage corresponding to the third gate low potential voltage GVss3 to the fifth output node No5 in accordance with the voltage of the second odd control node 1Qbo to supply the nth carry signal CS[n] of the low voltage to the front or rear stage circuit. For example, the 42rd TFT T42 may include a gate electrode connected to the second odd control node 1Qbo, a first source/drain electrode connected to the fifth output node No5, and a second source/drain electrode connected to the third gate low potential voltage line.

The 43rd TFT T43 (or (5-2)th odd pull-down TFT) may output the nth carry signal CS[n] of the low voltage corresponding to the third gate low potential voltage GVss3 to the fifth output node No5 in accordance with the voltage of the third odd control node 1Qbe to supply the nth carry signal CS[n] of the low voltage to the front or rear stage circuit. For example, the 43rd TFT T43 may include a gate electrode connected to the third odd control node 1Qbe, a first source/drain electrode connected to the fifth output node No5, and a second source/drain electrode connected to the third gate low potential voltage line.

The 42nd TFT T42 and the 43rd TFT T43 according to the present disclosure may be driven alternately on a certain time period basis in accordance with an opposite voltage of each of the second odd control node 1Qbo and the third odd control node 1Qbe, whereby the degradation speed may be delayed.

The fifth coupling capacitor Cc5 may be embodied between the first odd control node 1Qo and the fifth output node No5. The fifth coupling capacitor Cc5 may generate bootstrapping in the first odd control node 1Qo in accordance with phase shift (or change) of the nth carry shift clock CCLK[n], whereby the 41st TFT T41 may completely turned on. As a result, the nth carry shift clock CCLK[n] of the high voltage may be output to the fifth output node No5 through the 41st TFT T41, which is completely turned, without loss.

The first and second coupling capacitors Cc1 and Cc2 of the first to fifth coupling capacitors Cc1 to Cc5 may generate coupling between a scan output circuit and a carry output circuit or serve as holding capacitors. In this case, the potential of the first odd control node 1Qo may be lowered, whereby driving characteristics and reliability of the gate driving circuit may be deteriorated. Therefore, in order to prevent coupling between the scan output circuit and the carry output circuit from occurring, the first to fourth coupling capacitors Cc1 to Cc4 may be omitted or the fifth coupling capacitor Cc5 may be omitted.

The (n+1)th stage circuit ST[n+1] according to one embodiment of the present disclosure may include a second sensing control circuit SCC2, a second node control circuit NCC2, a second inverter circuit IC2, a second node reset circuit NRC2, and a second output buffer circuit OBC2, which are selectively connected to the first to fifth even control nodes 2Qe, 2Qbo, 2Qbe, 2Qhe and 2Qme. The (n+1)th stage circuit ST[n+1] may be embodied to be substantially the same as the nth stage circuit ST[n] except the second sensing control circuit SCC2.

The (n+1)th stage circuit ST[n+1] according to one embodiment is substantially the same as the nth stage circuit ST[n] except that the (n+1)th stage circuit ST[n+1] shares the line sensing preparation circuit, the second odd control node 1Qbo, the third odd control node 1Qbe and the fourth odd control node 1Qmo and controls the potential of the first even control node 2Qe through the first gate high potential voltage GVdd1 in response to the (n−2)th carry signal CS[n−2] and the fourth gate high potential voltage GVdde. Therefore, the same reference numerals will be given to the same elements of the (n+1)th stage circuit ST[n+1] as those of the nth stage circuit ST[n], and a repeated description of the same elements will be omitted or simplified.

The second node control circuit NCC2 according to one embodiment may include first to tenth TFTs T1 to T10. Since the second node control circuit NCC2 that includes the first to tenth TFTs T1 to T10 operates with the same elements in the same manner as the first node control circuit NCC1 of the nth stage circuit ST[n] except that it is connected with the first to third even control nodes 2Qo, 2Qbo and 2Qbe and the even control hold node 2Qbo, its repeated description will be omitted or simplified.

The first to fourth TFTs T1 to T4 serve to control or setup the potential of the second even control node 2Qbo, and thus may be expressed as second node setup circuits.

The first TFT T1 and the second TFT T2 may be embodied to be electrically connected between the first gate high potential voltage line for transferring the first gate high potential voltage GVdd1 and the first odd control node 1Qo in series and charge the first gate high potential voltage GVdd1 in the first even control node 2Qe in response to the (n−2)th carry signal CS[n−2].

The third TFTs T3*a* and T3*b* may be turned on in accordance with the second gate high potential voltage GVdd2 to supply the second gate high potential voltage GVdd2 to the first connection node Nc1 between the first TFT T1 and the second TFT T2, thereby preventing off current of the first TFT T1 and current leakage of the first even control node 2Qe from occurring.

The fourth TFTs T4*a* and T4*b* may be turned on in accordance with the high voltage of the first even control node 2Qe to supply the first gate high potential voltage GVdd1 to the fourth even control node 2Qhe.

The fifth and sixth TFTs T5 and T6 may be embodied to control the potential of each of the second even control node 2Qbo and the fourth even control node 2Qhe through the third gate low potential voltage GVss3 in response to the (n+4)th carry signal CS[n+4]. The fifth and sixth TFTs T5 and T6 may be expressed as first even discharge circuits.

The seventh and eighth TFTs T7 and T8 may be embodied to control the potential of each of the first even control node 2Qe and the fourth even control node 2Qhe through the third gate low potential voltage GVss3 in response to the voltage of the second even control node 2Qbo. The seventh and eighth TFTs T7 and T8 may be expressed as second even discharge circuits.

The ninth and tenth TFTs T9 and T10 may be embodied to control the potential of each of the first even control node 2Qe and the fourth even control node 2Qhe through the third gate low potential voltage GVss3 in response to the voltage of the third even control node 2Qbe. The ninth and tenth TFTs T9 and T10 may be expressed as third even discharge circuits.

The second inverter circuit IC2 according to one embodiment may include 11th to 15th TFTs T11 to T15. Since the second inverter circuit IC2 that includes the 11th to 15th TFTs T11 to T15 operates with the same elements in the same manner as the first inverter circuit IC1 of the nth stage circuit ST[n] except that it is connected with the first even control node 2Qo and the first odd control node 1Qo of the nth stage circuit, its repeated description will be omitted or simplified.

The 11th TFTs T11*a* and T11*b* may include (11-1)th and (11-2)th TFTs T11*a* and T11*b* electrically connected with each other in series between the fourth gate high potential voltage line and the second connection node Nc2 to prevent the leakage current due to the off current from occurring.

The 12th TFT T12 may be turned on or turned off in accordance with a voltage of the second connection node Nc2, and may supply the fourth gate high potential voltage GVdde to the second even control node 2Qbo when it is turned on.

The 13th TFT T13 may be turned on or turned off in accordance with the voltage of the first even control node 2Qe, and may discharge or reset the potential of the second even control node 2Qbo to the third gate low potential voltage GVss3 when it is turned on.

The 14th TFT T14 may be turned on or turned off in accordance with the voltage of the first even control node 1Qo, and may discharge or reset the potential of the second connection node Nc2 to the second gate low potential voltage GVss2 when it is turned on.

The 15th TFT T15 may be turned on or turned off in accordance with the voltage of the first even control node 2Qe of the (n+1)th stage circuit ST[n+1], and may discharge or reset the potential of the second connection node Nc2 to the second gate low potential voltage GVss2 when it is turned on.

The second sensing control circuit SCC2 according to one embodiment may include 20th to 22th TFTs T20, T21 and T22.

The 20th TFT T20 may be embodied to control the potential of the first even control node 2Qe through the first gate high potential voltage GVdd1 supplied from the first sensing control circuit SCC1 of the nth stage circuit ST[n] in response to the first reset signal RST1.

The 20th TFT T20 may be turned on in accordance with the first reset signal RST1 of the high voltage to supply the first gate high potential voltage GVdd1 supplied through the sharing node Ns of the nth stage circuit ST[n], to the first even control node 2Qe, thereby charging the first gate high potential voltage GVdd1 in the first even control node 2Qe to activate the first even control node 2Qe.

The 21st and 22nd TFTs T21 and T22 may be embodied to discharge or reset the potential of the first even control node 2Qe to the third gate low potential voltage GVss3 in response to the display panel on signal POS supplied when the display apparatus is powered on. The 21st and 22nd TFTs T21 and T22 may be expressed as second stage initialization circuits.

The 21st TFT T21 may be turned on in accordance with the display panel on signal POS of the high voltage to discharge or reset the potential of the fourth even control node 2Qhe to the third gate low potential voltage GVss3.

The 22nd TFT T22 may be turned on in accordance with the display panel on signal POS simultaneously with the 21st TFT T21 to supply the third gate low potential voltage GVss3 supplied through the 21st TFT T21 and the fourth even control node 2Qhe, to the first even control node 2Qe, thereby charging or resetting the potential of the first even control node 2Qe to the third gate low potential voltage GVss3.

Optionally, the second sensing control circuit SCC2 may be omitted when the nth stage circuit ST[n] is omitted.

The second node reset circuit NRC2 according to one embodiment may include 23rd to 28th TFTs T23 to T28. Since the second node reset circuit NRC2 that includes the 23rd to 28th TFTs T23 to T28 operates with the same elements in the same manner as the first node reset circuit NRC1 of the nth stage circuit ST[n] except that it is connected with the first even control node 2Qo and the second even control node 2Qbo, its repeated description will be omitted or simplified.

The 23rd TFT T23 may be embodied to control the potential of the second even control node 2Qbo through the third gate low potential voltage GVss3 in response to the (n−3)th carry signal CS[n−3]. The 23rd TFT T23 may be expressed as (2-1)th reset circuit.

The 23rd TFT T23 may be turned on in accordance with the (n−3)th carry signal CS[n−3] of the high voltage in the display mode to discharge or reset the potential of the second odd control node 1Qbo to the third gate low potential voltage GVss3.

The 24th and 25th TFTs T24 and T25 may be embodied to control the potential of the second even control node 2Qbo through the third gate low potential voltage GVss3 in response to the voltage of the fifth even control node 2Qme and the first reset signal RST1. The 24th and 25th TFTs T24 and T25 may be expressed as (2-2)th reset circuits.

The 26th to 28th TFTs T26, T27 and T28 may be embodied to control the potential of the first even control node 2Qe through the third gate low potential voltage GVss3 in response to the voltage of the fourth even control node 2Qhe, the voltage of the fifth even control node 2Qme and the second reset signal RST2. The 26th to 28th TFTs T26, T27 and T28 may be expressed as fourth even discharge circuits.

Meanwhile, the 24th to 28th TFTs T24 to T28 may be omitted when the second sensing control circuit SCC2 is omitted.

The second output buffer circuit OBC2 according to one embodiment may include 29th to 43rd TFTs T29 to T43, and first to fifth coupling capacitors Cc1, Cc2, Cc3, Cc4 and Cc5.

The 29th, 32nd, 35th and 38th TFTs T29, T32, T35 and T38 embodied in the second output buffer circuit OBC2 are even pull-up TFTs, and have the same TFT connection structure as that of the 29th, 32nd, 35th and 38th TFTs T29, T32, T35 and T38 of the aforementioned nth stage circuit ST[n] except that the (n+4)th to (n+7)th scan shift clocks SCLKn+4 to SCLK+7 as the (n+4)th to (n+7)th scan signals SS[n+4] to SS[n+7] in accordance with a given order in response to the voltage of the first even control node 2Qe. Therefore, the same reference numerals will be given to the same elements as those of the 29th, 32nd, 35th and 38th TFTs, and their repeated description will be omitted.

The 41st TFT T41 embodied in the second output buffer circuit OBC2 is an even pull-up TFT, and has the same TFT connection structure as that of the 41st TFT T41 of the aforementioned nth stage circuit ST[n] except that the (n+1)th carry shift clock CCLKn+1 is output as the (n+1)th carry signal CS[n+1] in response to the voltage of the first even control node 2Qe. Therefore, the same reference numerals as the elements of the 41st TFT T41 of the nth stage circuit ST[n] will be given to the elements as the 41st TFT T41 embodied in the second output buffer circuit OBC2, and their repeated description will be omitted.

Each of the first to fifth coupling capacitors Cc1, Cc2, Cc3, Cc4 and Cc5 embodied in the second output buffer circuit OBC2 serves to perform the substantially same function as that of the coupling capacitors of the nth stage circuit ST[n]. Therefore, the same reference numerals as the elements of the coupling capacitor of the nth stage circuit ST[n] will be given to the elements as each of the coupling capacitors Cc1, Cc2, Cc3, Cc4 and Cc5 embodied in the second output buffer circuit OBC2, and their repeated description will be omitted.

Figure 12:
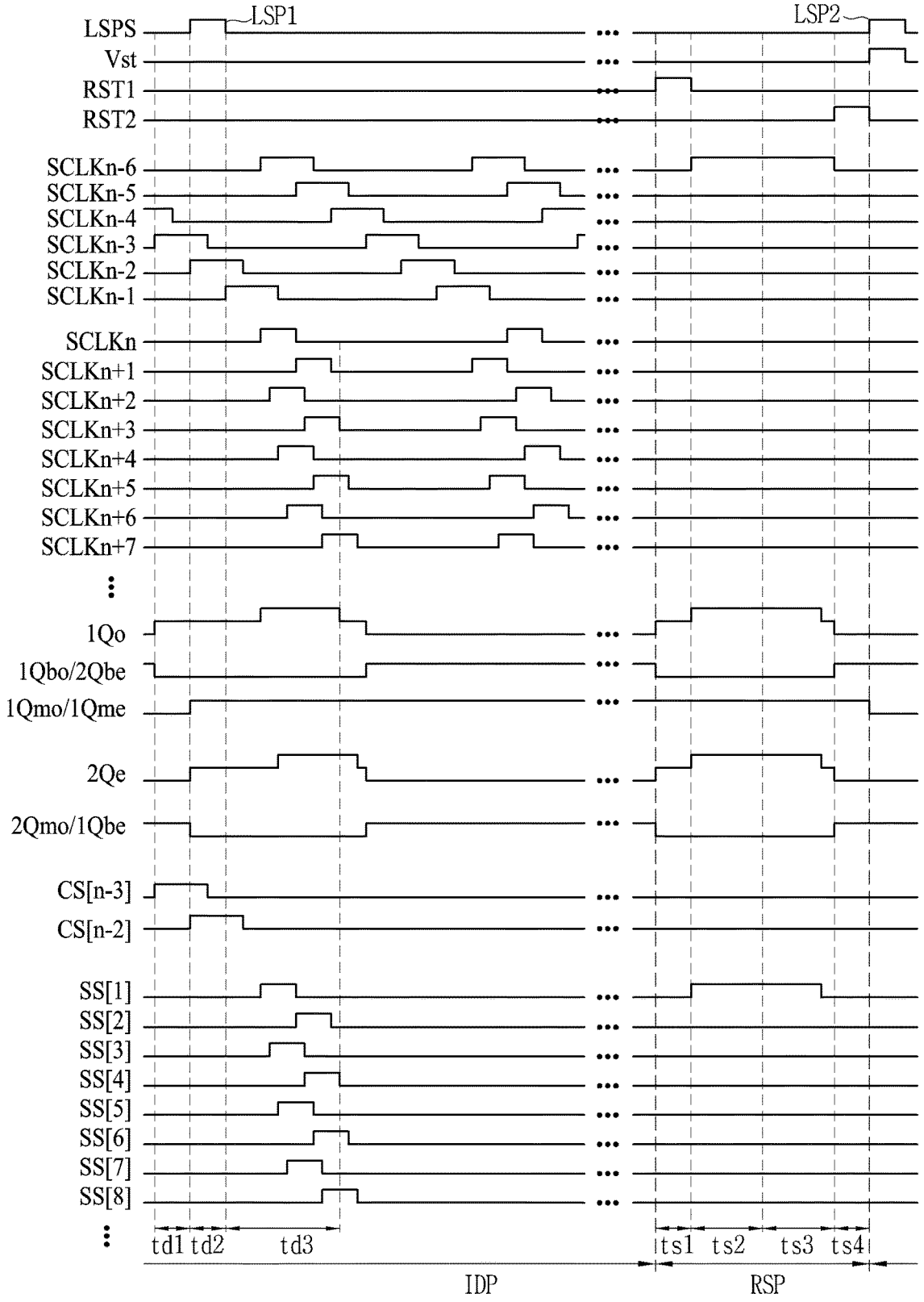
FIG. 12 is a view illustrating input and output waveforms of each of an nth stage circuit and an (n+1)th stage circuit shown in FIG. 11.

FIG. 12 is a view illustrating input and output waveforms of each of an nth stage circuit and an (n+1)th stage circuit shown in FIG. 11, and FIGS. 13A to 13H are views illustrating an operation process of each of an nth stage circuit and an (n+1)th stage circuit shown in FIG. 11. In FIGS. 13A to 13H, thick solid lines indicate nodes and turned-on TFTs, which have a potential of a high voltage or more, and thin solid lines indicate nodes and turned-off TFTs, which have a potential of a low voltage. In description of FIG. 12 and FIGS. 13A to 13H, operation description of TFTs embodied in the nth stage circuit and the (n+1)th stage circuit is substantially the same as the description in FIG. 11, its repeated description will be omitted.

Figure 13A:
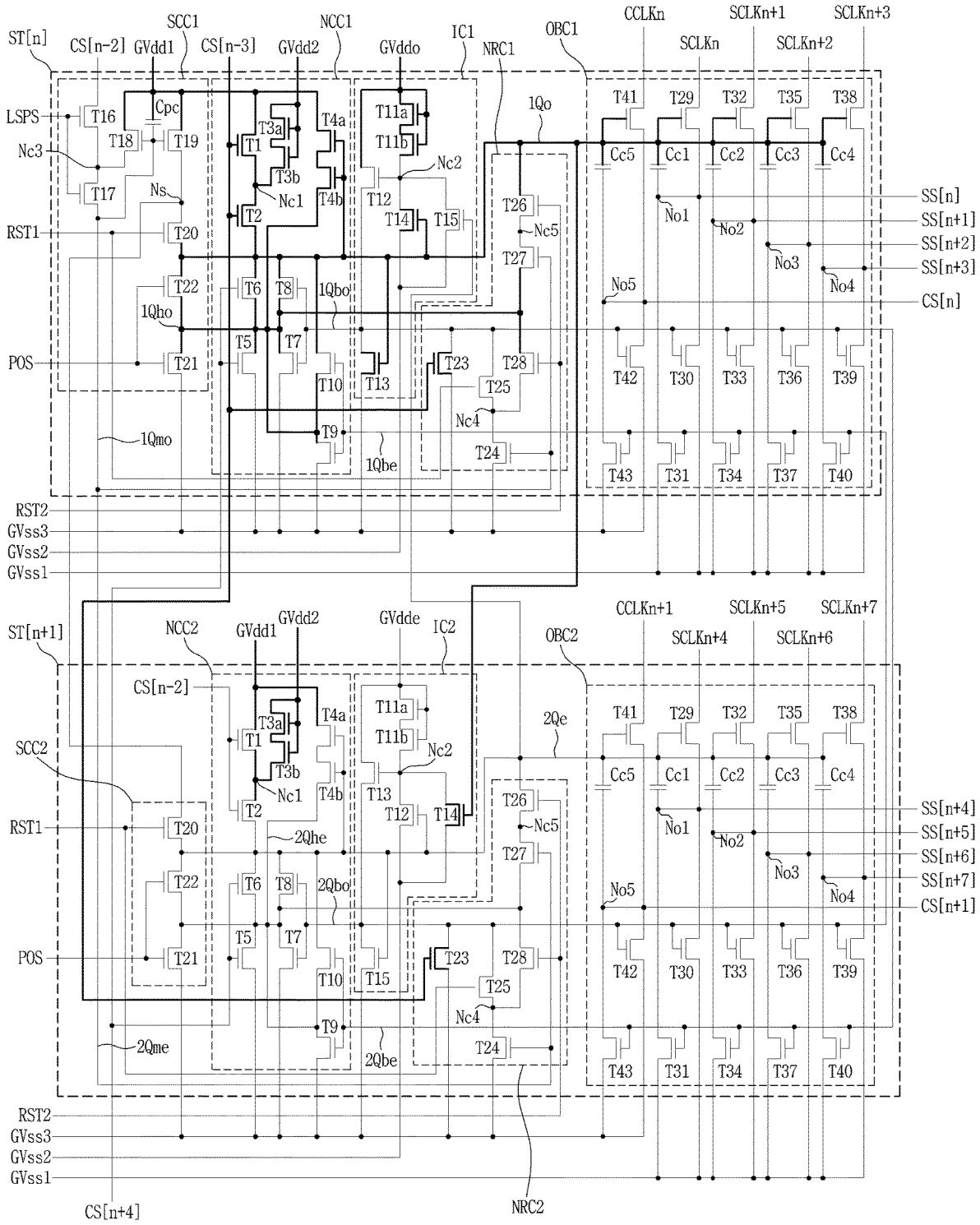
FIGS. 13A to 13H are views illustrating an operation process of each of an nth stage circuit and an (n+1)th stage circuit shown in FIG. 11.

Referring to FIGS. 12 and 13A, for a first display period td1 of the image display period IDP of the display mode according to one embodiment of the present disclosure, the first odd control node 1Qo of the nth stage circuit ST[n] is charged with the first gate high potential voltage GVdd1 in accordance with the operation of the first node control circuit NCC1 responding to the (n−3)th carry signal CS[n−3] of the high voltage. The second odd control node 1Qbo of the nth stage circuit ST[n] is discharged with the third gate low potential voltage GVss3 in accordance with the operation of the first inverter circuit IC1 responding to the charging voltage of the first odd control node 1Qo. The first odd control node 2Qe of the (n+1)th stage circuit ST[n+1] is discharged with the third gate low potential voltage GVss3 in accordance with the operation of the second inverter circuit IC2 responding to the charging voltage of the first odd control node 1Qo of the nth stage circuit ST[n]. The second even control node 2Qbo of the (n+1)th stage circuit ST[n+1] is discharged with the third gate low potential voltage GVss3 in accordance with the operation of the second node reset circuit NRC2 responding to the (n−3)th carry signal CS[n−3] of the high voltage. The third odd control node 1Qbe of the nth stage circuit ST[n] is connected with the second even control node 2Qbo of the (n+1)th stage circuit ST[n+1] and thus discharged with the third gate low potential voltage GVss3. The third even control node 2Qbe of the (n+1)th stage circuit ST[n+1] is connected with the second odd control node 1Qbo of the nth stage circuit ST[n] and thus discharged with the third gate low potential voltage GVss3.

At the first display period td1 of the image display period IDP, the first gate high potential voltage GVdd1 charged in the first odd control node 1Qo of the nth stage circuit ST[n] is supplied from the first gate high potential voltage line through two TFTs T1 and T2, whereby voltage charging characteristic of the first odd control node 1Qo may be enhanced.

At the first display period td1 of the image display period IDP, as each of the nth to (n+7)th scan shift clocks SCLK[n] to SCLK[n+7], the nth carry shift clock CCLK[n] and the (n+1)th carry shift clock CCLK[n+1] is maintained at the low voltage, bootstrapping is not generated in the first odd control node 1Qo, whereby each of the odd pull-up TFTs T29, T32, T35, T38 and T41 of the first output buffer circuit OBC1 is maintained at the turn-off state without being turned on.

Figure 13B:
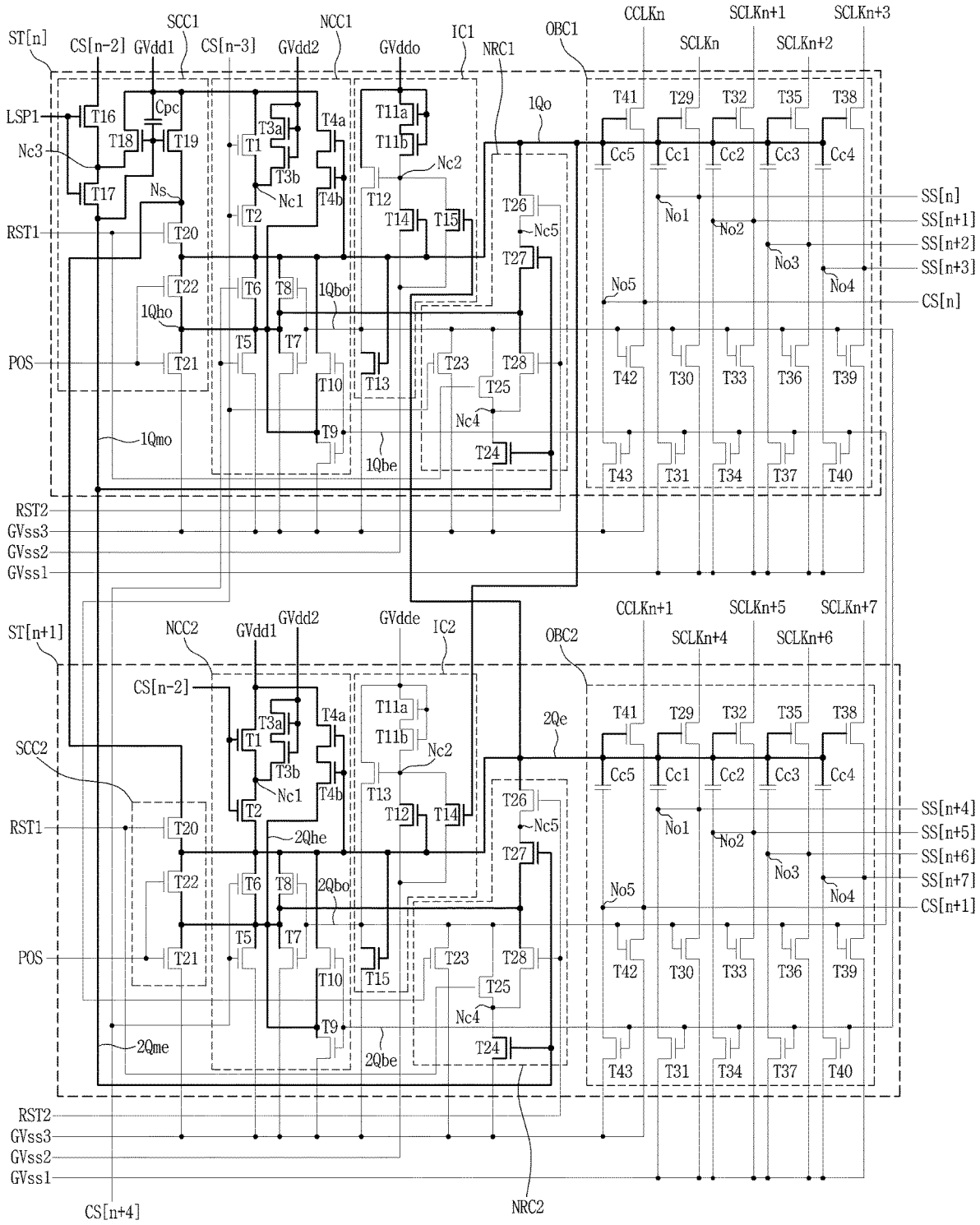

Referring to FIGS. 12 and 13B, for a second display period td2 of the image display period IDP of the display mode according to one embodiment of the present disclosure, the fifth odd control node 1Qmo of the nth stage circuit ST[n] is charged with the first gate high potential voltage GVdd1 in accordance with the operation of the first sensing control circuit SCC1 responding to the (n−2)th carry signal CS[n−2] of the high voltage and the line sensing selection pulse LSP1 of the line sensing preparation signal LSPS having a high voltage. The first odd control node 1Qo of the nth stage circuit ST[n] is maintained at the first gate high potential voltage GVdd1 charged for the first display period td1. The first even control node 2Qe of the (n+1)th stage circuit ST[n+1] is charged with the first gate high potential voltage GVdd1 in accordance with the operation of the second node control circuit NCC2 responding to the (n−2)th carry signal CS[n−2] of the high voltage. The first gate high potential voltage GVdd1 charged in the first even control node 2Qe is supplied from the first gate high potential voltage line through two TFTs T1 and T2, whereby voltage charging characteristics of the first even control node 2Qe may be enhanced. The second odd control node 1Qbo of the nth stage circuit ST[n] is maintained at the third gate low potential voltage GVss3 in accordance with the operation of the first inverter circuit IC1 responding to the charging voltage of the first odd control node 1Qo. The third even control node 2Qbe of the (n+1)th stage circuit ST[n+1] is connected with the second odd control node 1Qbo of the nth stage circuit ST[n] and thus maintained at the third gate low potential voltage GVss3. The second even control node 2Qbo of the (n+1)th stage circuit ST[n+1] is maintained at the third gate low potential voltage GVss3 in accordance with the operation of the second inverter circuit IC2 responding to the charging voltage of the first even control node 2Qe. The third odd control node 1Qbe of the nth stage circuit ST[n] is connected with the second even control node 2Qbo of the (n+1)th stage circuit ST[n+1] and thus maintained at the third gate low potential voltage GVss3.

At the second display period td2 of the image display period IDP, as each of the nth to (n+3)th scan shift clock SCLK[n] to SCLK[n+3] and the nth carry shift clock CCLK[n] is maintained at the low voltage, bootstrapping is not generated in the first odd control node 1Qo, whereby each of the odd pull-up TFTs T29, T32, T35, T38 and T41 of the first output buffer circuit OBC1 is maintained at the turn-off state without being turned on. And, as each of the (n+4)th to (n+7)th scan shift clocks SCLK[n+4] to SCLK[n+7] and the (n+1)th carry shift clock CCLK[n+1] is maintained at the low voltage, bootstrapping is not generated in the first even control node 2Qe, whereby each of the even pull-up TFTs T29, T32, T35, T38 and T41 of the second output buffer circuit OBC2 is maintained at the turn-off state without being turned on.

Figure 13C:
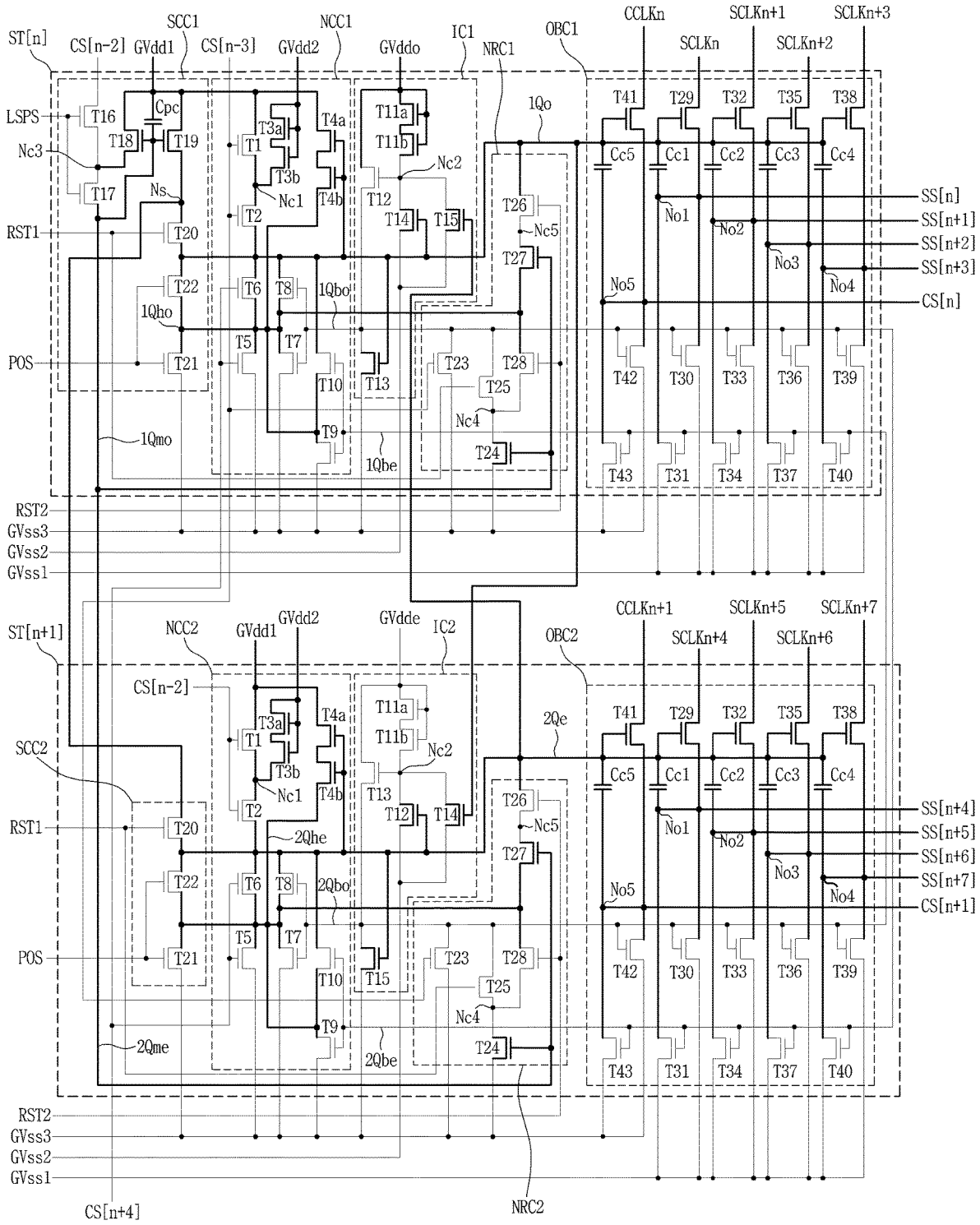

Referring to FIGS. 12 and 13C, for a third display period td3 of the image display period IDP of the display mode according to one embodiment of the present disclosure, each of the second to fifth odd control nodes 1Qbo, 1Qbe, 1Qho and 1Qmo of the nth stage circuit ST[n] and each of the first to fifth even control nodes 2Qe, 2Qbo, 2Qbe, 2Qhe and 2Qme of the (n+1)th stage circuit ST[n+1] maintains the voltage state of the second display period td2 as it is.

For the third display period td3 of the image display period IDP, as the nth to (n+)th scan shift clocks SCLK[n] to SCLK[n+3] and the nth carry shift clock CCLK[n] are sequentially input as the high voltages, bootstrapping is generated in the first odd control node 1Qo, whereby each of the odd pull-up TFTs T29, T32, T35, T38 and T41 of the first output buffer circuit OBC1 is completely turned on. Therefore, the nth stage circuit ST[n] outputs the nth to (n+3)th scan signals SS[n] to SS[n+3] having a first scan pulse SCP1 of a high voltage through each of the first to fourth output nodes No1 to No4 in a given order, and outputs the nth carry shift clock CCLK[n] as the nth carry signal CS[n] through the fifth output node No5. Therefore, an image data addressing period for the pixels corresponding to the nth to (n+3)th scan signals SS[n] to SS[n+3] may be performed.

At the third display period td3 of the image display period IDP, as the (n+4)th to (n+7)th scan shift clocks SCLK[n+4] to SCLK[n+7] and the (n+1)th carry shift clock CCLK[n+1] are sequentially input as the high voltages, bootstrapping is generated in the first even control node 2Qe, whereby each of the even pull-up TFTs T29, T32, T35, T38 and T41 of the second output buffer circuit OBC2 is completely turned on. Therefore, the (n+1)th stage circuit ST[n+1] outputs the (n+4)th to (n+7)th scan signals SS[n+4] to SS[n+7] having a first scan pulse SCP1 of a high voltage through each of the first to fourth output nodes No1 to No4 in a given order, and outputs the (n+1)th carry shift clock CCLK[n+1] as the (n+1)th carry signal CS[n+1] through the fifth output node No5. Therefore, an image data addressing period for the pixels corresponding to the (n+4)th to (n+7)th scan signals SS[n+4] to SS[n+7] may be performed.

Figure 13D:
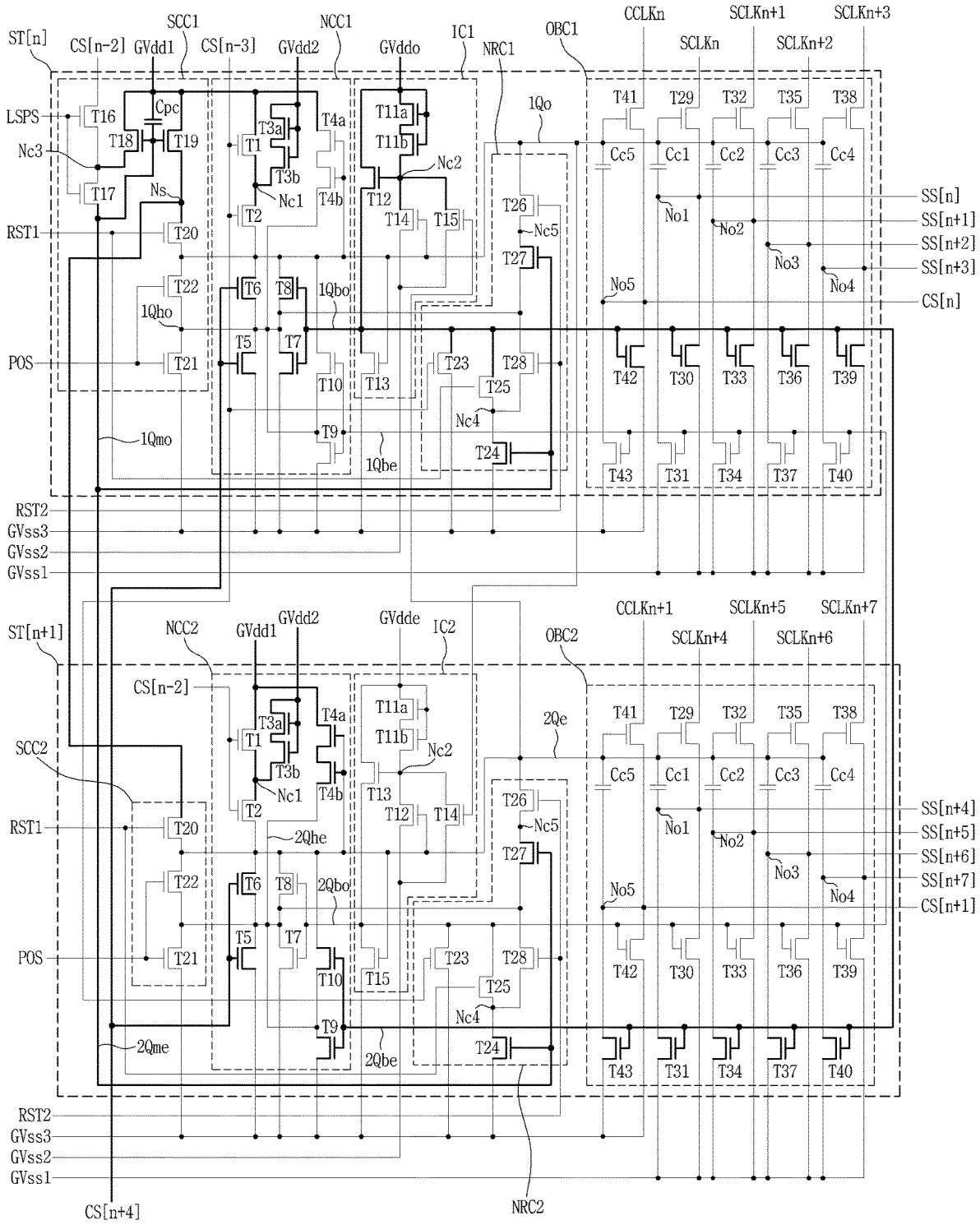

Referring to FIGS. 12 and 13D, after a third display period td3 of the image display period IDP of the display mode according to one embodiment of the present disclosure, the fifth odd control node 1Qmo of the nth stage circuit ST[n] maintains the charging state as it is.

After the third display period td3 of the image display period IDP, the first odd control node 1Qo of the nth stage circuit ST[n] is discharged with the third gate low potential voltage GVss3 in accordance with the operation of the first node control circuit NCC1 responding to the (n+4)th carry signal CS[n+4] (or the (n+3)th carry signal CS[n+3]) of the high voltage. The second odd control node 1Qbo of the nth stage circuit ST[n] is charged with the third gate high potential voltage GVddo in accordance with the operation of the first inverter circuit IC1 responding to discharge of the first odd control node 1Qo.

Therefore, as each of the odd pull-down TFTs T30, T33, T36, T39 and T42 is turned on by the charging voltage of the second odd control node 1Qbo, the first output buffer circuit OBC1 outputs the nth to (n+3)th scan signals SS[n] to SS[n+3] of the low voltage through each of the first to fourth output nodes No1 to No4, and outputs the nth carry signal CS[n] of the low voltage through the fifth output node No5. Therefore, the pixels addressed by the nth to (n+3)th scan signals SS[n] to SS[n+3] may emit light in accordance with a data current corresponding to an image data voltage which is addressed.

After the third display period td3 of the image display period IDP, the first even control node 2Qe of the (n+1)th stage circuit ST[n+1] is discharged with the third gate low potential voltage GVss3 in accordance with the operation of the second node control circuit NCC2 responding to the (n+4)th carry signal CS[n+4] of the high voltage. The third even control node 2Qbe of the (n+1)th stage circuit ST[n+1] is connected with the second odd control node 1Qbo of the nth stage circuit ST[n] and thus charged with the third gate high potential voltage GVddo. Therefore, as each of the even pull-down TFTs T31, T34, T37, T40 and T43 is turned on by the charging voltage of the third even control node 2Qbe, the second output buffer circuit OBC2 outputs the (n+4)th to (n+7)th scan signals SS[n+4] to SS[n+7] of the low voltage through each of the first to fourth output nodes No1 to No4, and outputs the (n+1)th carry signal CS[n+1] of the low voltage through the fifth output node No5. Therefore, the pixels addressed by the (n+4)th to (n+7)th scan signals SS[n+4] to SS[n+7] may emit light in accordance with a data current corresponding to an image data voltage which is addressed.

Optionally, after the third display period td3 of the image display period IDP of the display mode according to one embodiment of the present disclosure, each voltage of the first odd control node 1Qo of the nth stage circuit ST[n] and the first even control node 2Qe of the (n+1)th stage circuit ST[n+1] is reset. Then, at the black display period of the black mode, the nth stage circuit ST[n] and the (n+1)th stage circuit ST[n+1] may operate equally to the display periods td1, td2 and td3 of FIGS. 13A to 13C in accordance with the (n−3)th carry signal CS[n−3] of the high voltage to display a black image.

Figure 13E:
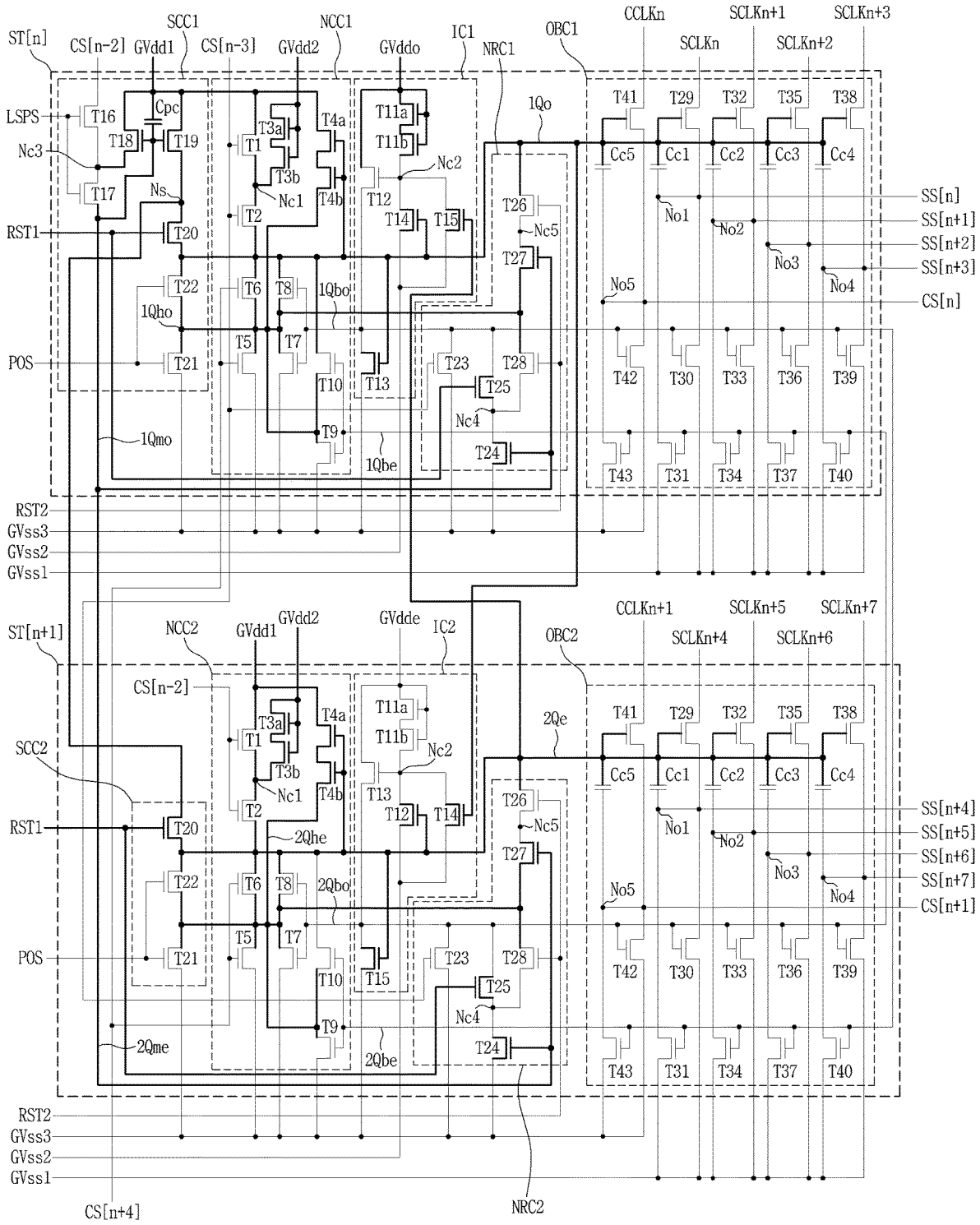

Referring to FIGS. 12 and 13E, at the first sensing period ts1 of the sensing period RSP of the sensing mode according to one embodiment of the present disclosure, the first odd control node 1Qo of the nth stage circuit ST[n] is charged with the first gate high potential voltage GVdd1 in accordance with the operation of the first sensing control circuit SCC1 responding to the first reset signal RST1 of the high voltage. The second odd control node 1Qbo of the nth stage circuit ST[n] is discharged with the third gate low potential voltage GVss3 in accordance with the operation of the first inverter circuit IC1 responding to the charging voltage of the first odd control node 1Qo.

For the first sensing period ts1 of the sensing period RSP, the first even control node 2Qe of the (n+1)th stage circuit ST[n+1] is discharged with the first gate high potential voltage GVdd1 supplied through the sharing node Ns of the nth stage circuit ST[n] in accordance with the operation of the second sensing control circuit SCC2 responding to the first reset signal RST1 of the high voltage. The second even control node 2Qbo of the (n+1)th stage circuit ST[n+1] is discharged with the third gate low potential voltage GVss3 in accordance with the operation of the second inverter circuit IC2 responding to the charging voltage of the first even control node 2Qe.

At the first sensing period ts1 of the sensing period RSP, as each of the nth to (n+3)th scan shift clocks SCLK[n] to SCLK[n+3] and the nth carry shift clock CCLK[n] is maintained at the low voltage, bootstrapping is not generated in the first odd control node 1Qo, whereby each of the odd pull-up TFTs T29, T32, T35, T38 and T41 of the first output buffer circuit OBC1 is maintained at the turn-off state without being turned on. Likewise, at the first sensing period ts1 of the sensing period RSP, as each of the (n+4)th to (n+7)th scan shift clocks SCLK[n+4] to SCLK[n+7] and the (n+1)th carry shift clock CCLK[n+1] is maintained at the low voltage, bootstrapping is not generated in the first even control node 2Qe, whereby each of the even pull-up TFTs T29, T32, T35, T38 and T41 of the second output buffer circuit OBC2 is maintained at the turn-off state without being turned on.

Figure 13F:
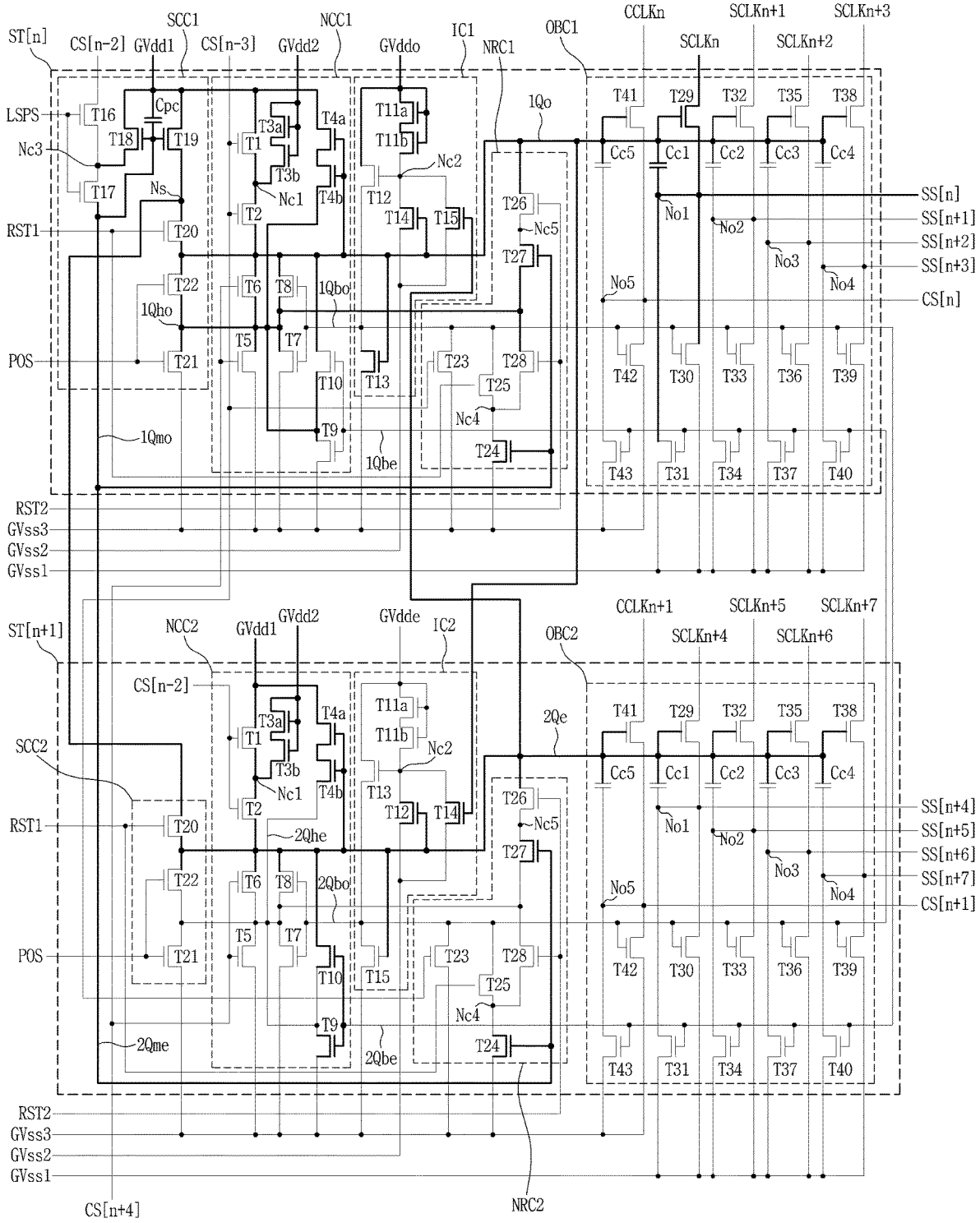

Referring to FIGS. 12 and 13F, for the second sensing period ts2 of the sensing period RSP of the sensing mode according to one embodiment of the present disclosure, the nth scan clock SCCLK[n] is input as the high voltage and the nth carry clock CRCLK[n] is input as the low voltage, bootstrapping is generated in the first odd control node 1Qo, whereby each of the odd pull-up TFTs T29, T32, T35, T38 and T41 of the first output buffer circuit OBC1 is completely turned on. Therefore, the nth stage circuit ST[n] outputs the nth scan signal SC[n] having a third scan pulse SCP3 of a high voltage through the first output node No1. Therefore, a sensing data addressing period for the pixels disposed in the nth horizontal line may be performed for the second sensing period ts2 of the sensing period RSP.

At the second sensing period ts2 of the sensing period RSP, as the rest of clocks except the (n)th scan shift clock SCCLK[n] are maintained at the low voltage, bootstrapping is not generated in the first even control node 2Qe, whereby each of the even pull-up TFTs T29, T32, 35, T38 and T41 of the second output buffer circuit OBC2 is maintained at the turn-off state without being turned on.

After the sensing period ts2 of the sensing period RSP, the (n+2)th scan signal SC[n+2] may maintain the first high voltage for the third sensing period ts3, whereby a sampling period for sensing driving characteristics of the subpixels disposed in the (n+2)th horizontal line may be performed.

At the third sensing period ts3 of the sensing period RSP, the (n+2)th scan signal SC[n+2] may maintain the first high voltage as it is, whereby a data restoring period for restoring a light emission state of the pixels disposed in the (n+2)th horizontal line to a previous state of the sensing period RSP may be performed.

Figure 13G:
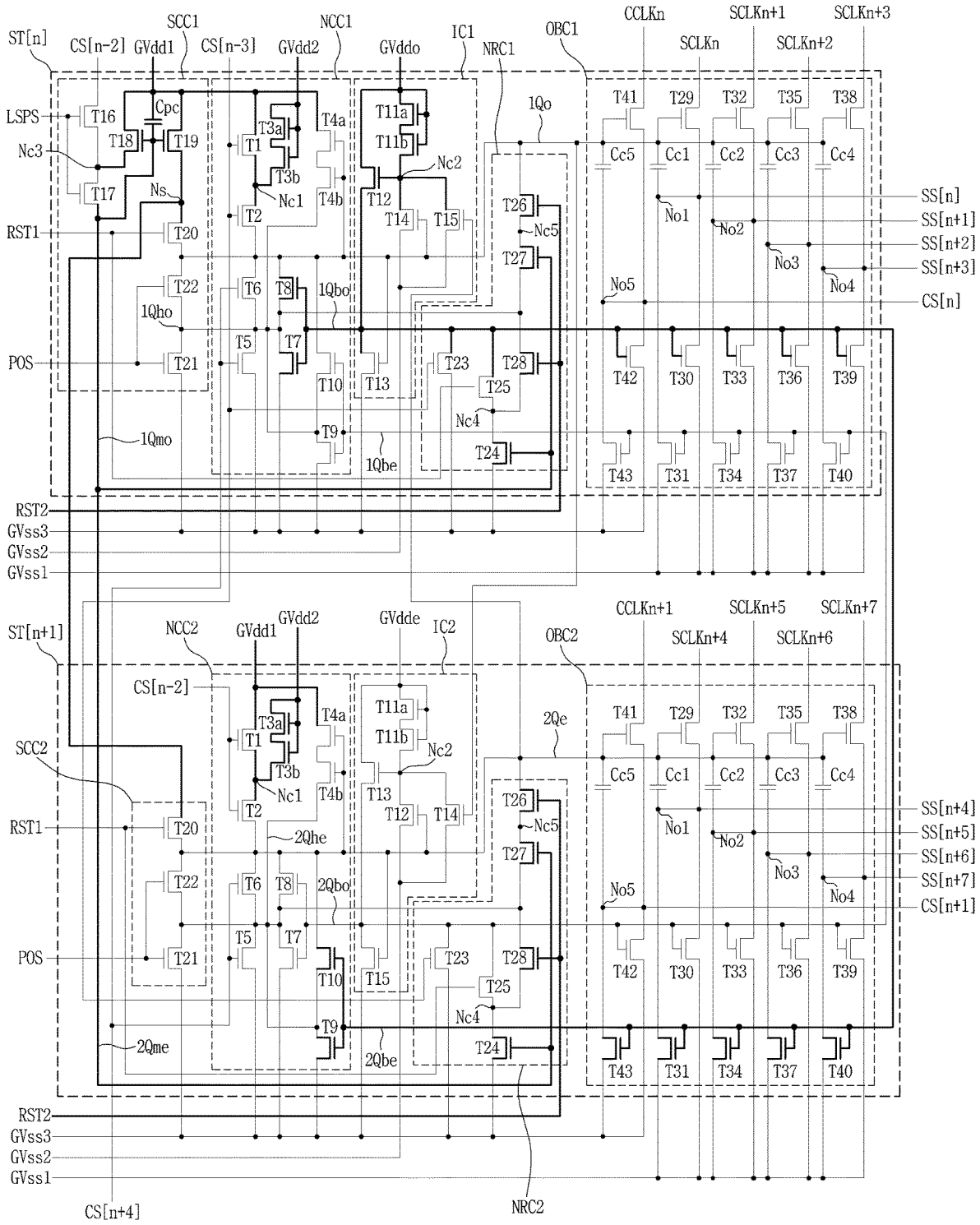

Referring to FIGS. 12 and 13G, for the fourth sensing period ts4 of the sensing period RSP of the sensing mode according to one embodiment of the present disclosure, the first odd control node 1Qo of the nth stage circuit ST[n] is discharged with the third gate low potential voltage GVss3 in accordance with the operation of the first node reset circuit NRC1 responding to the second reset signal RST2 of the high voltage and the charging voltage of the fifth odd control node 1Qmo. Therefore, the sensing mode for the pixels disposed in the nth horizontal line may be released.

At the fourth sensing period ts4 of the sensing period RSP, the second odd control node 1Qbo of the nth stage circuit ST[n] is charged with the third gate high potential voltage GVddo in accordance with the operation of the first inverter circuit IC1 responding to the discharge voltage of the first odd control node 1Qo. Therefore, as each of the odd pull-down TFTs T30, T33, T36, T39 and T42 is turned on by the charging voltage of the second odd control node 1Qbo, the first output buffer circuit OBC1 outputs the nth to (n+3)th scan signals SC[n] to SC[n+1] of a low voltage through the first to fourth output nodes No1 to No4, outputs the nth carry signal CS[n] of a low voltage through the fifth output node No5.

For the fourth sensing period ts4 of the sensing period RSP, the first odd control node 2Qe of the (n+1)th stage circuit ST[n+1] is discharged with the third gate low potential voltage GVss3 in accordance with the operation of the second node reset circuit NRC2 responding to the second reset signal RST2 of the high voltage and the discharge voltage of the fifth odd control node 1Qmo. The third even control node 2Qbe of the (n+1)th stage circuit ST[n+1] is connected with the second odd control node 2Qbo of the nth stage circuit ST[n] and thus charged with the third gate high potential voltage GVddo. Therefore, as each of the even pull-down TFTs T31, T34, T37, T40 and T43 is turned on by the charging voltage of the third even control node 2Qbe, the second output buffer circuit OBC2 outputs the (n+4)th to (n+7)th scan signals SS[n+4] to SS[n+7] of a low voltage through each of the first to fourth output nodes No1 to No4, outputs the (n+1)th carry signal CS[n+1] of a low voltage through the fifth output node No5.

Figure 13H:
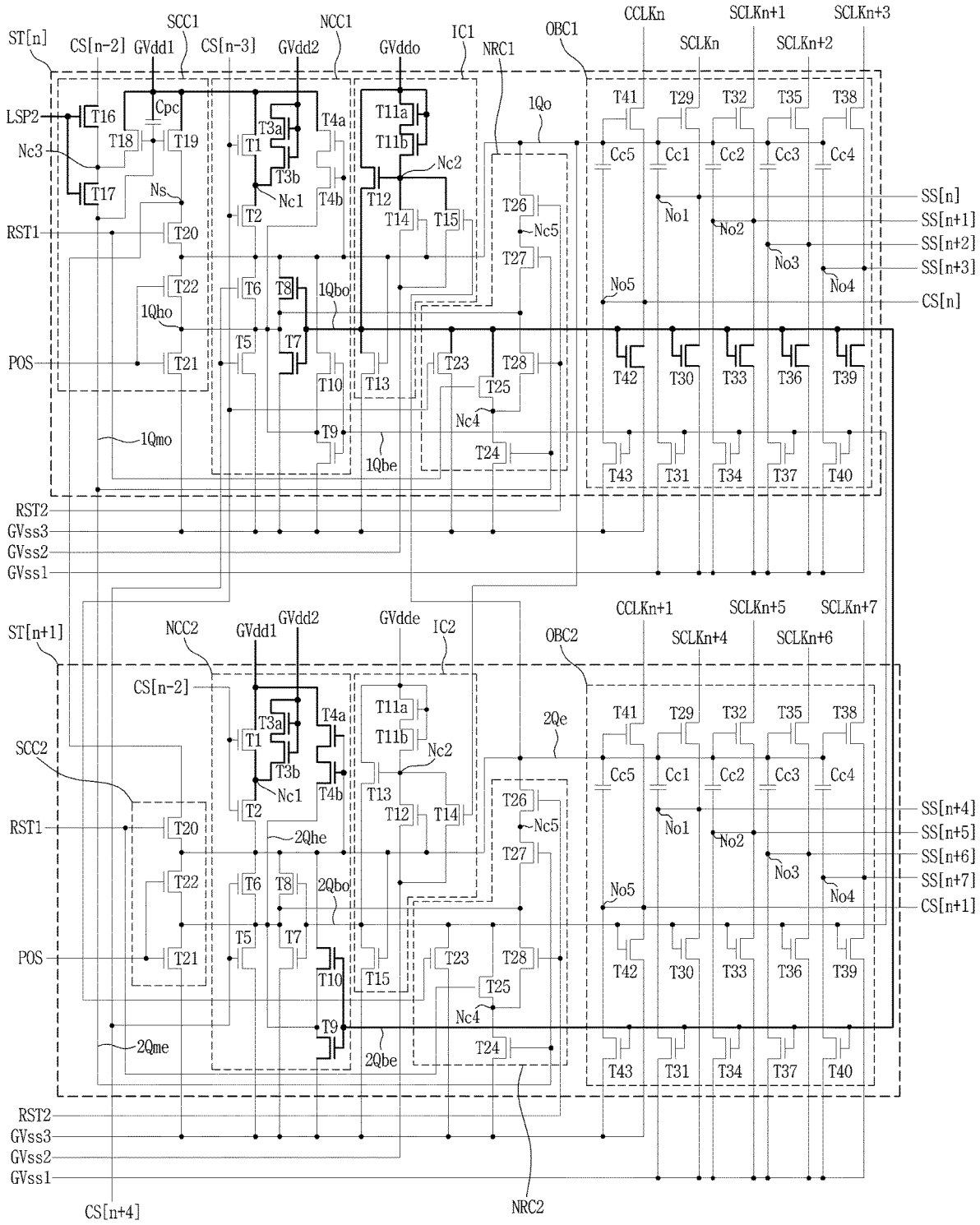

Referring to FIGS. 12 and 13H, at the start timing of the display mode after the sensing mode according to one embodiment of the present disclosure, the fifth odd control node 1Qmo of the nth stage circuit ST[n] is charged or discharged with the low voltage of the (n−2)th carry signal CS[n−2] in accordance with the operation of the first sensing control circuit SCC1 responding to the line sensing release pulse LSP2 having a high voltage of the line sensing preparation signal LSPS. The second odd control node 1Qbo of the nth stage circuit ST[n] maintains the charged state with the third gate high potential voltage GVddo. Therefore, as each of the odd pull-down TFTs T30, T33, T36, T39 and T42 is turned on by the charging voltage of the second odd control node 1Qbo, the first output buffer circuit OBC1 outputs the nth to (n+3)th scan signals SS[n] to SS[n+3] of a low voltage through each of the first to fourth output nodes No1 to No4, outputs the nth carry signal CS[n] of a low voltage through the fifth output node No5.

At the start timing of the display mode after the sensing mode, the third even control node 2Qbe of the (n+1)th stage circuit ST[n+1] is connected with the second odd control node 2Qbo of the nth stage circuit ST[n] and thus maintains the charged state with the third gate high potential voltage GVddo. Therefore, as each of the even pull-down TFTs T31, T34, T37, T40 and T43 is turned on by the charging voltage of the third even control node 2Qbe, the second output buffer circuit OBC2 outputs the (n+4)th to (n+7)th scan signals SS[n+4] to SS[n+7] of a low voltage through the first to fourth output nodes No1 to No4, outputs the (n+1)th carry signal CS[n+1] of a low voltage through the fifth output node No5.

Figure 14:
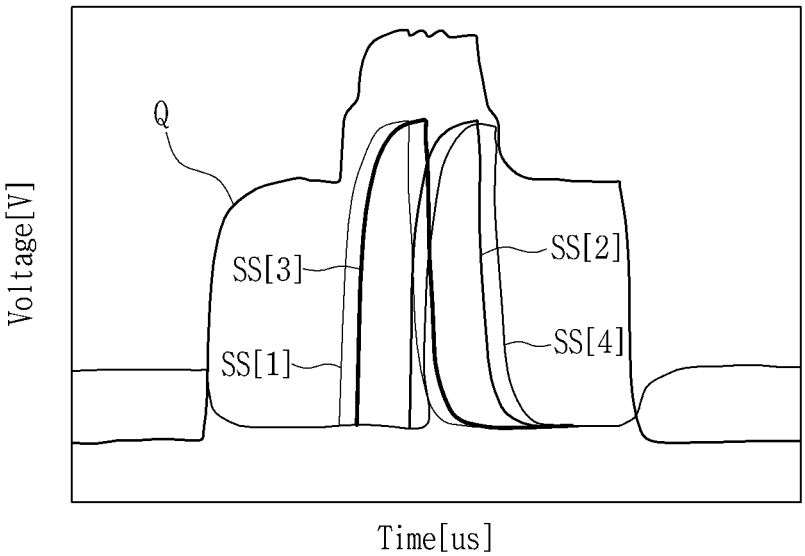
FIG. 14 is a waveform illustrating a voltage of a control node of one stage circuit and four scan output signals according to one embodiment of the present disclosure.

FIG. 14 is a waveform illustrating a voltage of a control node of one stage circuit and four scan output signals according to one embodiment of the present disclosure.

As will be aware of it from FIG. 14, it is noted that the stage circuit of the gate driving circuit according to one embodiment of the present disclosure normally outputs four scan signals SS[1], SS[2], SS[3] and SS[4] in response to a boosting voltage of the first control node Q.

Therefore, the gate driving circuit according to one embodiment of the present disclosure may output four scan signals SS[1], SS[2], SS[3] and SS[4] through one stage circuit. For this reason, a size of the gate driving circuit may be reduced, whereby a thin bezel of the display apparatus may be obtained.

A gate driving circuit and a display apparatus comprising the same according to an embodiment of the present disclosure will be described below.

A gate driving circuit according to one embodiment of the present disclosure may comprise first to mth stage circuits outputting a plurality of scan signals by dividing the scan signals into a first signal group and a second signal group, the first to mth stage circuits may be grouped into k number of stage groups having two adjacent stage circuits, stage circuits of jth stage group (j is a natural number of 1 to k−1) may output the scan signals of the first signal group to be earlier than the scan signals of the second signal group, and stage circuits of (j+1)th stage group may output the scan signals of the second signal group to be earlier than the scan signals of the first signal group.

According to one embodiment of the present disclosure, the first signal group may include odd numbered scan signals of the plurality of scan signals, and the second signal group may include even numbered scan signals of the plurality of scan signals.

According to one embodiment of the present disclosure, each of the first to mth stage circuits may output four scan signals, the first signal group may include two of the four scan signals, and the second signal group may include the other two of the four scan signals.

According to one embodiment of the present disclosure, each of the first to mth stage circuits may output four scan signals, the first signal group may include odd numbered scan signals of the four scan signals, and the second signal group may include even numbered scan signals of the four scan signals.

According to one embodiment of the present disclosure, each of the first to mth stage circuits may output four scan signals based on four scan shift clocks and one carry shift clock.

According to one embodiment of the present disclosure, each of the k number of stage groups may receive eight scan shift clocks, and odd numbered scan shift clocks of the eight scan shift clocks input to the jth stage group may be generated to be earlier than even numbered scan shift clocks.

According to one embodiment of the present disclosure, even numbered scan shift clocks of eight scan shift clocks input to the (j+1)th stage group may be generated to be earlier than odd numbered scan shift clocks.

A gate driving circuit according to one embodiment of the present disclosure may comprise a plurality of scan shift clock lines transferring a plurality of scan shift clocks, a plurality of carry shift clock lines transferring a plurality of carry shift clocks, and first to mth stage circuits selectively connected to the plurality of scan shift clock lines and connected to any one of the plurality of carry shift clock lines, the first to mth stage circuits may be grouped into k number of stage groups having two adjacent stage circuits, and the order of scan signals output from odd numbered stage groups of the k number of stage groups may be different from the order of scan signals output from even numbered stage groups.

According to one embodiment of the present disclosure, the plurality of scan shift clocks are grouped into first to third clock groups, and even numbered scan shift clocks of a plurality of scan shift clocks grouped into the second clock group may be generated to be earlier than odd numbered scan shift clocks.

According to one embodiment of the present disclosure, the odd numbered scan shift clocks of the plurality of scan shift clocks grouped into each of the first clock group and the third clock group may be generated to be earlier than the even numbered scan shift clocks.

According to one embodiment of the present disclosure, each of the first to mth stage circuits may include first to fifth control nodes, a node control circuit controlling a voltage of each of the first to fourth control nodes based on a first front carry signal, an inverter circuit controlling a voltage of the second control node in accordance with the voltage of the first control node, a sensing control circuit controlling a voltage of the fifth control node based on a line sensing preparation signal, a second front carry signal and a first reset signal, and a node reset circuit controlling the voltage of the first control node based on the voltage of the fifth control node and a second reset signal.

According to one embodiment of the present disclosure, the second control node embodied in an nth stage circuit of the first to mth stage circuits may be electrically connected with the third control node embodied in an (n+1)th stage circuit, and the third control node embodied in the nth stage circuit may be electrically connected with the second control node embodied in the (n+1)th stage circuit.

According to one embodiment of the present disclosure, the inverter circuit of the nth stage circuit may additionally control the voltage of the second control node of the nth stage circuit in accordance with the voltage of the first control node of the (n+1)th stage circuit, and the inverter circuit of the (n+1)th stage circuit may additionally control the voltage of the second control node of the (n+1)th stage circuit in accordance with the voltage of the first control node of the nth stage circuit.

According to one embodiment of the present disclosure, the sensing control circuit of the nth stage circuit may control the voltage of the fifth control node through a voltage of the second front carry signal in response to the line sensing preparation signal and the second front carry signal, output a first gate high potential voltage to a sharing node in accordance with the voltage of the fifth control node, and supply the first gate high potential voltage to the first control node in accordance with the first reset signal and the voltage of the fifth control node.

A display apparatus according to one embodiment of the present disclosure may comprise a display panel including a plurality of unit pixels having a plurality of subpixels, a plurality of gate line groups connected to the plurality of pixels, and a plurality of data and reference lines connected to the plurality of pixels overlapping the plurality of gate line groups, a gate driving circuit portion connected to the plurality of gate line groups, a data driving circuit portion connected to the plurality of data lines and the plurality of reference lines, and a timing controller controlling a driving timing of each of the gate driving circuit portion and the data driving circuit portion, the gate driving circuit portion may include first to mth stage circuits outputting a plurality of scan signals by dividing the scan signals into a first signal group and a second signal group, the first to mth stage circuits may be grouped into k number of stage groups having two adjacent stage circuits, stage circuits of jth stage group (j is a natural number of 1 to k−1) may output the scan signals of the first signal group to be earlier than the scan signals of the second signal group, and stage circuits of (j+1)th stage group may output the scan signals of the second signal group to be earlier than the scan signals of the first signal group.

According to one embodiment of the present disclosure, each of the plurality of unit pixels may include a first pixel group and a second pixel group, which has two adjacent subpixels, and the first pixel group and the second pixel group may be driven at their respective timings different from each other.

According to one embodiment of the present disclosure, the plurality of gate line groups may include a plurality of gate lines, and the first pixel group and the second pixel group may be connected to their respective gate lines different from each other.

According to one embodiment of the present disclosure, any one of the subpixels which belong to the first pixel group may be connected to the dame data line as the subpixels which belong to the second pixel group.

According to one embodiment of the present disclosure, the timing controller may control the display panel in a display mode and a sensing mode, the gate driving circuit portion may supply a scan signal to any one of the plurality of gate line groups in the sensing mode, and the data driving circuit portion may supply a sensing data voltage synchronized with the scan signal to the plurality of data lines and senses driving characteristics of the subpixels through the plurality of reference lines in the sensing mode.

According to one embodiment of the present disclosure, the timing controller may control the display mode in an image display period and a black display period, the gate driving circuit portion may supply only the scan signal to a first gate line corresponding to at least one of the plurality of gate line groups at the black display period, and the data driving circuit portion may supply a black data voltage synchronized with the scan signal to the plurality of data lines at the black display period.

A gate driving circuit and display apparatus including the same according to an embodiment of the present disclosure may be applied to all electronic apparatus including a display panel and/or a gate driving circuit built in the display panel. Example, gate driving circuit and display apparatus including the same according to an embodiment of the present disclosure may be applied to mobile devices, video phones, smart watches, watch phones, wearable devices, foldable devices, rollable devices, bendable devices, flexible devices, curved devices, portable multimedia players (PMPs), personal digital assistants (PDAs), electronic organizers, desktop personal computers (PCs), laptop PCs, netbook computers, workstations, navigation devices, automotive navigation devices, automotive display apparatuses, televisions (TVs), wall paper display apparatuses, signage devices, game machines, notebook computers, monitors, cameras, camcorders, home appliances, etc.

It will be apparent to those skilled in the art that the present disclosure described above is not limited by the above-described embodiments and the accompanying drawings and that various substitutions, modifications, and variations can be made in the present disclosure without departing from the spirit or scope of the disclosures. Consequently, the scope of the present disclosure is intended to cover all variations or modifications derived from the meaning, scope, and equivalent concept of the claims fall within the scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A gate driving circuit comprising first to $m^{th}$ stage circuits outputting a plurality of scan signals by dividing the plurality of scan signals into a first signal group and a second signal group, wherein:

the first to $m^{th}$ stage circuits are grouped into k number of stage groups having two adjacent stage circuits, stage circuits of $j^{th}$ stage group output the scan signals of the first signal group to be earlier than the scan signals of the second signal group, wherein j is a natural number within the range of 1 to k, and stage circuits of $(j+1)^{th}$ stage group output the scan signals of the second signal group to be earlier than the scan signals of the first signal group.

2. The gate driving circuit of claim 1, wherein the first signal group includes odd numbered scan signals of the plurality of scan signals, and the second signal group includes even numbered scan signals of the plurality of scan signals.

3. The gate driving circuit of claim 1, wherein:

each of the first to $m^{th}$ stage circuits outputs four scan signals, the first signal group includes two of the four scan signals, and the second signal group includes the other two of the four scan signals.

4. The gate driving circuit of claim 1, wherein:

each of the first to $m^{th}$ stage circuits outputs four scan signals, the first signal group includes odd numbered scan signals of the four scan signals, and the second signal group includes even numbered scan signals of the four scan signals.

5. The gate driving circuit of claim 1, wherein each of the first to $m^{th}$ stage circuits outputs four scan signals based on four scan shift clocks and one carry shift clock.

6. The gate driving circuit of claim 1, wherein:

each of the k number of stage groups receives eight scan shift clocks; and odd numbered scan shift clocks of the eight scan shift clocks input to the $j^{th}$ stage group are generated to be earlier than even numbered scan shift clocks.

7. The gate driving circuit of claim 6, wherein even numbered scan shift clocks of eight scan shift clocks input to the $(j+1)^{th}$ stage group are generated to be earlier than odd numbered scan shift clocks.

8. A gate driving circuit, comprising:

a plurality of scan shift clock lines transferring a plurality of scan shift clocks;

a plurality of carry shift clock lines transferring a plurality of carry shift clocks; and first to $m^{th}$ stage circuits selectively connected to the plurality of scan shift clock lines and connected to any one of the plurality of carry shift clock lines, wherein the first to $m^{th}$ stage circuits are grouped into k number of stage groups having two adjacent stage circuits, and wherein the order of scan signals output from odd numbered stage groups of the k number of stage groups is different from the order of scan signals output from even numbered stage groups.

9. The gate driving circuit of claim 8, wherein:

the plurality of scan shift clocks are grouped into first to third clock groups, and even numbered scan shift clocks of a plurality of scan shift clocks grouped into the second clock group are generated to be earlier than odd numbered scan shift clocks.

10. The gate driving circuit of claim 9, wherein the odd numbered scan shift clocks of the plurality of scan shift clocks grouped into each of the first clock group and the third clock group are generated to be earlier than the even numbered scan shift clocks.

11. The gate driving circuit of claim 8, wherein each of the first to $m^{th}$ stage circuits includes:

first to fifth control nodes;

a node control circuit controlling a voltage of each of the first to fourth control nodes based on a first front carry signal;

an inverter circuit controlling a voltage of the second control node in accordance with the voltage of the first control node;

a sensing control circuit controlling a voltage of the fifth control node based on a line sensing preparation signal, a second front carry signal, and a first reset signal; and a node reset circuit controlling the voltage of the first control node based on the voltage of the fifth control node and a second reset signal.

12. The gate driving circuit of claim 11, wherein:

the second control node embodied in an $n^{th}$ stage circuit of the first to $m^{th}$ stage circuits is electrically connected with the third control node embodied in an $(n+1)^{th}$ stage circuit; and the third control node embodied in the $n^{th}$ stage circuit is electrically connected with the second control node embodied in the $(n+1)^{th}$ stage circuit.

13. The gate driving circuit of claim 12, wherein:

an inverter circuit of the $n^{th}$ stage circuit additionally controls the voltage of the second control node of the nth stage circuit in accordance with the voltage of the first control node of the $(n+1)^{th}$ stage circuit; and an inverter circuit of the $(n+1)^{th}$ stage circuit additionally controls the voltage of the second control node of the $(n+1)^{th}$ stage circuit in accordance with the voltage of the first control node of the $n^{th}$ stage circuit.

14. The gate driving circuit of claim 12, wherein the sensing control circuit of the $n^{th}$ stage circuit controls the voltage of the fifth control node through a voltage of the second front carry signal in response to a line sensing preparation signal and the second front carry signal, outputs a first gate high potential voltage to a sharing node in accordance with the voltage of the fifth control node, and supplies the first gate high potential voltage to the first control node in accordance with the first reset signal and the voltage of the fifth control node.

15. A display apparatus, comprising:

a display panel including a plurality of unit pixels having a plurality of subpixels, a plurality of gate line groups connected to the plurality of pixels, and a plurality of data and reference lines connected to the plurality of pixels overlapping the plurality of gate line groups;

a gate driving circuit portion connected to the plurality of gate line groups;

a data driving circuit portion connected to the plurality of data lines and the plurality of reference lines; and a timing controller controlling a driving timing of each of the gate driving circuit portion and the data driving circuit portion, wherein the gate driving circuit portion includes a gate driving circuit including first to $m^{th}$ stage circuits outputting a plurality of scan signals by dividing the plurality of scan signals into a first signal group and a second signal group, wherein:

the first to $m^{th}$ stage circuits are grouped into k number of stage groups having two adjacent stage circuits, stage circuits of $j^{th}$ stage group output the scan signals of the first signal group to be earlier than the scan signals of the second signal group, wherein j is a natural number of 1 to k−1, and stage circuits of $(j+1)^{th}$ stage group output the scan signals of the second signal group to be earlier than the scan signals of the first signal group.

16. The display apparatus of claim 15, wherein:

the timing controller controls the display panel in a display mode and a sensing mode;

the gate driving circuit portion supplies a scan signal to any one of the plurality of gate line groups in the sensing mode; and the data driving circuit portion supplies a sensing data voltage synchronized with the scan signal to the plurality of data lines and senses driving characteristics of the subpixels through the plurality of reference lines in the sensing mode.

17. The display apparatus of claim 16, wherein:

the timing controller controls the display mode in an image display period and a black display period;

the gate driving circuit portion supplies only the scan signal to a first gate line corresponding to at least one of the plurality of gate line groups at the black display period; and the data driving circuit portion supplies a black data voltage synchronized with the scan signal to the plurality of data lines at the black display period.

18. The display apparatus of claim 15, wherein each of the plurality of unit pixels includes a first pixel group and a second pixel group, each of which has two adjacent subpixels, and the first pixel group and the second pixel group are driven at their respective timings different from each other.

19. The display apparatus of claim 18, wherein:

the plurality of gate line groups include a plurality of gate lines, and the first pixel group and the second pixel group are connected to their respective gate lines different from each other.

20. The display apparatus of claim 19, wherein any one of the subpixels which belong to the first pixel group is connected to the same data line as the subpixels which belong to the second pixel group.

* * * * *